US008173884B2

(12) United States Patent
Gatzsche et al.

(10) Patent No.: US 8,173,884 B2
(45) Date of Patent: May 8, 2012

(54) DEVICE AND METHOD FOR GENERATING A NOTE SIGNAL UPON A MANUAL INPUT

(75) Inventors: Gabriel Gatzsche, Martinroda (DE); Markus Mehnert, Heringen (DE); David Gatzsche, Weimar (DE)

(73) Assignees: Fraunhofer-Gesellschaft zur Foerderung der Angewandten Forschung e.V., Munich (DE); Technische Universitaet Ilmenau, Ilmenau (DE)

( * ) Notice: Subject to any disclaimer, the term of this patent is extended or adjusted under 35 U.S.C. 154(b) by 0 days.

(21) Appl. No.: 12/961,630

(22) Filed: Dec. 7, 2010

(65) Prior Publication Data

US 2011/0100198 A1 May 5, 2011

Related U.S. Application Data

(63) Continuation of application No. PCT/EP2009/003975, filed on Jun. 3, 2009.

(30) Foreign Application Priority Data

Jun. 13, 2008 (DE) ..... 10 2008 028 328

(51) Int. Cl.
*G10H 1/00* (2006.01)
*G10H 7/00* (2006.01)
*G10H 1/18* (2006.01)

(52) U.S. Cl. ..... 84/615; 84/644

(58) Field of Classification Search ..... 84/615, 84/644, 670, 743, 744
See application file for complete search history.

(56) References Cited

U.S. PATENT DOCUMENTS

| | | | | |
|---|---|---|---|---|
| 4,031,800 | A | 6/1977 | Thompson | |
| 4,821,619 | A | 4/1989 | Coles | |
| 4,833,962 | A | 5/1989 | Mazzola et al. | |
| 7,273,979 | B2 | 9/2007 | Christensen | |
| 2001/0052283 | A1 | 12/2001 | Boyer | |
| 2002/0134223 | A1 | 9/2002 | Wesley | |
| 2003/0209130 | A1 | 11/2003 | Anderson et al. | |
| 2006/0027080 | A1 | 2/2006 | Schultz | |
| 2006/0123982 | A1 | 6/2006 | Christensen | |
| 2007/0214947 | A1 * | 9/2007 | Nishibori et al. | 84/744 |
| 2008/0307945 | A1 | 12/2008 | Gatzsche et al. | |

(Continued)

FOREIGN PATENT DOCUMENTS

DE 10 2006 008 260 B3 7/2007

(Continued)

OTHER PUBLICATIONS

Official Communication issued in corresponding International Patent Application No. PCT/EP2009/003975, mailed on Mar. 17, 2011.

*Primary Examiner* — Jeffrey Donels
(74) *Attorney, Agent, or Firm* — Keating & Bennett, LLP

(57) ABSTRACT

An embodiment of a device for generating a note signal upon a manual input includes an operator to enable a user of the same as an input to define one or several points as an input signal, and a controller which is implemented to receive the input signal and to generate a note signal based on the input signal and an allocation function. The allocation function allocates one single or no tone to each point of a two-dimensional definition amount with a tone quality axis and a frequency axis. The definition amount has a plurality of base points. Here, exactly one tone is allocated to each of the base points.

19 Claims, 31 Drawing Sheets

U.S. PATENT DOCUMENTS

| | | | |
|---|---|---|---|
| 2009/0173216 | A1 | 7/2009 | Gatzsche et al. |

FOREIGN PATENT DOCUMENTS

| | | | |
|---|---|---|---|
| DE | 10 2006 008 298 | A1 | 8/2007 |
| EP | 0 218 576 | B1 | 3/1990 |
| GB | 2 131 592 | A | 6/1984 |
| WO | 86/05616 | A1 | 9/1986 |
| WO | 2006/050575 | A1 | 5/2006 |
| WO | 2007/096035 | A1 | 8/2007 |
| WO | 2007/096152 | A1 | 8/2007 |

* cited by examiner

DEVICE AND METHOD FOR GENERATING A NOTE SIGNAL UPON A MANUAL INPUT

BACKGROUND OF THE INVENTION

Embodiments of the present invention relate to devices and methods for generating a note signal upon a manual input, for example on an electronic musical instrument.

When making music or improvising regarding an existing piece of music or an existing chord sequence, frequently a fast and efficient input of tones is desired. Such a fast and efficient input of tones necessitates, however, in many cases a basic understanding of music and in particular for the musical instrument used for making music. Without this knowledge it is very difficult in particular for an inexperienced user and musician to generate tone combinations sounding harmonic and/or consonant at a sufficient speed.

Many of the classical musical instruments, for example, already necessitate substantial effort to produce even one single tone. These classical instruments include the trumpet and the saxophone. But also the specific generation of individual tones or even several tones can certainly be a challenging task with classical musical instruments. Thus, both in the case of keyboard or claviature-based instruments—like the piano or the organ—but also with string instruments—like the guitar—it is a challenge which should not be underestimated for a beginner to play single specific tones or even several specific tones—like, for example, a chord.

DE 10 2006 008 260 A1 and WO 2007/096035 A1 describe a device and a method for the analysis of an audio datum, wherein an audio datum is supplied to a semitone analysis means to be analyzed with respect to a volume information distribution. Via a vector calculation means based on the volume information distribution via two-dimensional intermediate vectors, a sum vector and an analysis signal based on the same are generated.

DE 10 2006 008 298 A1 and WO 2007/096152 A1 relate to a device and a method for generating a note signal and a device and a method for outputting an output signal indicating a tone quality. With such a device for generating a note signal, such a signal is generated on the basis of an input angle or an input angle range input by the user.

SUMMARY

According to an embodiment, a device for generating a note signal upon a manual input may have an operator which is implemented to enable, as an input, a user of the same to define one or several points as an input signal; and a controller implemented to receive the input signal and to generate a note signal based on the input signal and an allocation function, wherein the allocation function allocates one single or no tone to each point of a two-dimensional definition amount determined via an affine coordinate system and having a tone quality axis and a frequency axis; wherein the definition amount has a plurality of base points; wherein to each of the base points exactly one tone is allocated, which may be uniquely determined by a tone quality and a frequency; wherein to base points having the same coordinate on the tone quality axis tones having the same tone quality are allocated; wherein at least two of the base points having an identical coordinate on the tone quality axis exist which have different coordinates on the frequency axis; and wherein to each point of the definition amount which is not a base point either no tone or a tone associated to a base point is associated and, if there is a point which is not a base point and to which a tone is associated, this tone belongs to a simply connected area of the definition amount in which further a base point is located and in which the same tone is associated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area.

According to another embodiment, a method for generating a note signal upon a manual input into an operator, having the steps of receiving an input signal defining one or several points; and generating a note signal on the basis of an allocation function and the input signal, wherein the allocation function allocates one single or no tone to each point of a two-dimensional definition amount determined via an affine coordinate system and having a tone quality axis and a frequency axis; wherein the definition amount has a plurality of base points; wherein exactly one tone which may be uniquely determined by a tone quality and a frequency is allocated to each of the base points; wherein to base points having the same coordinate on the tone quality axis tones with the same tone quality are allocated; wherein at least two of the base points with an identical coordinate on the tone quality axis exist which have different coordinates on the frequency axis; and wherein either no tone or a tone allocated to a base point is allocated to each point of the definition amount which is not a base point and, if there is a point which is not a base point and to which a tone is allocated, this tone belongs to a simply connected area of the definition amount in which a base point is further located and in which the same tone is allocated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area.

According to another embodiment, a program may have a program code for executing a method for generating a note signal upon a manual input into an operator which may have the steps of receiving an input signal defining one or several points; and generating a note signal on the basis of an allocation function and the input signal, wherein the allocation function allocates one single or no tone to each point of a two-dimensional definition amount determined via an affine coordinate system and having a tone quality axis and a frequency axis; wherein the definition amount has a plurality of base points; wherein exactly one tone which may be uniquely determined by a tone quality and a frequency is allocated to each of the base points; wherein to base points having the same coordinate on the tone quality axis tones with the same tone quality are allocated; wherein at least two of the base points with an identical coordinate on the tone quality axis exist which have different coordinates on the frequency axis; and wherein either no tone or a tone allocated to a base point is allocated to each point of the definition amount which is not a base point and, if there is a point which is not a base point and to which a tone is allocated, this tone belongs to a simply connected area of the definition amount in which a base point is further located and in which the same tone is allocated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area, when the program is executed on a processor.

One embodiment of a device for generating a note signal upon a manual input includes an operating means implemented to enable a user of the same, as an input, to define one or several points as an input signal. It further includes a control means implemented to receive the input signal and to generate a note signal based on the input signal and an allocation function.

The allocation function allocates one single or no tone to each point of a two-dimensional definition quantity determined via an affine coordinate system having a tone quality axis and a frequency axis, wherein the definition quantity comprises a plurality of base points, wherein exactly one tone is allocated to each base point that may be uniquely determined by tone quality and frequency or tone quality and tone pitch information, and wherein one tone with a tone quality which also all the other tones comprise is allocated to each of the base points with one coordinate on the tone quality axis, wherein the tones are allocated to base points with the same coordinate on the tone quality axis. In embodiments of the present invention, a tone may already be clearly defined, for example, by a frequency, such as a basic frequency. In this case, this tone may comprise a certain tone quality. In this case, a tone may already be determined by the frequency.

At least two of the base points with one identical coordinate on the tone quality axis exist, which comprise different coordinates on the frequency axis, wherein either no tone or a tone allocated to a base point is allocated to each point of the definition amount or quantity which is not a base point, and, if a point exists which is not a base point and to which a tone is allocated, this tone belongs to a simply connected area of the definition amount in which, further, a base point is located and in which the same tone is allocated to all points.

A further embodiment of the present invention in the form of a device for generating a note signal upon a manual input includes an operating means which is implemented to enable a user of the same as an input to define an area with one or several points as an input signal. It further includes a control means which is implemented to receive the input signal and to generate a note signal based on the input signal and an allocation function. The allocation function allocates one single or no tone to each point of a two-dimensional definition amount with a tone quality axis and a frequency axis, wherein the definition amount comprises a plurality of base points, wherein exactly one tone is allocated to each of the base points which may be clearly determined by a tone quality and a frequency.

To each base point with a coordinate on the tone quality axis one tone with a tone quality is allocated which all other tones also have which are allocated to base points of the same coordinate. At least two of the base points with one identical coordinate on the tone quality axis exist which comprise different coordinates on the frequency axis. Either no tone or a tone allocated to a base point is allocated to each point of the definition amount which is not a base point, and, if there is one point which is not a base point and to which a tone is allocated, then this tone belongs to a simple coherent range of the definition amount in which, further, a base point is located and in which the same tone is allocated to all points.

The operating means is here further implemented to enable a user of the same to define an area as an input signal to define one or several points, wherein the area comprises a tone quality interval and wherein the tone quality interval depends on a lowest frequency of all points of the area. By this, if applicable, a tone combination perceived as being dissonant may be avoided.

Embodiments of the present invention are based on the finding that a simple and fast input of constantly sounding tones and an output of a corresponding note signal may be achieved by a user defining one or several points with respect to an allocation function, wherein base points and, if applicable, further points in an affine coordinate system are arranged with respect to their tone quality with regard to an axis and with regard to their frequency with respect to the other axes of the two-dimensional affine coordinate system. Here, according to this allocation given by an allocation function, tones are allocated to the base points and possibly further points. By the affine plotting on the one hand and by the separation regarding tone quality and frequency on the other hand, a user is here able to generate related tones and tone combinations more efficiently and simply.

Thus, in particular embodiments of the present invention may enable that by the use of this arrangement similar or related tone combinations may be generated very fast, which represents a possible advantage. In this respect, basically not only the two main relations have an effect which is "octave similarity" and "tone quality similarity", i.e. a consideration of chords having the same tone qualities as being related. Rather, also other relations may be specifically used. Octave similarity is here maybe the most important and fundamental one, as this principle is rooted in music of all cultures, e.g. also in classical Indian music. By this, possibly very simple constantly sounding tone combinations may be generated.

By a suitable arrangement of the tone qualities on the tone quality axis, the degrees of relationship may be specified more accurately. Thus, for example, relationships of thirds of the first degree or relationships of fifths may be used (e.g. by mapping the symmetry circle model or the third circle model on the tone quality axis) or melodic relationships by mapping a diatonic or other tone quality scales on the tone quality axis.

Depending on the specific form of an implementation according to an embodiment of the present invention, here melodic tone combinations may be generated. This is, however, not a compulsory precondition, as possibly, also by a certain arrangement of the tone quality lines on the tone quality axis, such tone quality arrangements are possible in which very dissonant tone combinations may be generated.

In embodiments of the present invention, the affine coordinate system is a Cartesian coordinate system. Possibly, the tone interval between one tone quality of a point allocated to a base point and a tone quality of a tone of a nearest neighboring point with respect to the tone quality axis is a prime, a minor third, a major third, a fourth or a fifth. Likewise, in some embodiments, it may be possible for the user to select an area, so that the point or the several points are determined by the area. This area may, for example, be by the input of a designated point of the area, a tone quality interval and a frequency interval or also by the selection of two designated points characteristic for the respective area with regard to the underlying coordinate system.

In embodiments, it may further be possible for the user to generate a changeover signal so that the allocation function is modified to obtain a modified allocation function. The same may then for example result from the allocation function by a shift with regard to the tone quality axis, with regard to the frequency axis of with regard to the tone quality axis and the frequency axis. Further, the modified allocation function may comprise a first point to which via the allocation function the same tone is allocated as via the modified allocation function, and may comprise a second point to which via the modified allocation function a tone having a tone quality is allocated which is different from a tone quality of a tone allocated to a point with the same coordinate on the tone quality axis via the allocation function. By this, it is, for example, possible to change the key or to alienate tones of a different key or other tones for a short or a longer term.

In further embodiments, the note signal may, for example, also include volume information with regard to one tone or several tones. This may, for example, be done by allocating volume information for points included in that range to one, a plurality, a variety or all coherent ranges of the definition amount, wherein the information is based on the coordinates of the points with respect to the tone quality axis and the frequency axis and a single tone volume function.

In further embodiments, the operating means may enable a user to define an area with a tone quality interval, wherein the tone quality interval depends on a lowest frequency of all points of the area. The tone quality interval may thus be reduced from a first value above a cutoff frequency to a second value below the cutoff frequency, wherein the second value is smaller than the first value. By this it is possible to avoid sound combinations in the low-frequency range, possibly perceived as unpleasant, i.e. for example in the bass.

In further embodiments of the present invention, for example the operating means may comprise a key panel with a two-dimensional raster of keys, wherein one point is allocated to each key, so that, via the allocation function, at least one tone or no tone is allocated to the keys. The raster of keys may here reproduce the allocation function. In further embodiments of the present invention, here either no tone, one tone or a plurality of tones may be allocated to each key of the key panel in a pre-stored way, so that such tones which are allocated via the allocation function to a plurality of points via a coherent area are allocated at least to each key to which a plurality of tones is allocated, wherein the point allocated to the key is part of the corresponding area. In particular in the case of an implementation of the operating means on the basis of a keypad, but also in the case of other implementations, thus a contemporary calculation on the basis of the allocation function is not necessary with every key stroke. The note signal may rather be allocated to a corresponding key in a pre-stored way, i.e. for example by a pre-computation and a permanent, non-volatile or volatile storage.

Further embodiments of the present invention are based on the finding that low sounding tone combinations perceived as dissonant which are not perceived as sounding dissonant in the range of higher frequencies may be avoided in the range of lower frequencies by basing a smaller tone quality interval on an area than in the region of higher frequencies. In other words, with devices according to these embodiments of the present invention, the operating means is implemented to enable in particular a user of the same to define an area with a tone quality interval, wherein the tone quality interval depends on a lowest frequency of all points of the area. The tone quality interval may here be reduced from a first value above a cutoff frequency to a second value below the cutoff frequency, wherein the second value is smaller than the first value.

In this respect, as coordinate systems based on the allocation function also coordinate systems other than Cartesian or affine coordinate systems may be used, i.e. for example polar coordinate systems or coordinate systems based on other angles.

BRIEF DESCRIPTION OF THE DRAWINGS

In the following, embodiments are described in more detail with reference to the accompanying drawings, in which.

DETAILED DESCRIPTION OF THE INVENTION

Figure 1:
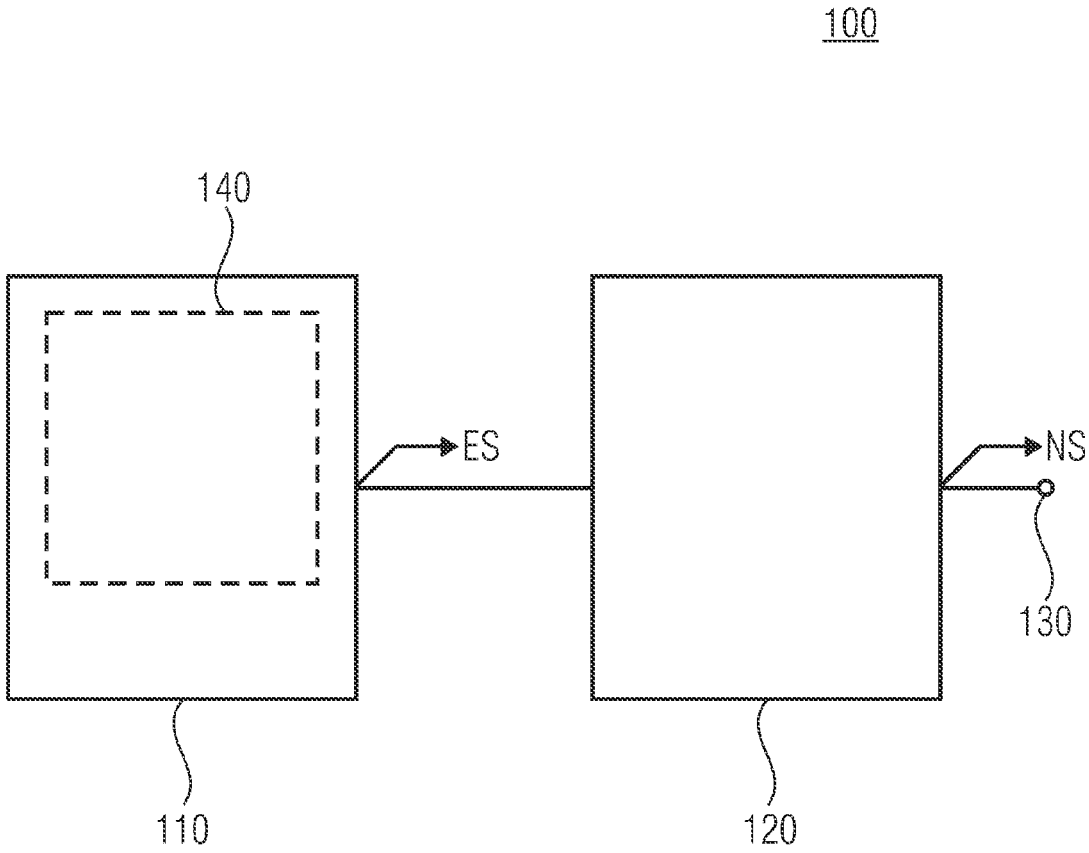
FIG. 1 shows a block diagram of an embodiment of a device for generating a note signal upon a manual input.

With reference to FIGS. 1 to 17, embodiments of the present invention will be described in the following. Here, objects, elements and structures occurring in identical or similar form or with an identical or similar functionality in several embodiments of the present invention are designated by the same or similar reference numerals. Parts of the description relating to elements, objects or structures with identical or similar reference numerals may here be added as a supplementary description between the individual embodiments, as far as this is not explicitly excluded in the present description. By this, the possibility results to represent more complex embodiments in a shorter and clearer way instead of using unnecessary repetitions.

In addition to that, within the present description, summarizing reference numerals are used for objects which occur several times within one embodiment or within one figure. Summarizing reference numerals may further be used for identical or similar elements, objects and structures when features or characteristics of the same are generally described. However, also here exceptions are possible. Thus, summarizing reference numerals are used when general features and characteristics of the corresponding structures, elements and objects are described. Only when a special component is designated, described or described with respect to its function and/or its features, for example connected to another component or coupled to the same, the individual reference numeral is advantageous with respect to the summarizing one.

In addition to that, it would be advantageous here to note that within the present description two objects coupled to each other are objects that are directly or indirectly connected to each other. Depending on the respective implementation, thus, for example, different objects, devices or components coupled to each other may be connected to each other directly or indirectly via a wire-bonded coupling or indirectly by a wire-bonded connection—for example via a router, a switching center or another corresponding communication means. Likewise, the corresponding components, structures and objects may also be coupled directly or indirectly, optically or via a radio connection.

FIG. 1 shows a block diagram of a device 100 for generating a note signal upon a manual input according to an embodiment of the present invention. The device 100 includes an operating means 110 coupled to a control means 120. The operating means 110 is now implemented such that it enables a user to define one or several points as an input and to transfer a corresponding input signal ES to the control means 120. Depending on the specific implementation of a corresponding embodiment according to the present invention, the operating means 110 may for this purpose include, for example, keys, a touch-sensitive area, a touchscreen, a joystick, a mouse, a trackball, a light pen, a rotary regulator (or switch), enabling an interaction with the user of the device 100.

The control means 120 receives the input signal ES and generates a note signal NS on the basis of this input signal ES, which it may provide to a downstream component at an optional output 130. The note signal NS is here not only based on the input signal ES, but additionally on an allocation function allocating an individual tone or no tone to each point of a two-dimensional definition amount with a tone quality axis and a frequency axis.

This allocation on the basis of the input signal may take place by a contemporary calculation using the corresponding allocation function or by a preceding calculation in the sense of a pre-stored or pre-calculated determination of the one or the several tones included in the note signal NS. In the second case, the control means 120 may include a corresponding storage in which for the different values of the input signal ES combinations of these allocated tones are stored for the note signal NS. This may, for example, be in the form of a table stored in the corresponding storage. Depending on the exact implementation of the device 100, this may be volatile, a non-volatile or a fixedly programmed storage. In the case of an implementation of a volatile or a non-volatile storage, it may additionally be advisable to implement a corresponding processor or another arithmetic logic unit within the control means 120 which monitors and executes pre-computations or also a communication with an external device.

The optional output 130 may be different outputs which may be adapted to the corresponding note signal NS. If the note signal NS is an MIDI signal for example, the output 130 may be a corresponding plug-in connection for connecting a receiver of the MIDI signals. For example synthesizers, samplers or other sound generators may be used as corresponding components which are able to process MIDI signals and possibly generate corresponding tones as electrical, acoustical, optical or other signals. These may optionally also be encoded or (pre-)processed otherwise. Further, the output 130 may, of course, also be an Ethernet/IP interface, wherein, for example, the OSC protocol (open sound control) based on the same is attached. Of course, further proprietary or also other standards for transmitting the note signals may be used.

If, on the contrary, the control means 120 itself for example includes a corresponding tone generator in the form of a synthesizer, sampler or another sound generation means, the note signal NS may also be a signal resident in the time domain, i.e. for example a WAV signal or another corresponding audio signal. Depending on the specific implementation, the note signal NS may, for example, also be block-oriented with regard to temporal sections and/or encoded and/or (pre-) processed.

If the control means 120 also includes an amplifier and/or one or several loudspeakers in addition to that as further optional components, then the note signal NS may also be acoustic vibrations which the user of the device 100 or his audience may hear directly.

As a further optional component, the operating means 110 of the device 100, as it is illustrated in FIG. 1, includes a display means 140. The display means 140 is implemented here to display at least one of the allocation function of the control means 120, the base points defined within the definition amount of the allocation function, the input point or the input points. Depending on the specific implementation of the operating means 110, the display means 140 may be a screen, an LCD display, a field of light diodes, a field of optically distinguishable keys or other optically distinguishable display elements. In the case of a touchscreen as the operating means 110, the display means 140 thus includes the actual imaging elements, whereas the operating means apart from the same also includes the touch-sensitive sensor elements and the associated circuit for determining one or several points on the basis of the signals of the sensors. If the operating means 110 includes individual keys or a whole key pad, each optically distinguishable for example by lightening the same using one or several colors, the display means 140 includes the corresponding light elements. These may, for example, be little individual lights, LED elements or other light elements.

The control means 120 generates the note signal NS on the one hand on the basis of the input signal ES and on the other hand on the basis of the allocation function. The allocation function is defined via a two-dimensional definition amount comprising a tone quality axis and a frequency axis or tone pitch information axis. The allocation function here allocates either one single tone or no tone to each point. The definition amount here includes a plurality of base points, wherein exactly one tone is allocated to each of the base points which may be clearly determined by a tone quality and a frequency. A tone of the frequency 440 Hz which is, according to definition, the concert pitch a (one-line a or a') thus has the tone quality a or A. Accordingly, the tone with the frequency 220 Hz, which is a (without a line) also has the tone quality a or A. Analog to that, the tone with the frequency 880 Hz, which is the two-line a (a"), also has the tone quality a.

A tone is also clearly determined with regard to its frequency in the case of a pure tone (pure harmonic oscillation or wave) or via the frequency of its basic oscillation. As the preceding example of the different tones a showed, the specification of a tone quality alone is not unique for a tone. Here, at least one indication is missing as to which octave the corresponding tone of the tone quality belongs. This information is also referred to as octaving. Thus, alternatively, a tone may also be determined by its tone quality and its octaving. The indication of the frequency and the indication of the octaving thus present examples for tone pitch information.

Apart from the already mentioned tone quality a or A, 11 further tone qualities resulting from the chromatic scale exist which are, more precisely, the tone qualities c, c#/db, d, d#, eb, e, f, f#/gb, g, g#/ab, a#/bb and b. The tone quality a is here sorted between the two tone qualities g#/ab and a#/bb. It is to be noted here that for the designation of tone qualities the British or American notation is used. From this, the following allocation from English to German notation results: c#→cis, d#→dis, . . . , db→des, eb→es, . . . . Apart from that, the English B corresponds to the German H or the English Bb to the German B.

The tone qualities raised by a semitone ending in "is" are correspondingly designated by a post-positioned "#", while the tone qualities lowered by a semitone—ending in German with a post-positioned "es"—are designated by a post-positioned "b". The same also holds true, of course, for corresponding tones.

Within the scope of embodiments of the present invention, however, also other tone qualities may be used indicating corresponding relational connections between tones. Thus, it is not necessary in embodiments to use the 12 chromatic tone qualities. Rather, also new tone qualities, for example lying in between the 12 chromatic tone qualities may be used.

The allocation function is now applied such that a tone having one tone quality, which all other tones allocated to base points with the same coordinate also have, is allocated to each of the base points with one coordinate on the tone quality axis. In other words, tones of the same tone quality comprising the same coordinates on the tone quality axis are allocated to all base points. At least two base points exist comprising such an identical coordinate on the tone quality axis but having different coordinates on the frequency or tone pitch information axis. The allocated tones may thus, for example, lie one or several octaves apart.

With regard to intervals it remains to be noted that tones possibly comprise an interval different from their respective tone qualities. The tones c' and e", i.e. the one-lined c and the two-lined e, for example comprise an interval of more than one octave. Due to the periodicity of the tone qualities with respect to the octave, the associated tone qualities c and e however comprise a major third as an interval. Based on this periodicity, which finally leads to the fact that in the consideration of intervals of tone qualities any number of "whole octaves" may be added or subtracted, the two tones c' and a' have an interval of a major sixth. The associated tone qualities also comprise the same. In addition to that, due to the possible shifting of the octave position (octaving), the same comprise the interval of a minor third when an octave is added to the tone c'. In this case, the interval between the tones a' and c" is to be considered which includes 4 semitones. With tone qualities, consequently a "smallest interval" exists.

Figure 2:
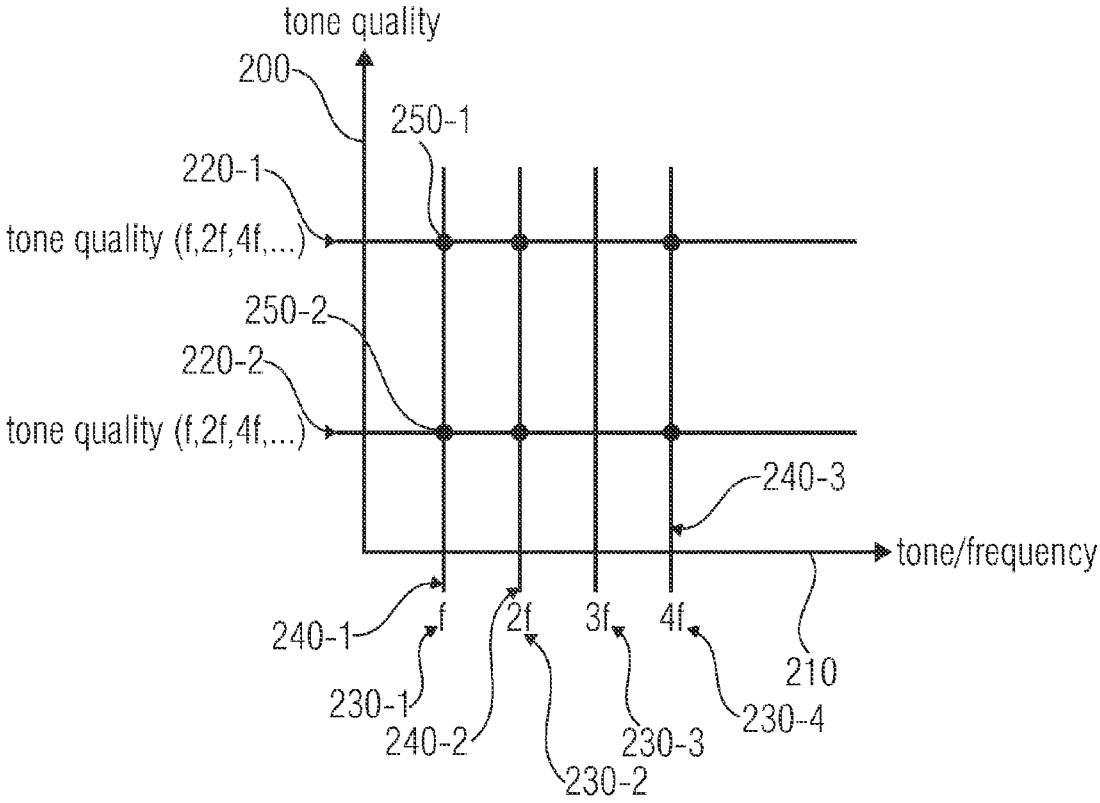
FIG. 2 illustrates an allocation function according to an embodiment of the present invention.

To explain the structure of the allocation function in more detail, FIG. 2 shows a simplified illustration of an allocation function of a device 100 according to one embodiment of the present invention. More precisely, FIG. 2 shows a schematical illustration of an allocation function defined on the basis of a two-dimensional definition amount determined via a Cartesian coordinate system. The tone qualities are represented on a first axis 200. The axis 200 is thus the above-mentioned tone quality axis 200. The y axis of the coordinate system is illustrated in the representation selected in FIG. 2. Of course, in other allocation functions this may also be the x axis.

The allocation of the tone qualities to a geometrical position, i.e. to corresponding coordinates of the tone quality axis, may here follow physical rules or other arrangements perceived as pleasant. This is, however, by no means an obligatory arrangement. Rather, the designer of a tone space of this nature can in principle arrange every arbitrary tone quality in principle at every optional position on the tone quality axis 200. Such an arrangement does not have to be clear. One the contrary, one tone quality may be arranged on the tone quality axis 200 several times.

The definition amount based on the coordinate system further comprises a second axis 210 on which the tones are arranged. For this reason, the same is also referred to as tone axis or frequency axis. In some embodiments, this axis may also be a tone pitch information axis on which a tone pitch is plotted.

The individual frequencies or tones may here be arranged in a sequence corresponding to the tone pitch. Although such an arrangement may in some fields of application definitely turn out to be very sensible, also here, however, any other tone selections, orders and arrangements are possible and may be realized with respect to the desired application. In other words, also on the frequency axis 210 an arrangement of the corresponding tones may be executed such that the same are arranged, for example, in a descending order or in any other order. Further, with respect to the intervals, i.e. the scaling of the frequency axis, any arrangement of the frequencies or tones is possible. As the further description will show, thus not only linear or logarithmic arrangements of the frequencies and tones are possible, but also others.

As already indicated above, the representation in FIG. 2 is a simplified illustration of an allocation function or of the tone space defined by the allocation function. Thus, FIG. 2 only shows one single tone quality corresponding to the frequencies f, 2f, 4f, 8f, . . . based on a basic or fundamental frequency f. In the allocation function illustrated in FIG. 2, this tone quality is plotted two times on the tone quality axis 200 at a first position 220-2 and at a second position 220-2. These positions are referred to as tone quality lines.

If the tone qualities for a tone space are determined and arranged on the tone quality axis 200 or associated with the same, a second step is now to determine the geometrical positions of the (real) tones. After a corresponding definition or scaling of the frequency axis 210, for each of the two tone quality lines 220-1, 220-2 the frequencies are determined corresponding to tones belonging to the two tone quality lines 220-1, 220-2. In other words, with regard to the frequency axis 210, the tone frequencies belonging to the tone qualities and their tone quality lines 220 are determined.

The frequency or tone axis 210 may thus, for example, be arranged linearly, logarithmically or in any other deviating way. It may further be advisable in many cases to arrange frequencies at least in an ordered way, so that also positions of three increasing frequencies on the frequency axis 210 are accordingly arranged in a rising or falling direction. Here, it is not necessary, however, for the individual frequencies, regarding their interval or distance to each other, to be based on a ratio or a difference of the underlying frequency values. It should be noted, however, that in embodiments of the present invention it may well be advisable to also deviate from this order. It does not, thus, represent a compulsory feature.

In FIG. 2, thus. based on the fundamental frequency f on the frequency axis 210 in parallel to the tone quality axis 200 for the fundamental frequency f itself, a frequency line 230-1 is plotted. With double the fundamental frequency 2f, accordingly a further frequency line 230-2 is plotted, with three times the fundamental frequency 3f a frequency line 230-3 is plotted and with four times the fundamental frequency 4f a frequency line 230-4 is plotted in FIG. 2.

Based on the frequency lines 230, i.e. the thus found tone frequencies 230-1 to 230-4, the same are indicated by a corresponding tone line 240 as far as the associated frequencies correspond to frequencies of the corresponding tone quality lines 220. As every change of octave causes a doubling of the frequency of the corresponding tone, this concerns the frequencies f, 2f, 4f, 8f etc. Accordingly, of the frequency lines 230 indicated in FIG. 2 also three tone lines 240-1, 240-2, 240-3 are illustrated corresponding to the tone qualities associated by tone quality lines 220. The frequency line 230-1 thus corresponds to the tone line 240-1, the frequency line 230-2 corresponds to the tone line 240-2 and the frequency line 230-4 corresponds to the tone line 240-3. Only the frequency line 230-3 corresponding to three times the fundamental frequency 3f does not represent a tone line for the tone quality. The same corresponds, rather, to a fifth with regard to the tone line 240-2 (frequency 2f).

The base tones of the definition amount of the allocation function or their geometric position thus result as an intersection of the corresponding tone quality liens 220 and the associated tone lines 240. Accordingly, in FIG. 2 six base points 250 are plotted, each arranged at the intersections of the tone quality lines 220 with the tone lines 240 which again represent, with respect to frequency, tones belonging to this tone quality. More precisely, for example in FIG. 2 a base point 250-1 at the intersection of the tone quality line 220-1 and the tone line 240-1 and a second base point 250-2 at an intersection of the tone quality line 220-2 and the tone line 240-1 are designated.

The use of embodiments of the present invention in the form of a device 100 on the basis of an allocation function, as is shown, for example, in FIG. 2, thus enables tone qualities and tones to be bound to each other. Thus it is possible, for example, by raising or lowering a tone quality to likewise raise or lower all tones dependent thereon. If the tones are arranged, for example, on the tone axis 210 in an order corresponding to the tone pitch and a selection area of any form is placed onto the thus generated tone space, this offers the possibility, by shifting this area along the tone axis 210, to automatically form the reversals of the thus selected chord. In the case of a shift along the tone quality axis 200, automatically "advantageous" chord connections are generated as far as the corresponding arrangement of the tone qualities makes this possible. Depending on the specific arrangement of the tone qualities, thus for example consecutive fifths or also other unpleasantly sounding tone combinations may be avoided.

As the further description will show, in particular this last effect turns out to be especially positive when, for example, the tone space lying below it is transformed into another key. In this case, also automatically very favorable and pleasantly sounding chord combinations are formed.

Before some possible arrangements of tone qualities on the tone quality axis 200 are briefly described and explained below, it is obvious to note that if also in FIG. 2 a Cartesian representation of the allocation function based on the definition amount was selected this is not necessary in many cases. Independent of a scaling of the actual axes, a Cartesian coordinate system in two dimensions is a special case of a two-dimensional affine coordinate system. Both the Cartesian coordinate system and also the affine coordinate system may be defined in two dimensions on the basis of two constant unit vectors $e_1$ and $e_2$. With the coordinates $a_1$ and $a_2$ which may be real, rational or integer numbers, any point in the corresponding coordinate system may be described by a vector r according to an equation $$r=a_1e_1+a_2e_2 \tag{1}$$

In the case of an affine coordinate system and the Cartesian coordinate system, the two unit vectors $e_1$ and $e_2$ are constant for all points of the coordinate system. The Cartesian coordinate system is different from the affine system by the fact that, in the case of the Cartesian coordinate system, the two unit vectors are perpendicular to each other. This side condition is not necessary in the case of the affine coordinate system, so that the two unit vectors may, for example, also form an "oblique-angled" coordinate system with angles of less than or more than 90°.

In contrast to that, for example the directions of the unit vectors change and, if applicable, their length in the case of a polar coordinate system. Here, one of the two unit vectors radially points away from the origin of the coordinate system, while the second unit vector, which in many cases is perpendicular to the first, may change with respect to its length depending on the distance of the corresponding point from the origin. Thus, in such a case possibly not only the directions but also the lengths of the unit vectors $e_1$ and $e_2$ are not constant. Although many embodiments of the present invention may not only be implemented on the basis of affine or Cartesian coordinate systems, in the following only such embodiments are considered which are based on an affine or a Cartesian coordinate system.

With regard to the arrangement of the individual tone qualities on the tone quality axis 200, apart from a chromatic or diatonic arrangement further an arrangement according to the circle of fifths, a symmetry circle arrangement (according to the symmetry circle model) or a circle of thirds arrangement (according to the circle of thirds model) are advantageous. In the case of the circle of fifths, the arrangement of the tone qualities is in the order C-G-D-A-E-B-Gb/F#. This arrangement corresponds to half the circle of fifths of the major keys with an increasing number of the tone raising signs or crosses (#). Based on C major (without a sign), thus the number of crosses up to Gb/F# major is increased or raised to six crosses. In the opposite direction of the circle of fifths, thus the tone quality sequence results C-F-Bb-Eb-Ab-Db-Gb/F#. Also here, the order of the tone qualities reflects the number of tone lowering signs (b) of the corresponding major keys.

Analog to this, with regard to the minor keys based on the a minor major scale having no sign the sequence a-e-b-f#-c#-g#-eb/d# results. Correspondingly, based on the a minor key, in the direction of increasing flat signs the tone quality sequence a-d-g-c-f-bb-eb/d# results. Here, the major keys or major chords are designated by capital letters and minor keys or minor chords by small letters.

The so-called circle of thirds model is based on an alternating sequence of tone qualities in major and minor thirds. By this, a combination of tones with neighboring tone qualities results in major or minor chords. Accordingly, according to the following listing of tone qualities major or minor chords result alternatingly. For this reason, the corresponding tone qualities are designated by capital or small letters and designations. According to the circle of thirds model, thus the following tone quality sequence results: C-e-G-b-D-f#-A-c#-E-g#-B-d#/eb-F#/Gb-bb-Db-f-Ab-c-Eb-g-Bb-d-F-a-C.

Apart from the circle of fifths and the circle of thirds models which cover all twelve tone qualities of the chromatic scale, there are also arrangements of tone qualities based on a diatonic scale. One example is the so-called symmetry circle model in which also major and minor thirds are alternatingly strung together. Only with a symmetry tone spaced apart from the fundamental tone of the corresponding major scale or minor scale at the interval of a major second, two minor thirds meet. In the case of a C major scale, thus the symmetry tone or the symmetry tone quality is D. Based hereon, thus the following tone quality series results: D-F-A-C-E-G-B-D. For corresponding other major or minor scales, by a corresponding transposition of the mentioned tone qualities the associated tone quality sequences result according to the symmetry circle model.

As already mentioned above, the associated tone quality lines 220 may be arranged on the tone quality axis 200 for example according to one of the above-mentioned tone quality sequences. Of course, also here deviating tone quality sequences may be used, like a fourth arrangement or another arrangement. Apart from that, it is further not a compulsory precondition that all tone qualities or only all tone qualities of a diatonic scale have to be arranged on the tone quality axis 200. With respect to the exact geometric arrangement of the tone quality lines 220 on the tone quality axis 200, these may be implemented equidistantly or also with a deviating distance.

Embodiments of the present invention in the form of a device 100 for generating a note signal NS upon a manual input and corresponding methods thus represent as general a system as possible for generating arbitrary tone spaces, wherein the system, depending on the specific implementation, may consider the following characteristics. Depending on the specific selection of tone quality sequence on the tone quality axis 200, psychoacoustic principles of "octave similarity" may be considered. Likewise, tones may be arranged such that, by shifting a selection function in the form of an area over the tone space, consecutive fifths may be prevented and as "favorable chord connections" as possible may be formed.

In addition to that, embodiments may further be implemented such that reversals of arbitrary chords may be generated by simple geometric movements. When shifting such a selection area, the possibility exists of generating most "favorable" chord connections, i.e. two chords generated by shifting the selection area occupy comparatively closely neighboring frequency ranges on the corresponding axis. In addition to that, corresponding systems according to embodiments of the present invention may possibly not only enable adding a sharp sign to an individual tone but all octavings of the respective tone. Via flexibility which enables the allocation function, there is additionally the possibility that a device according to an embodiment of the present invention may operate on the basis of any tone systems.

Thus, for example, the use of an affine or Cartesian coordinate system by which the definition amount of the allocation function is given offers the possibility of hitting special tones relatively easily, which may represent an advantage with respect to other coordinate systems.

Figure 3B:
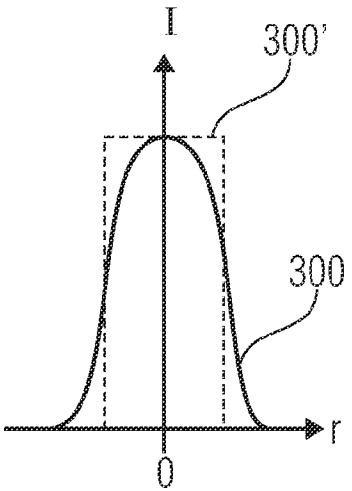
FIG. 3*b* shows two different single tone volume functions according to embodiments of the present invention.
Figure 3A:
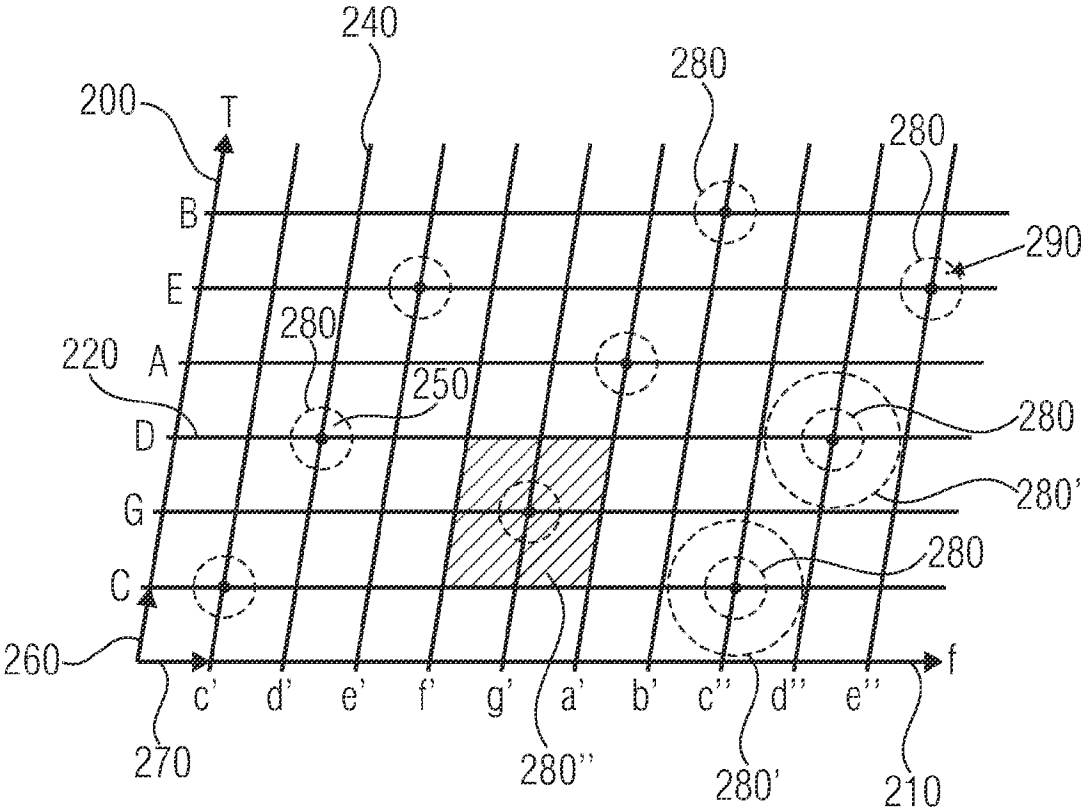
FIG. 3*a* shows a further allocation function according to an embodiment of the present invention.

FIG. 3*a* illustrates a further allocation function on the basis of an affine coordinate system. In contrast to the allocation function as was illustrated in FIG. 2, the allocation function of FIG. 3*a* is based on a coordinate system in which the unit vectors underlying the same do not include a right angle with each other. More precisely, FIG. 3*a* shows a first unit vector 260 representing the direction and the unit of the tone quality axis 200 designated by T in FIG. 3*a*. The frequency axis 210 here is determined by a second unit vector 270 with regard to direction and scaling. Both unit vectors 260, 270 are not perpendicular to each other.

On the frequency axis 210, in the allocation function illustrated in FIG. 3*a*, the tones c' to e" of the diatonic C major scale are plotted equidistantly. In particular this plotting of the frequency axis 210 shows that both the tones with respect to the frequency axis 210 and analogously the tone qualities on the tone quality axis 200 may in principle be spaced apart and arranged randomly. In particular with respect to the frequency axis 210 a linear or logarithmic plotting is not compulsory. Thus, the spacing between the tones e' and f on the frequency axis is identical to that of the tones c' and d', although the tone distance or the interval between the two latter tones is a major second and between the two former tones a minor second.

On the tone quality axis 200, based on the tone quality C according to the circle of fifths, a tone quality sequence is also plotted equidistantly. Thus, the above-mentioned tone quality sequence C-G-D-A-E-B results.

According to this plotting on the tone quality axis 200 and the frequency axis 210, corresponding tone lines 240 and tone quality lines 220 result, from which, for a better illustration, only the tone quality line of the tone quality D and the tone line of the tone d' are designated as such. The other ones are correspondingly shifted in parallel. At the associated intersection lines of tone quality line 220 and tone line 240 again the base points 250 are arranged. Also here, for simplifying the illustration, only the base point 250 is provided with a reference numeral which is arranged at the intersection point of the tone quality line for the tone quality D and the tone d'.

FIG. 3*a* further illustrates that tones may also be allocated to points which are not base points 250. Thus, a simply connected area 280 is allocated to all base points 250 designated as black points of the definition amount illustrated in FIG. 3*a*, within which the same tone which is also allocated to the corresponding simply connected area 280 of the associated base point 250 is allocated to each point. In other words, either no tone is allocated or a tone allocated to a base point is allocated to each point of the definition amount which is not a base point. In the allocation function illustrated in FIG. 3*a*, further a point exists which is not a base point 250 and to which a tone is allocated. Such a point, as is marked, for example, as point 290, belongs to the simply connected area 280 in which further the base point 250 is located which is on the intersection line of the tone line for the tone e" and the tone quality line of the tone quality E. In other words, the tone e" having the tone quality E is also allocated to the point 290.

In some embodiments of the present invention, exactly one base point 250 is located in each such simply connected area. In other embodiments, only base points to which the same tone quality and the same tone are allocated are located within such a simply connected area.

Additionally, FIG. 3*a* illustrates that possibly also differently shaped or otherwise differing simply connected areas 280, 280' may be allocated to different base points 250. Thus, in FIG. 3*a* optionally a deviating simply connected area 280' is allocated to each of the tones c" and d" which come very close on a direct connecting line of the two base points 250 which, however, do not overlap with respect to any point. This variant of the simply connected areas 280' illustrates that tones which do not "fit" their coordinate with respect to the tone quality axis 200 may well be allocated to points of the definition amount. Thus, the tone c" is allocated to the intersection point of the tone line of the tone c" with the tone quality line G, where no base point 250 is located due to its position within the simply connected area 280'. This is, however, not in contrast to the preceding definition of the allocation function.

Depending on the specific implementation of an embodiment of the present invention in the form of a device 100 for generating a note signal, this note signal NS may also include volume information with respect to one or several tones.

Apart from an individual allocation of the corresponding volume information which may, for example, consider the auditory characteristic of the human ear, also an allocation of the corresponding volume information for the complete simply connected area 280 is possible which is allocated to a base point 250. FIG. 3*b* thus shows two possible single tone volume functions 300, 300', which, in addition to the tone, via a distance or interval r from a base point 250 also allocates a volume information I to each point within the corresponding connected area 280. The respective base point 250 itself is here allocated to the value r=0. In the practical realization it is also possible to occupy the selection area at each point with a weighting information. The actual overall volume information then results from the product of the weighting information with the volume function associated with the corresponding point of the definition amount.

As also illustrated in FIG. 3*b*, here different individual tone volume functions 300 may be implemented. While the individual tone volume information 300 shows a bell-shaped course, the single tone volume information 300' is a rectangular function. A size of the corresponding simply connected areas 280 may thus, for example be determined by an extension of the single tone volume function 300. Depending on the implementation, a user may possibly switch on or off such a volume information distribution, select from a plurality of the same or also freely define one or several of the same. A delta or Dirac-shaped single tone volume function 300 or a point-shaped single tone volume function 300 may correspond to "switching off" the same.

Of course, also other simply connected areas 280 may be defined apart from circular ones. Thus, there is, for example, the possibility of dividing the definition amount on the basis of the unit vectors 260, 270 or on the basis of other geometrical shapes and to allocate corresponding single tone volume functions 300 to the corresponding base points 250. Thus, for example, in the case of the allocation function illustrated in FIG. 3*a*, there is the possibility of defining a simply connected area 280" which extends starting from the corresponding base point 250 into both directions each by one unit vector or by one or several other lengths in both directions. Such a simply connected area 280" is plotted in FIG. 3*a* for the base point 250 allocated to the tone g'.

Depending on the specific implementation, when for example more than one point is selected to which both volume information and also the same tone is allocated, an effective volume information for the corresponding tone may be determined by summation across all corresponding selected points by averaging, by maximum value determination or another corresponding calculation.

Figure 4A:
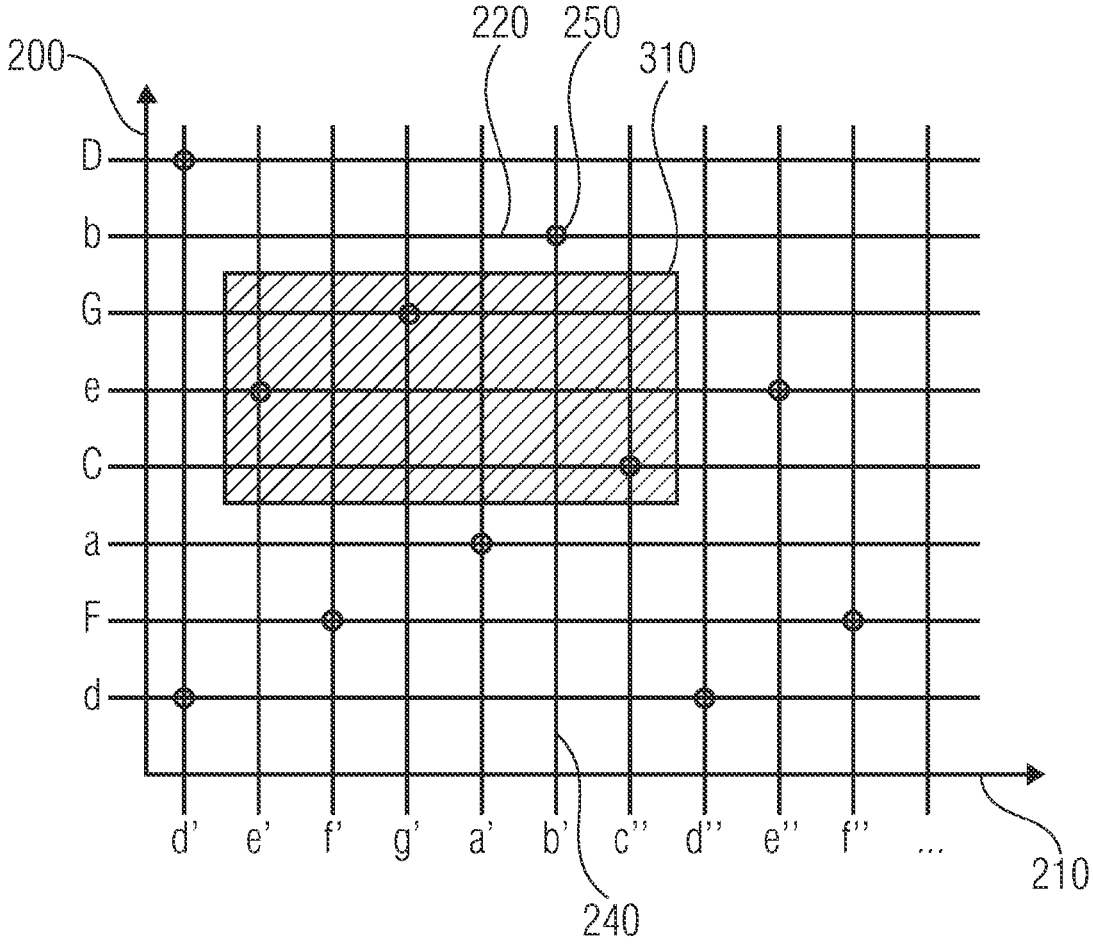
FIGS. 4*a* to 4*c* show different areas with regard to an allocation function according to an embodiment of the present invention.

FIG. 4*a* shows a further illustration of an allocation function on the basis of a two-dimensional Cartesian coordinate system. To simplify the illustration, in this case, too, not all tone lines 240, tone quality lines 220 and base points 250 are designated with corresponding reference numerals. More precisely, only the tone quality line 220 allocated to the tone quality b and the tone b' of the tone line 240 are designated. The tone qualities are arranged on the tone quality axis 200 for the diatonic C major scale according to the symmetry circle model. On the tone or frequency axis 210, the tones of the C major scale are arranged in an ascending order regarding frequency. Apart from the deviation already mentioned above with respect to the diatonic scale and the varying intervals between neighboring tones of the same, thus plotting on the frequency axis 210 is basically logarithmic. In other words, the geometric intervals do not correspond to the real tone intervals as semitone and whole tone steps have the same intervals. Any other arrangement, i.e. in particular a non-ordered arrangement, may also be implemented here, however.

On the tone quality axis 200 further the tone qualities of the C major scale are arranged, but in the order of the symmetry circle model. The tone quality d, which represents the symmetry tone of the C major scale, is accordingly present twice. The associated tone quality lines 220 represent the beginning and the end of the tone quality amount represented in FIG. 4*a*.

The circles represent the base points 250 of the allocation function, i.e. the real geometric tone space positions of the tones arranged on the tone axis 210. These again result from the intersections of the associated tone quality lines 220 and tone lines 240.

As was already briefly explained in connection with FIG. 1, the operating means is implemented to enable the user of the same to transfer one or several points in the form of the input signal to the control means 120. Apart from a direct selection of the corresponding points, for example by pressing keys, thus also a transfer of several points in the form of the definition of an area is possible. Such an area is also referred to as a selection area or a selection function. Thus, depending on the specific implementation, the input signal includes information with regard to all or outstanding points lying within the corresponding area.

In the situation illustrated in FIG. 4*a*, a rectangular selection function or area 310 was defined and selected designating the chord C major in the first inversion (e'-g'-c"). Thus, the control means 120 outputs exactly these tones as a note signal optionally extended by corresponding volume information in case the allocation function only allocates the corresponding tones to the base points.

Figure 4B:
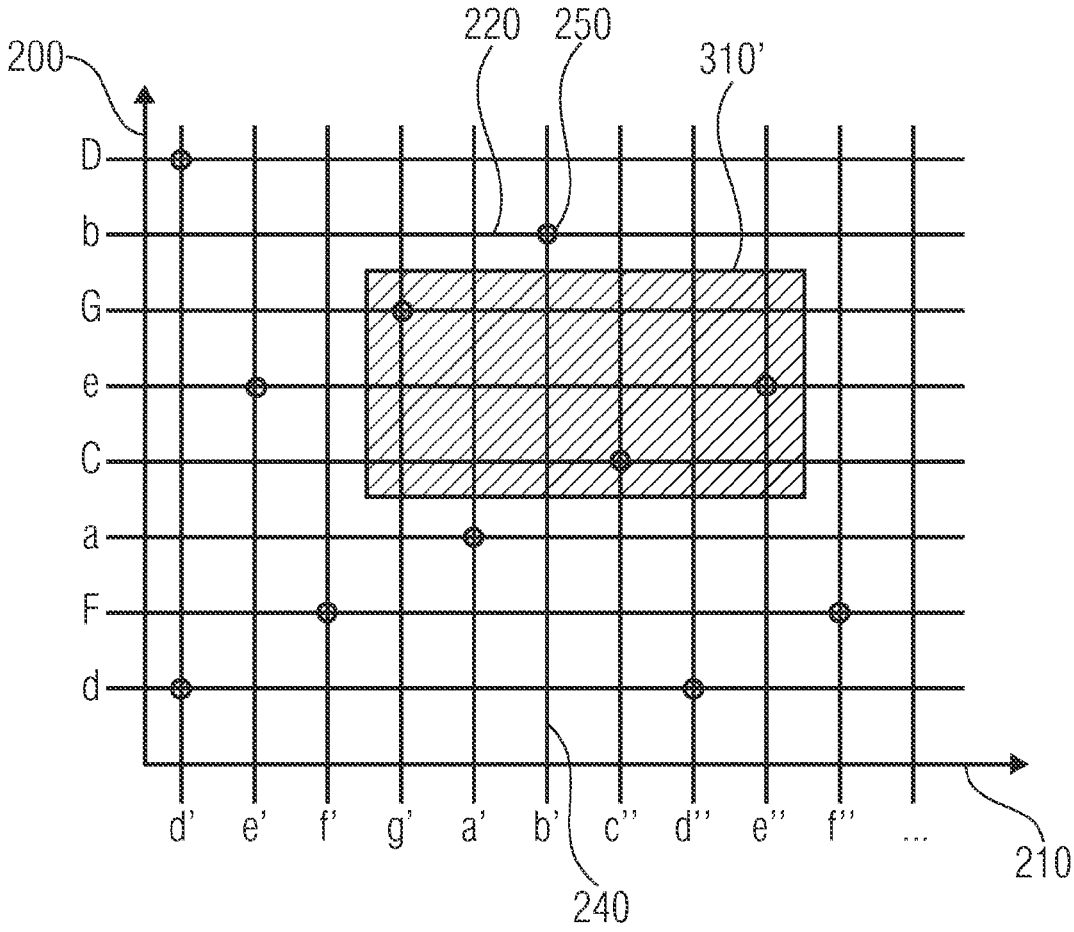

FIG. 4*b* shows the same allocation function, wherein, however, compared to the illustration shown in FIG. 4*a* the area 310 was shifted along the tone axis 210 to obtain the area 310'. By the tone space definition principle implemented within the scope of the embodiments of the present invention, hereby automatically the next inversion of the above-defined chord is generated. In particular, this is the second inversion of the C major chord with the tones g'-c'-e".

Figure 4C:
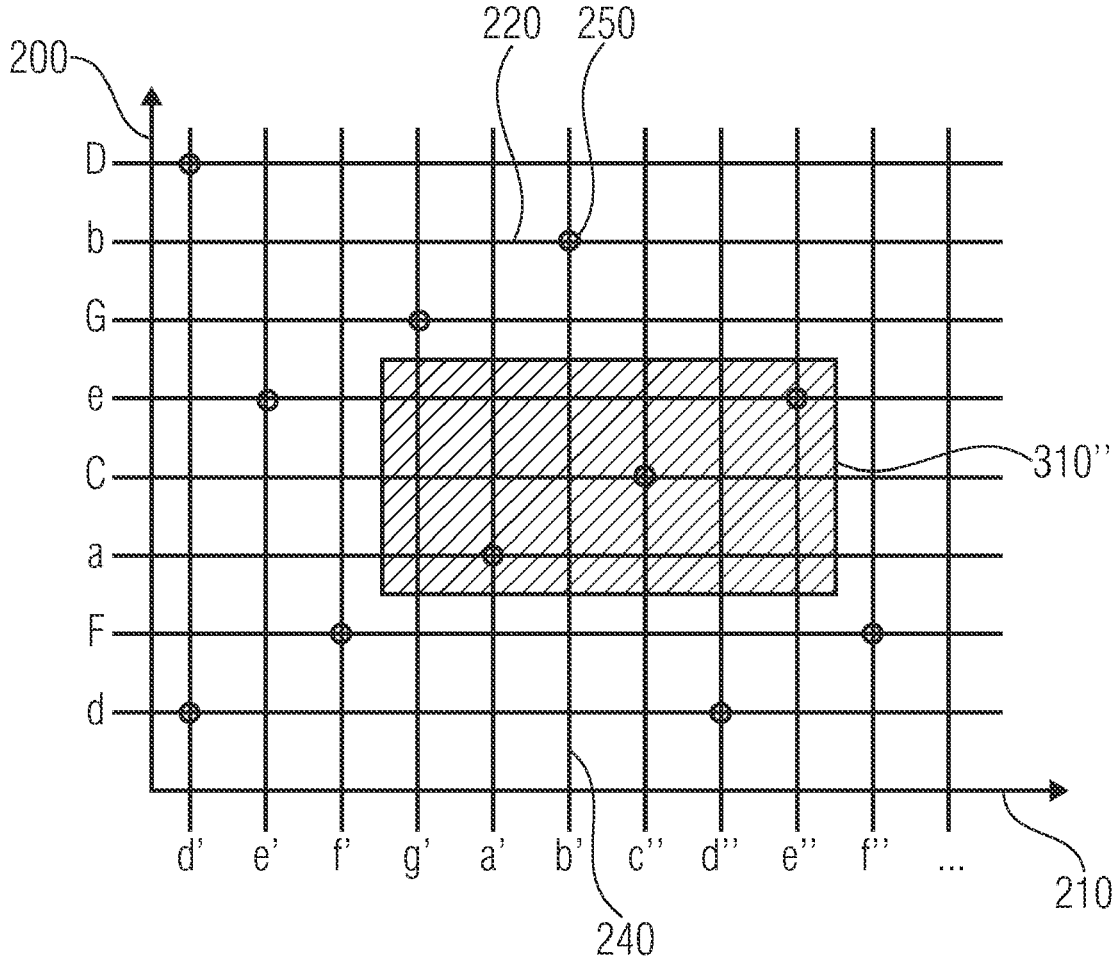

Also FIG. 4*c* shows the above-explained allocation function, wherein the selection area 310' of FIG. 4*b* was shifted in the direction of the tone quality axis 200. The chord C major in the second inversion (g'-c"-e") thus automatically became the nearest and most favorably positioned a minor chord in the normal position (a'-c"-e"). The principle of favorable chord connection automatically results also for other tone spaces, e.g. also containing dissonant or very tense tone combinations.

As the illustration of the different areas 310 in FIGS. 4*a* to 4*c* illustrated, the arrangement of the tones over the base points 250 in an affine or Cartesian coordinate system, sometimes synonymously also referred to as an xy arrangement, results in a substantial simplification and improvement of the playability of a musical instrument with a corresponding operating means 110. Such an improvement may, for example, be realized in connection with touch-sensitive area (touch areas) based media.

Tone quality intervals and frequency intervals or tone intervals thus become limitations of a rectangular or an equal-sided trapezoidal selection area 310. As was also illustrated in connection with FIGS. 4*a* to 4*c*, here a reference tone quality for the current key, also called scale, may be placed at the center of the definition amount based on the allocation function. The illustration of the allocation function shown in FIGS. 4*a* to 4*c* is here the fundamental tone or the fundamental tone quality C of the C major key. The symmetry tones or symmetry tone qualities d or D here delimit the illustrated definition amount. Alternatively, it is, for example, also possible to select the symmetry tone, i.e. the tone quality D or d, as the central tone quality line 220 of the allocation function.

Apart from the described tone quality arrangements according to the circle of thirds model or the symmetry circle model and the chromatic or diatonic scale and the circle of fifths, the tone qualities may, of course, also be distributed in any other arrangements on the tone quality axis. Thus, there is, for example, the possibility of arranging the tone qualities at intervals of major thirds, minor thirds or also corresponding to the complete tone series. The exact position of the base points 250 results, as already described above, on the basis of the intersections of tone lines 240 and tone quality lines 220.

Within the scope of the implementation of such a musical instrument, of course also the two axes may be exchanged. In other words, depending on the application, the x axis and the y axis may be interchanged so that the tone axis or the frequency axis is used as the y axis and the tone quality axis as the x axis. Of course, also mirrorings may be used here.

As the illustrations of FIGS. 4*a* to 4*c* have shown, reversals, octave variations and transformations between different sounds may easily be realized for the user of a device 100 according to an embodiment of the present invention. Sounds similar with regard to the octave or the tonality may easily be generated.

Thus, there is further the possibility of optionally implementing a tone interval balancing or equalizing function. The intervals or distances of the tones may thus be arranged on the surface of the operating means 110, as far as the same comprises a display means 130 according to real interval distances. It may, however, be advantageous, in particular "in the heat of the moment" during playing, if two neighboring tones or tone qualities are represented at the same distance on the surface of the instrument. The tones will thus be more easily accessible.

It is thus possible to implement the already mentioned tone distance balancing function which quantizes the different interval distances to an evenly-distanced, equidistant raster. There is thus, for example, the possibility, by the tone distance balancing function or by another corresponding arrangement of the tone qualities and tones in the form of the base points via the definition amount of the allocation function, of avoiding the following situation while playing: as an example of a problem—if the tone quality interval is set such that it corresponds to an interval of a minor third, generally first of all exactly this minor third will sound. If the selection area is now shifted to the next interval within the scope of a circle of thirds arrangement or a symmetry circle arrangement, only one single tone is played, as in these tone quality arrangements for example the next interval represents a major third. The second tone thus does not "fall" into the above-defined selection area any more. The second tone is thus not covered by the above-defined selection area. This may become very problematic during playing.

This problem is solved by the above-described assimilation of the geometrical representation of different intervals, for example by introducing equidistant distances or intervals of tones and tone qualities. An analogy in this respect is found in the claviature, where in the key C major whole tone steps c-d, d-e, f-g, g-a, a-b and the semitone step b-c and e-f are represented by keys of the same width.

A situation frequently occurring in pieces of music is that the underlying key is changed, i.e. transposed. To enable such changes of key, there is the possibility of implementing the same in two ways. Depending on the specific playing situation, it may greatly facilitate the user to be able to constantly change the key. On the other hand, there is also the possibility that only a short-term, temporary transposition of the key is intended, so that the change of key ought to be implemented temporarily. Of course, also mixed forms may occur and be implemented.

With a constant change of key, the complete tone space is "remodeled", so that the reference tone of the new key, i.e. for example the fundamental tone or the symmetry tone of the corresponding key, is positioned at the corresponding reference position on the touch surface, i.e. the center of the respective axes. Accordingly, all other tones and tone qualities may be repositioned with respect to this reference tone.

In order to implement such different variants for changing the key, in the case of the constant key changes two further sub-variants exist. If an absolute key storage is implemented, a numerical value may be stored in it representing a key absolutely. Thus it is possible to define the corresponding key by values of integer numbers between −6, . . . , 0, . . . , +6 according to the arrangement of the circle of fifths. Positive numbers in this case correspond to the number of sharp signs (#) of the corresponding key, while negative numbers represent the corresponding number of flat signs (b). Thus, the keys Gb major via C major up to F# major (=Gb major) may be designated by the numbers −6 to +6.

In addition to that, optionally, supplementary or alternatively a relative key storage may be implemented in which a corresponding numerical value may be stored designating a key relative to an absolutely determined key. If, for example, as a current absolute key the key G major is selected which has one sharp sign (#) as compared to C major (without a sign), i.e. corresponds to the numerical value +1 according to the above explanation and the circle of fifths, by the selection of the relative key +4 based on this the basic key of the allocation function may be newly defined. From these two keys the target key B major having 5 sharp signs (#) results, resulting from the addition of the corresponding numerical values (+1+(+4)=+5).

In this connection it is obvious to note that, based on the periodicity of the circle of fifths and the fact that the two keys Gb major (−6) and F# major (+6) are identical under the assumption or precondition of an equally tempered temperament, any multiples of the number 12 may be subtracted or added. In the calculation of the target tone quality, thus a summation modulo 12 (mod 12) may be applied.

Such a relative change of key may, for example, be called up by the user by operating certain operating elements which leads to a storage of the corresponding numerical value in the relative key storage. The resulting key may then—as indicated—be determined from the sum between the absolute and the relative key. Relative key numerical values are consequently allocated to the corresponding operating elements.

Specifically, this may, for example, be executed by the implementation of 13 operating elements, wherein each of the operating elements represents one key from Gb major (−6) to F# major (+6). The order of the operating elements here for example corresponds to the order of fifths of the circle of fifths. Two neighboring operating elements represent two keys at a fifth interval. Also a chromatic order may basically be implemented without problems. In this case, two neighboring operating elements would correspond to a change of key, wherein the corresponding base tones are arranged at a semitone interval. Also in this case, if applicable, a modulo 12 summation may be used in the determination of the target key from the relative key and the absolute key.

With regard to the arrangement of the operating elements, a circular arrangement is possible according to the circle of fifths. Based on the equality of the two keys Gb major and F# major described above, in the present case possibly of 13 key operating elements one may be omitted, so that only 12 key operating elements are arranged similar to a circle corresponding to the circle of fifths.

Also a linear arrangement in the form of 13 operating elements, for example keys or other buttons are possible, to which the numerical values −6, . . . , 0, . . . , +6 are associated. Such an arrangement is shown in FIG. 5*a*, in which each key represents a key between Gb major and F# major.

Figure 5A:
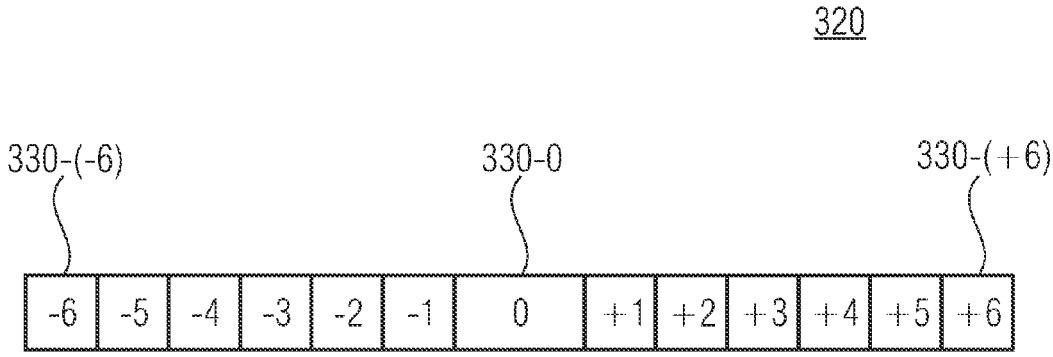
FIG. 5*a* show operating elements for providing a changeover signal for shifting the and 5*b* allocation function to obtain a modified allocation function.

FIG. 5*a* thus shows a change of key operating means 320 with the above-indicated 13 operating areas 330-(−6), . . . , 330-0, . . . , 330-(+6).

Figure 5B:
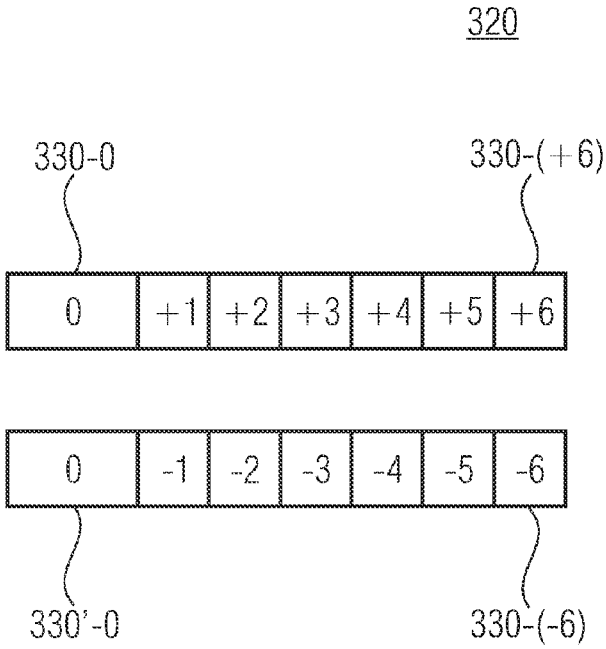

FIG. 5*b* shows a further implementation of change of key operating means 320, wherein all in all 14 operating areas 330 are arranged in two rows of 7. In the case of the upper row of operating elements 330-0 to 330-(+6), the key ascends in fifths according to the circle of fifths. In the case of the lower row with the operating areas 330'-0 to 330-(−6) the corresponding key descends accordingly in fifths. Both rows or series of keys start at the current key, so that the two operating areas 330-0 and 330'-0 each correspond to the current key.

Of course, the change of key operating means 320 illustrated in FIGS. 5*a* and 5*b* may also be implemented in correspondingly reversed variants and geometrically different arrangements. Thus, for example, the operating elements 330 may also be arranged semi-circularly or on the basis of an ellipse or a section of an ellipse. In the case of an arrangement in two rows, also here possibly a curved arrangement in two rows may be implemented.

There is the possibility here to implement the above-described change of key function on the basis of different variants, also referred to as "alignment" and "non-alignment". To explain this in more detail, in FIG. 6 again an allocation function with a plurality of tone quality lines 220 and tone lines 240 is illustrated, of which for reasons of clarity only the tone quality line C and the tone line c are designated by reference numerals. The base point 250 to which the corresponding tone C is allocated is located at their intersection.

Figure 6:
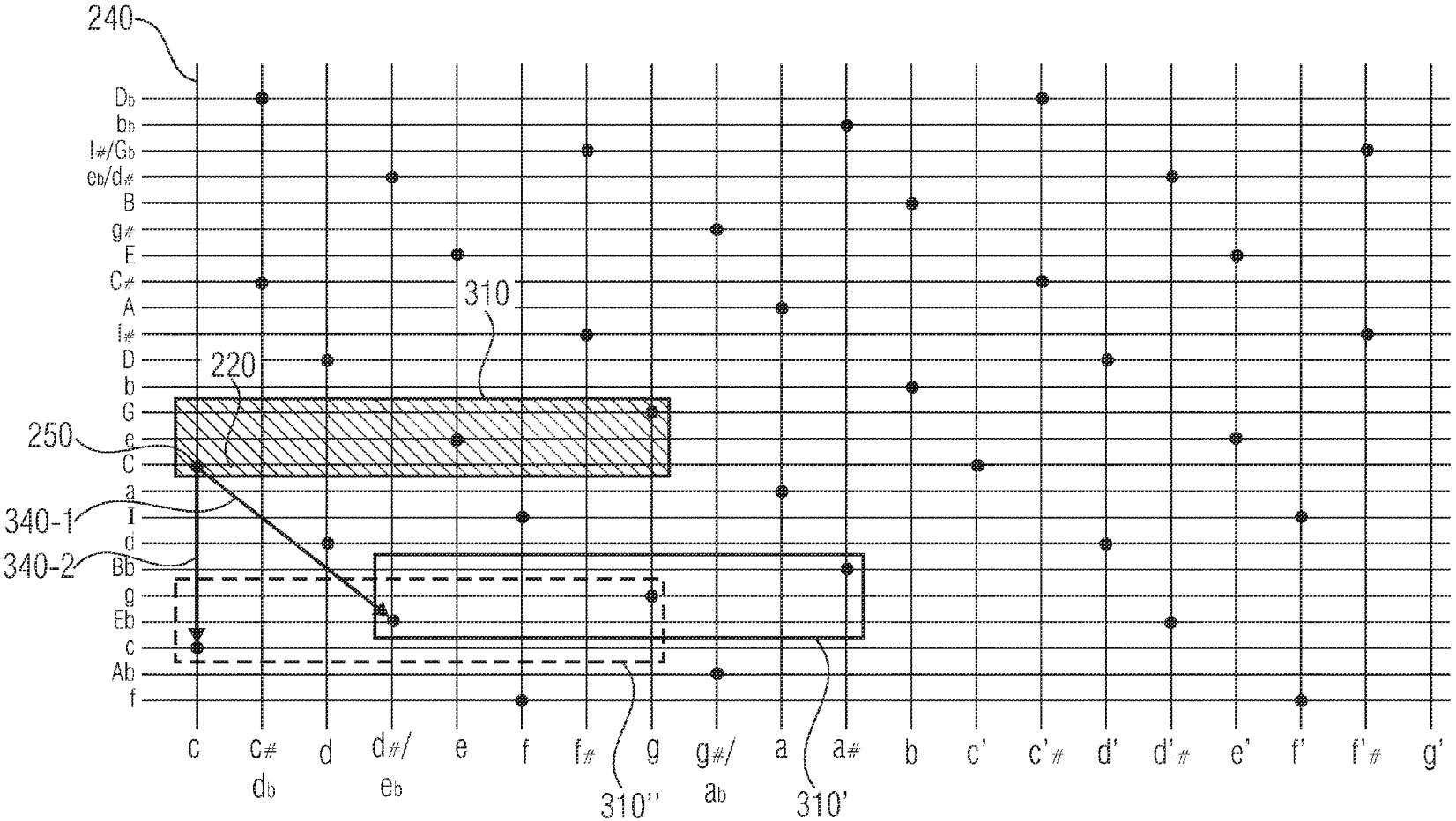
FIG. 6 illustrates such a shifting of the allocation function according to embodiments of the present invention.

For the sake of completeness, it is obvious to note here that the tone quality axis 200 not explicitly illustrated in FIG. 6 is in the order of the circle of thirds model. The frequency axis or tone axis 210, which is not explicitly plotted in FIG. 6 either, comprises the tones c-g'.

The definition amount of the allocation function here comprises a raster with a plurality of raster lines in parallel to the tone quality axis, i.e. a plurality of tone lines 240, and a plurality of raster lines in parallel to the frequency axis or tone axis, i.e. a plurality of tone quality lines 220. The base points are arranged at the intersection points of the raster lines. In the embodiment illustrated in FIG. 6, the raster is implemented equidistantly with respect to the tone quality axis and with respect to the frequency axis. Generally speaking, thus the definition amount is implemented such that the raster between the raster lines with respect to the tone quality axis comprises regular intervals with respect to the frequency axis or with respect to the tone quality axis and the frequency axis.

Back to the different variants mentioned above of the change of key function. In the case of the variant also designated as "alignment", a change to a new key is executed such that the symmetry tone of the new key is positioned on the operating surface exactly at the same place as the symmetry tone of the old key. If, for example, the user changes from the C major key to the Eb major key, an Eb major chord will subsequently sound, in the case of a corresponding selection, at the position of the former C major chord.

In FIG. 6, the starting position is represented by the area 310. The area 310 here extends such that the tones C-e-G are selected on the basis of their corresponding base points 250. The area 310 thus illustrates the situation that a C major chord is selected on the basis of the original C major key.

In the following, the change of key in the different variants is further explained on the basis of FIG. 6, wherein the consequences of the change are represented by a shift of the area 310. This illustration was merely selected for a better illustration. In many embodiments of the present invention, the area 310 per se remains, which is defined by the operating means 110. Rather, a shifting of the area 310 does not take place, but a shifting of the allocation function or its underlying definition amount. The shift of the area 310 described in the following may thus correspondingly be regarded as a shift in the opposite direction by the same length of the allocation function or the underlying definition amount. These are two different points of view on the same phenomenon and the same consequences describing the same circumstances.

If now, as described above, the key is changed within the scope of the alternative of the "orientation" from C major to Eb major, the tone space underlying the allocation function is manipulated such that the symmetry tone or the symmetry tone quality of the key Eb major is positioned at the location where the corresponding symmetry tone or the corresponding symmetry tone quality of the C major key was located before.

Alternatively, the tone space may here frequently only be shifted in the direction of the tone quality axis, so that the symmetry tone quality of the new key lies at the position of the symmetry tone quality of the old key. The positions of the symmetry tones (tone quality axis) may here possibly not be changed. This is done to prevent unfavorable consecutive fifths. Further the selection area may be made so large that it encloses three tones in any case. With a shift of the tone quality and frequency axes, a triad eb'-g'-bb' may thus result from c'-e'-g'. In the case of a shifting of the tone quality axis, b-eb'-g' may thus result from c'-e'-g'.

In the illustration selected in FIG. 6, this corresponds to a shifting of the area 310 by a vector 340-1, so that the area 310 is transferred into the area 310'. As mentioned above, this corresponds to a shifting of the allocation function or the definition amount underlying the same in the opposite direction by the same quantity. Within the scope of the above-mentioned alternative, in this case the vector 340-1 would also be directed perpendicularly to the bottom, but the tone qualities Eb, g and Bb would be included.

Within the scope of the change of key in the variant of the alignment, thus the allocation function may be shifted both with regard to the tone quality axis 200 and also to the tone axis 210. The allocation function is here shifted along the tone axis 210 according to the interval lying between the fundamental tones of the respective scales. The allocation function is shifted along the tone quality axis such that the tone quality of the fundamental tone of the new key comes to lie at the position of the original tone quality of the fundamental tone of the original key. In summary, thus in this variant the allocation function is shifted such that the tone quality of the fundamental tone of the new key comes to lie at the position of the original tone quality of the fundamental tone of the original key. As illustrated in FIG. 6, by a transfer of the area 310 into the area 310', now the Eb major chord sounds.

In the case of the variant without alignment, i.e. in the case of a "non-alignment", to the new key, the situation is different. In this case, common tones of the two participating keys, i.e. the original key and the new key, remain at their position on the operating surface. Tones existing in the original key but not in the new key are accordingly raised or lowered by a semitone. If the user in this variant changes from the C major key to Eb major, at the position of the former C major chord not the Eb major chord sounds but the c minor chord. The tones C and G of the C major chord are common to both keys and are thus maintained. The tone e of the C major chord is, however, not contained in the diatonic Eb major key and was thus lowered by a semitone to Eb.

Also this situation is illustrated in FIG. 6. Starting from the area 310, the tone space underlying the system is not modified in this case such that the tones C and E stay in place. The original tone E is rather lowered by one semitone to Eb. By this change of key, now a c minor chord sounds.

Within the allocation function, this corresponds to a shift of the area 310 by a second vector 340-2, so that the area 310 is transposed into the area 310". The allocation function or the definition amount underlying the same is thus again shifted by the same amount or quantity into the opposite direction. The shift in this case only takes place along the tone quality axis 200, so that regarding the allocation function at the position where the tone quality line C was located beforehand, now the tone quality line c, i.e. the corresponding minor tone quality line of the third circle model is located. Within the scope of the above-plotted alternative, in the preceding change of key variant the underlying definition amount may if applicable also be shifted only along the tone quality axis. Here it does not include the tone qualities c-Eb-g, but the tone qualities Eb-g-Bb.

Technically, this may, for example, be realized by the operating means 110 being implemented to enable the user to generate a corresponding switchover signal. The control means 120 in this case is able to receive the switchover signal and to modify the allocation function to obtain a modified allocation function. In the present case of a change of key—independent of whether the variant is implemented with or without alignment—an allocation function which is shifted with regard to the tone quality axis, the frequency axis or the tone quality axis and the frequency axis is obtained as a modified allocation function.

If, for example, in the case of a rectangular area, a C major chord in the basic position (C-E-G) is selected and subsequently the key is changed from C major to F major, in this case the corresponding chord sounds in the second inversion (C-F-a) and not in the basic position (F-a-C). This illustrates that such a change of key operating means by far does not lead to a simple transposition of the notes.

The preceding embodiments may also be implemented in the case of an absolute change of key. By operating corresponding operating elements, also in this case a certain key may be written into the absolute key storage. The operating elements are allocated to corresponding absolute key numeric values. With regard to the further implementation, the absolute change of key is only different from the relative one with regard to the selection of the starting key. In the case of the absolute change of key, the same is fixed, while in the case of the relative change of key the same relates to the preceding key.

Of course, it is also possible to realize different combinations of the above-described implementations. This might be sensible depending on the case of application, if, e.g., the new key is to be determined relatively but written into the absolute storage.

If the device 100 according to one embodiment of the present invention for example includes a display means 140, there is basically the possibility of displaying the complete tone space, i.e. the complete allocation function including its underlying definition amount on the display area or the surface of the display means 140. Apart from that there is, of course, also the possibility of representing only a section of the same. In other words, there is the possibility of instantiating the complete tone space, wherein a viewing window above the tone space defines the section represented on the display means 140. In this case, the tone space may be shifted randomly below the viewing window using conventional document scroll techniques. In this respect, for example scrollbars or shifting using a virtualized hand are a possibility, to mention only two possible examples.

This shifting of the viewing window above the tone space represents a corresponding change of the representation on the display means 140, which is possibly independent of the definition of the allocation function. Of course, this may also be implemented by a change of key, however, so that it is not a selection window or a display window above the tone space defined by the allocation function which is changed but the underlying allocation function which is modified. In many cases, these two approaches and considerations are to be regarded as a synonym of the modification of an allocation function.

From these technologies, different cases of application result for the user. By shifting in the direction of the frequency axis (octave direction), thus a fast change of the octave position may be realized. By shifting along the tone quality axis (tone quality direction), thus a fast change of key may be executed.

Figure 7:
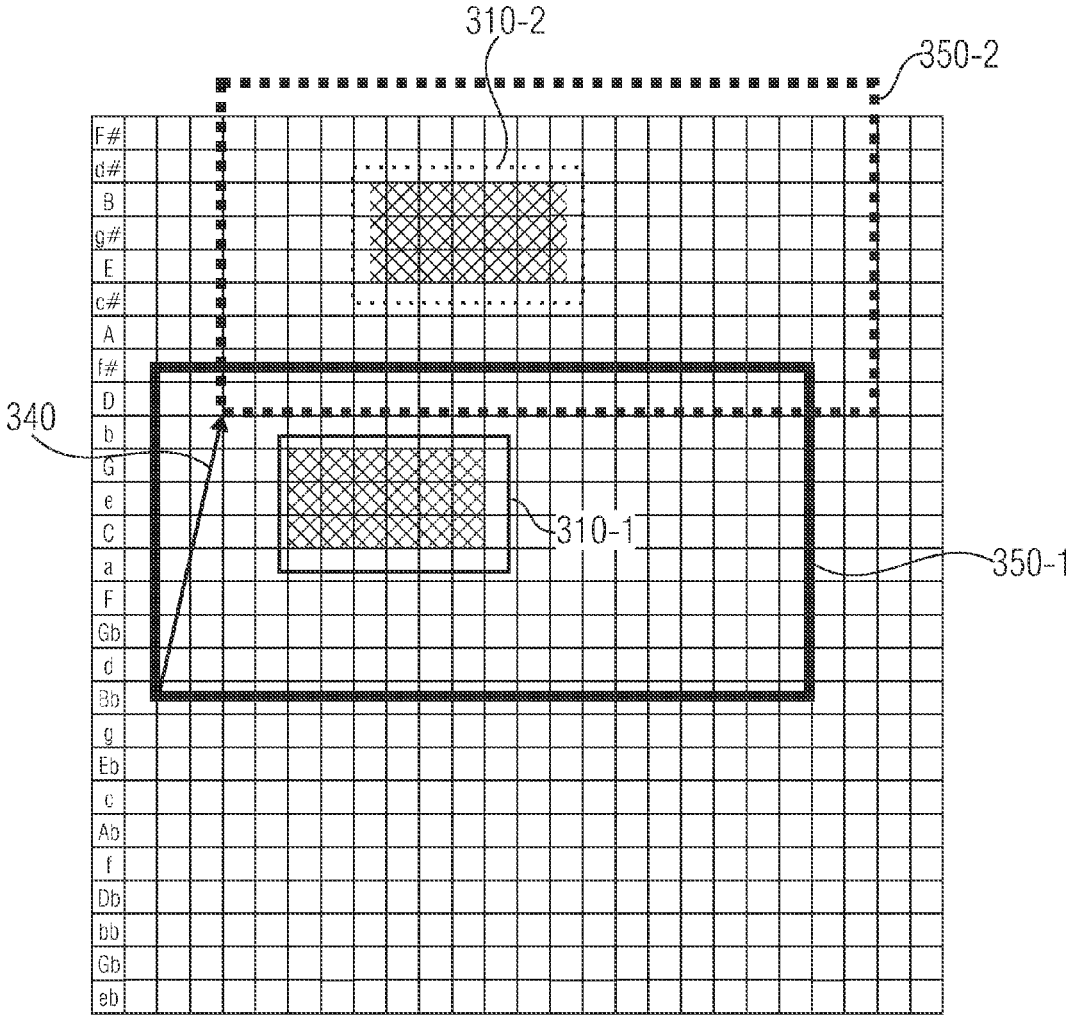
FIG. 7 illustrates, using a further example, a shifting of the allocation function to obtain a modified allocation function.

To illustrate this more closely, FIG. 7 shows a Cartesian illustration of the third circle model which theoretically goes beyond the image edges infinitely. Additionally, FIG. 7 shows a viewing window 350-1 describing the section of the tone space mapped via the display means 140 to the input area. In other words, the viewing window 350-1 in connection with the tone space lying below it defines the allocation function and its definition amount. In FIG. 7, in addition to that an area or a selection area 310-1 is illustrated describing a section of the currently illustrated tone space on the basis of which the note signal is generated by the device, i.e. which is currently being played. The area 310-1 here corresponds to a C major chord.

In the embodiment of the present invention illustrated in FIG. 7, now a change of key may be executed by shifting the viewing window 350-1. A change of key is thus possible by shifting the selection area region, wherein the viewing window 350-1 passes into a modified viewing window 350-2 which in the situation illustrated in FIG. 7 corresponds to the key E major. By shifting the viewing window 350-1 into the viewing window 350-2, thus again on the basis of the underlying tone space a new allocation function is defined, i.e. the modified allocation function. In other words, here again a vector 340 is defined transposing the underlying viewing windows 350 into each other.

In FIG. 7, apart from the area 310-1, also a further selection area or area 310-2 is plotted which, with regard to the respective viewing window 350-1, 350-2, was co-shifted in parallel. By this, the chord played is also correspondingly transferred according to the underlying key. In the variant illustrated in FIG. 7, the C major chord of the area 310-1 is transferred into an E major chord of the area 310-2.

For the tone space underlying this embodiment it may be advisable to select such a tone space which comprises a clear unique periodicity. A tone space based on the key-related symmetry circle model and which does not repeat at its ends is possibly less suitable. In contrast to that, for example a tone space according to the third circle model or the circle of fifths comprises an arrangement of tone qualities guaranteeing the corresponding periodicity. In this case, all keys may be selected by a corresponding shifting of a viewing window 350.

As already briefly mentioned above, one advantage of such an embodiment of the present invention is that such a transfer of definition or modification of the allocation function via a viewing window 350 enables the use of known document scroll technologies and zoom technologies with respect to the tone space. Thus, for example in the case of smaller devices, like portable media players (e.g. iPod Touch), the tone space may be scaled such that a good playability results depending on the input object. In other words, the number of octaves along the horizontal direction (x direction) or the associated frequency range and the number of tone qualities in the vertical direction (y direction) may be freely configured and scaled.

Thus, for example, a configuration is possible, so that neighboring tones or octaves have the distance of the width of a finger. The tone space on the surface of such a device may thus be adapted and configured to the size of the player's hand. If instead of the finger, however, a pen-like object is used typically comprising a smaller footprint, correspondingly more tone qualities and tones may be represented on the operating surface.

There are many input areas of different sizes, so that with some the hand sizes may be considered. This varies from person to person, which possibly makes an ergonomic adaptation of the tone space seem desirable. This is possible with the help of embodiments of the present invention via the flexibility of the allocation function, as a corresponding scaling function scaling the tone space in an x and also a y direction is implemented into such an allocation function.

With respect to FIG. 7 it remains to be noted that the viewing window 350 was not only shifted so that a new key is moved into the picture, but that the viewing window was also shifted in a horizontal dimension which means an octave shifting of the tone space.

Embodiments of the present invention additionally also enable playing fast chords from other keys. There is here the possibility of considering different approaches of musical theory.

First of all, the possibility already mentioned above of a relative or absolute change of key will be described. By a fast change into another key, corresponding chords which may be of another key may be played. Thus, for example, the chord C major may be played. By pressing the relative key change key "+4", the key is changed to E major and an E major chord sounds.

Figure 8A:
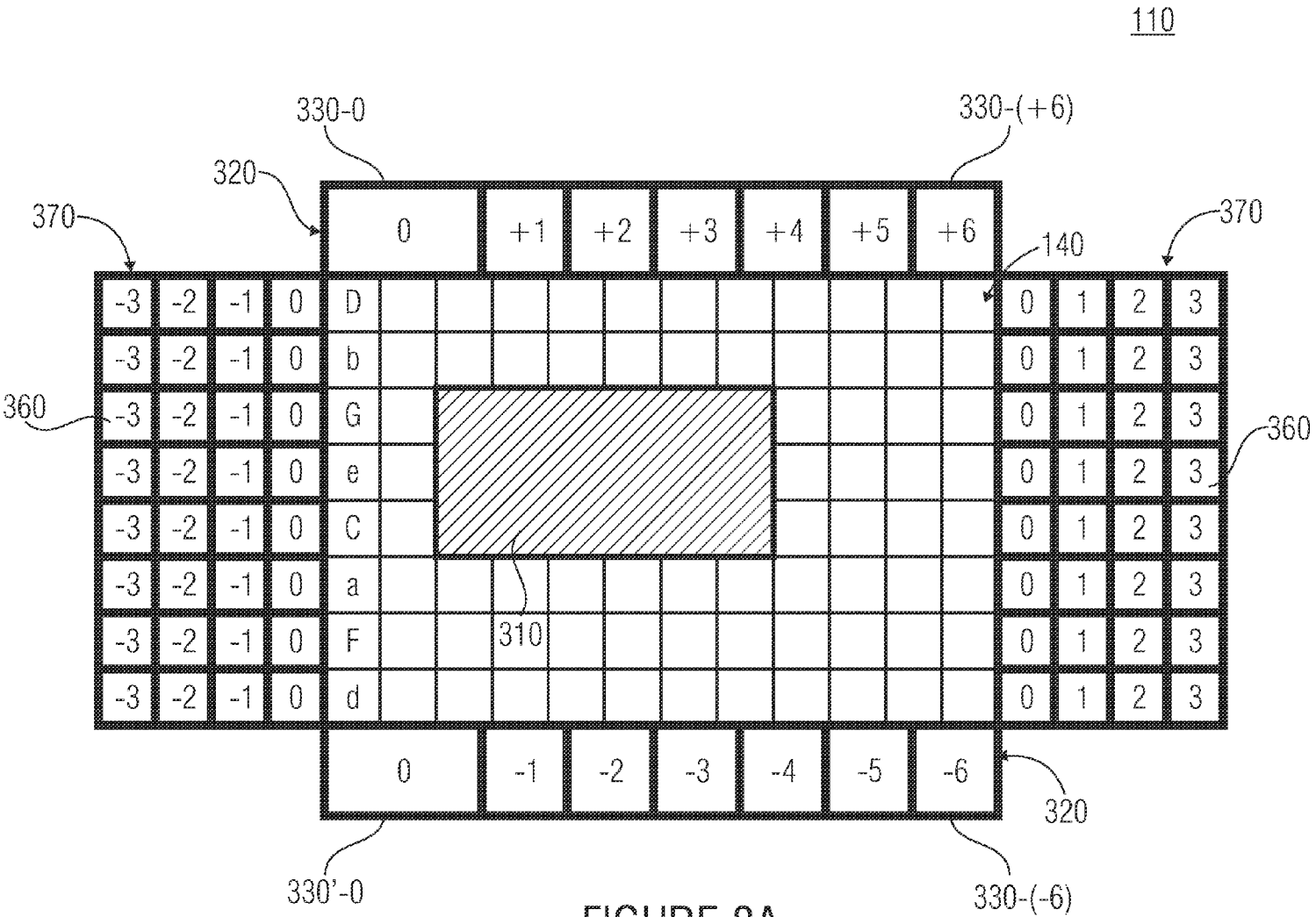
FIGS. 8*a* to 8*c* illustrate a change of key with the help of a device according to an embodiment of the present invention.

To illustrate this in more detail, in FIG. 8*a* an operating means 110 with a display means 140 is illustrated. On the display means 140 the allocation function is represented according to the symmetry circle model for the key C major. Above the display means 140 the operating means comprises a first row of operating areas 330-0 to 330-(+6). Below the display means 140 the operating means 110 comprises a second row of corresponding operating areas 330'-0 to 330-(−6), together with the operating areas 330 forming a change of key operating means 320 already described in connection with FIGS. 5*a* and 5*b*.

On both the left and the right side of the display means 140 the operating means 110 further comprises four operating areas 360 for each tone quality line 220 represented on the display means 140 (not illustrated as such in FIG. 8*a*). Merely as an example, the operating area 360 "−3" of the tone quality G and an operating area 360 "+3" of the tone quality e is designated as such. Together, the operating areas 360 on the left and right side of the display means 140 form a tone quality changing operating means whose functionality is explained in more detail in connection with FIGS. 11*a* to 11*d*.

In the situation illustrated in FIG. 8*a*, thus the key C major is selected. Further, on the display means 140 an area 310 is illustrated currently corresponding to a C major chord played by the device 100.

Figure 8B:
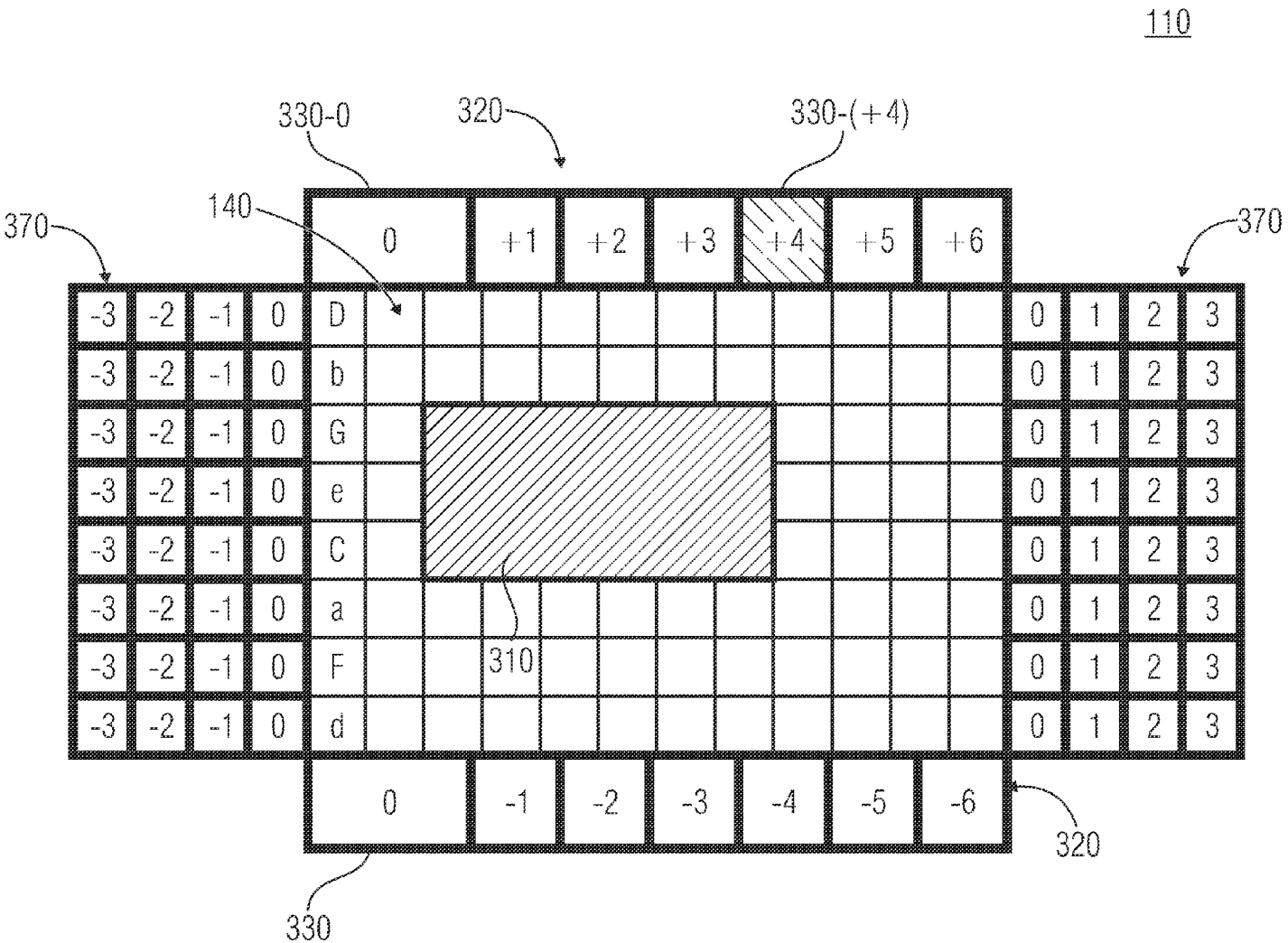

In FIG. 8*b* the situation is illustrated in which, based on the situation illustrated in FIG. 8*a*, the relative key change key 330-(+4) "+4" is pressed. On the display means 140 this change of key caused by a corresponding key change key is not yet represented.

Figure 8C:
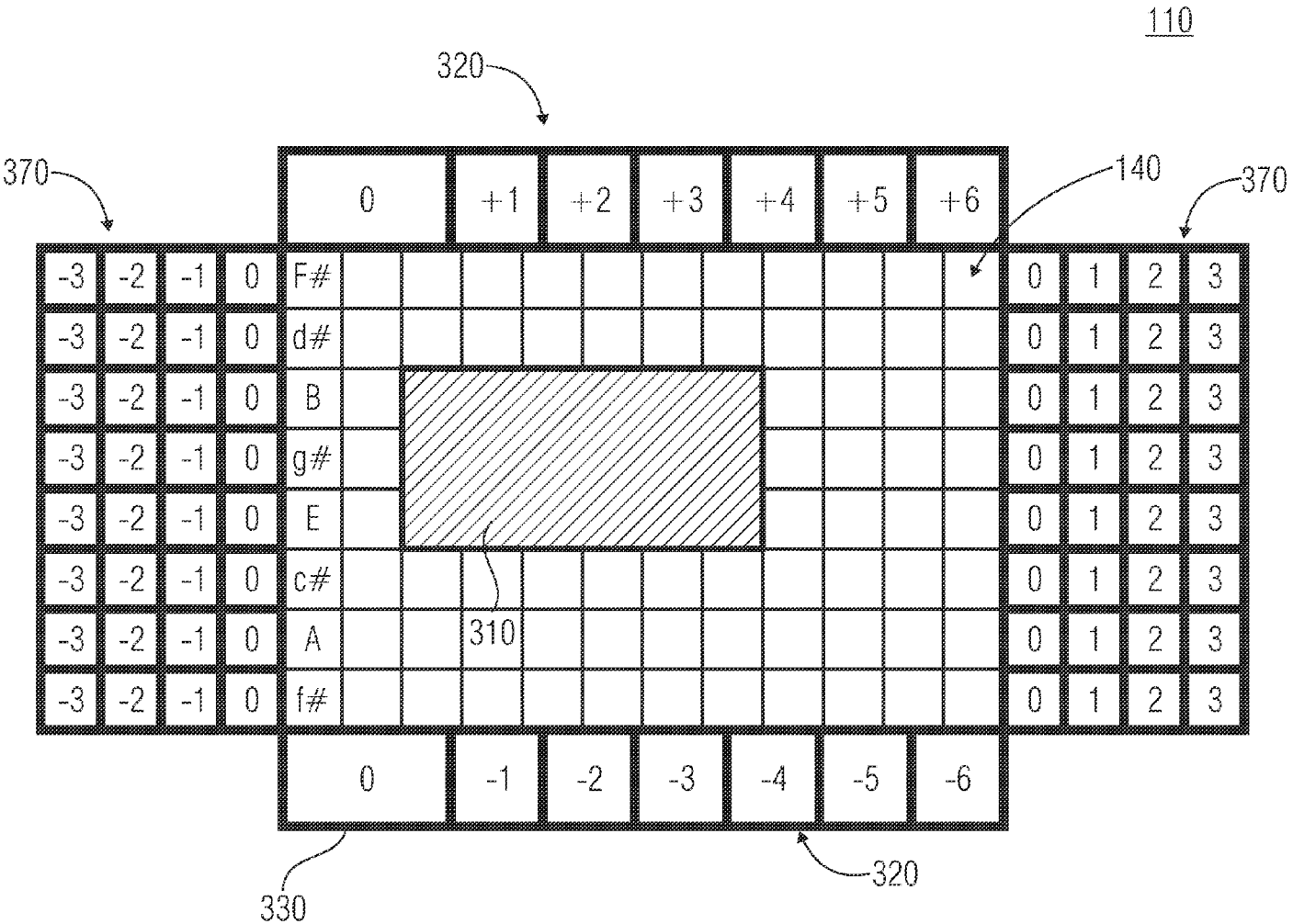

By releasing the key change key 330-(+4) the system is transposed into E major, as is illustrated in FIG. 8*c*. By operating the corresponding operating area, thus, as described above, the allocation function is modified accordingly. The modified allocation function is represented on the display means 140. Thus, the tone quality axis represented in FIG. 8*c* shows the tone quality arrangement according to the symmetry circle model of the diatonic key E major. In the situation illustrated in FIG. 8*c*, the system is additionally adjusted to the new key so that the symmetry axes of the old key (C major) and the new key (E major) are located at the same position. The points selected by the area 310 now lead to the result that the preceding and still currently playing chord C major directly changes into an E major chord. By not changing the frequency axis, the chord is not transposed 1:1 from C major to E major, but an automatic formation of the most advantageous chord combination results.

Of course, in embodiments of the present invention, also other triggering events for the corresponding key transposition to become effective may be implemented apart from releasing the corresponding operating element 330. Thus, for example, already pressing or operating the corresponding operating field 330 may trigger the changeover signal for modifying the allocation function.

This makes it possible for the user to use the same hand to change the key for playing other chords and to play the chords themselves. For this purpose, the operating elements for changing the key may be arranged adjacent to the actual operating unit for inputting the chords.

Figure 9A:
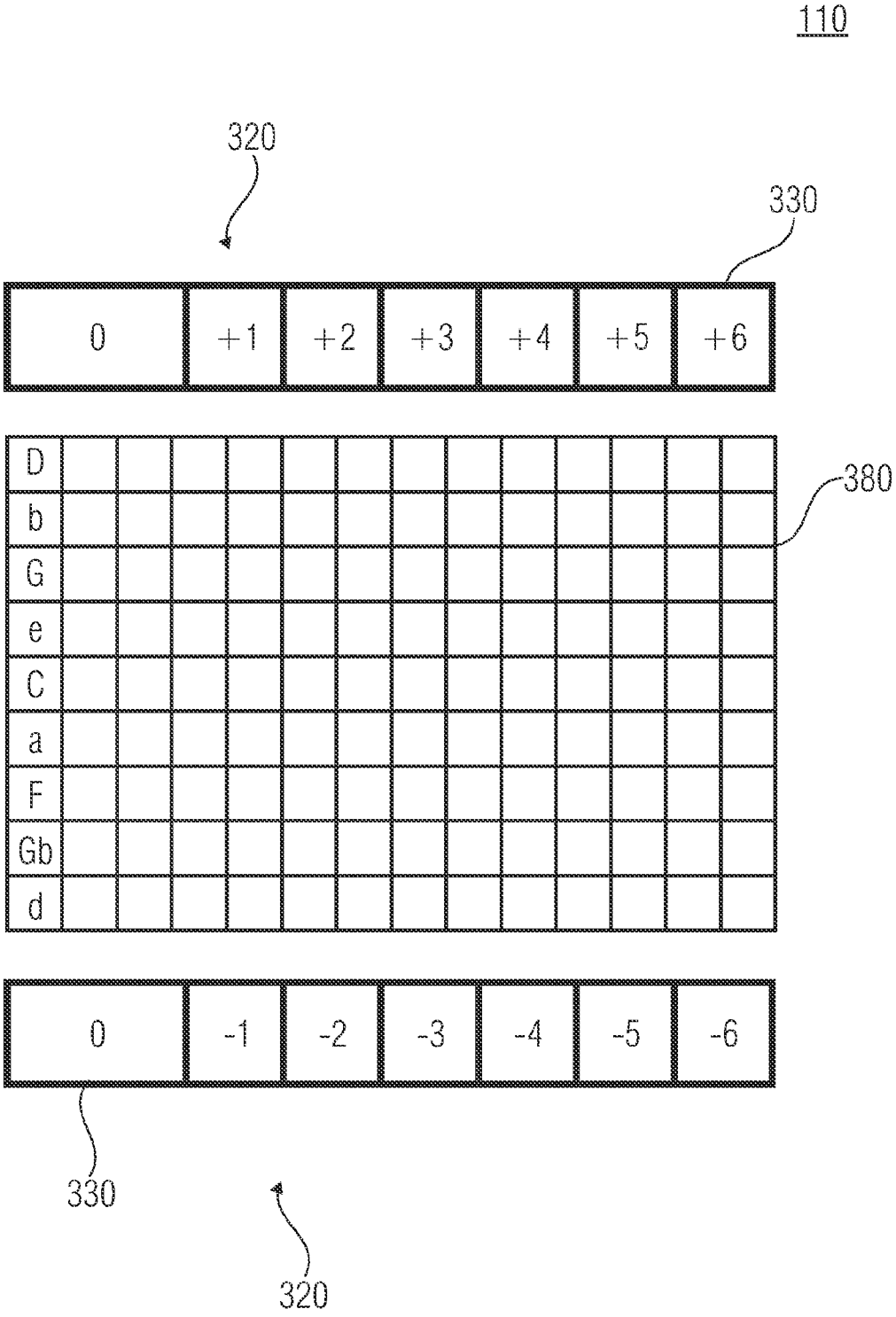
FIGS. 9*a* and 9*b* illustrate operating elements for changing the key of devices according to an embodiment of the present invention.

FIG. 9*a* shows such an implementation of an operating means 110 with an input field 380, for example a touchscreen. In this case, the input field 380 represents both a part of the operating means 110 and also a part of the display means 140 of FIG. 1.

Above and below the input field 380 again operating areas 330 of a change of key operating means 120 are arranged. As was already explained in connection with FIG. 8*a*, also here the operating areas 330 are arranged above the input field 380 such that the key is arranged according to the circle of fifths in a clockwise direction, i.e. in the direction of a rising number of sharp signs (#). Below the input field accordingly the operating areas 330 are also arranged according to the circle of fifths, however counterclockwise, i.e. in the direction of increasing flat signs (b). To also illustrate this, in FIG. 9*a* the corresponding operating areas 330 above the input fields 380 are designated by the numbers 0 to +6 and below the input field 380 by the numbers 0 to −6.

Figure 9B:
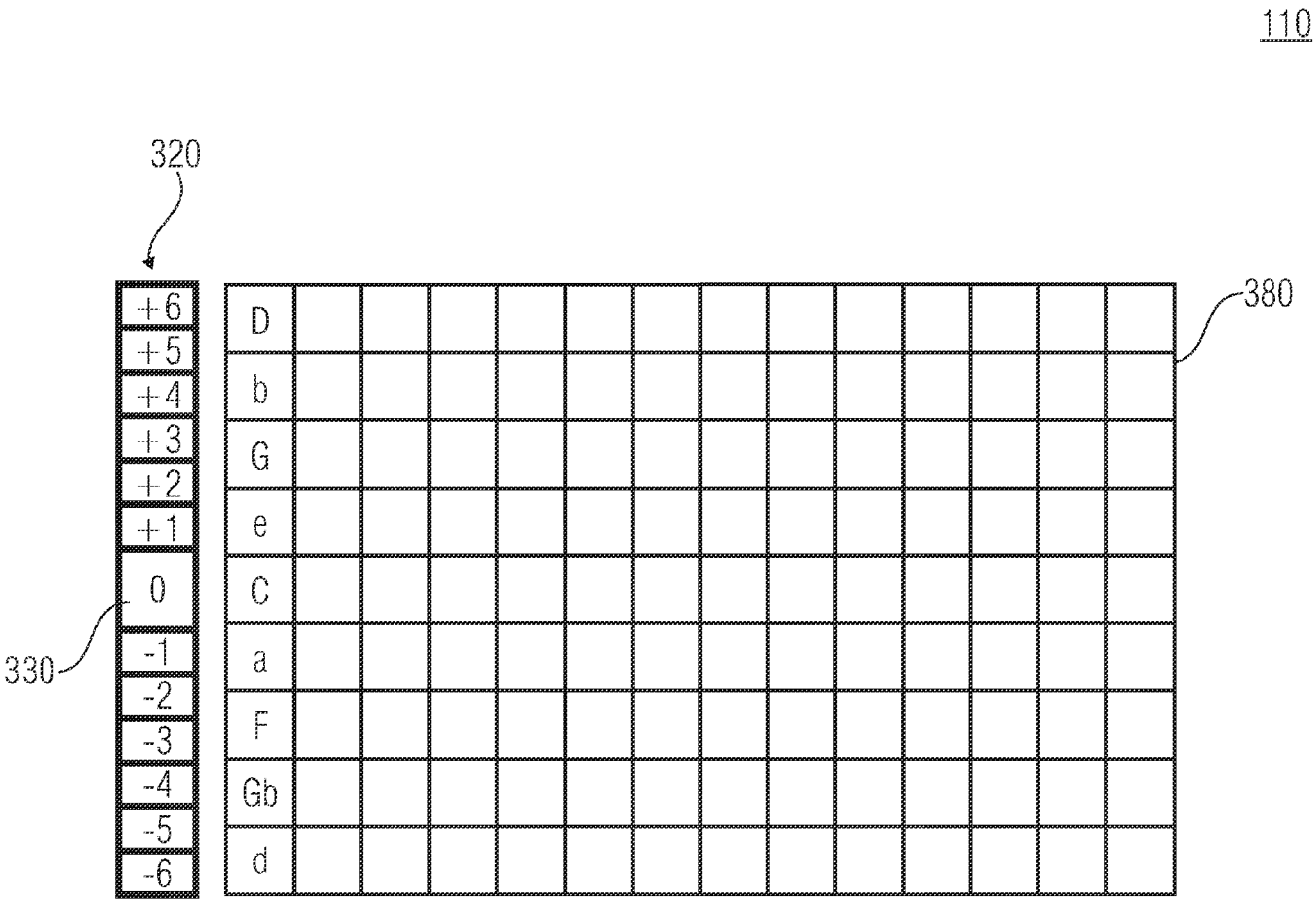

FIG. 9*b* shows a further alternative of an embodiment of an operating means 110 again comprising an input field 380 and a change of key operating means 320. The change of key operating means 320 in the present case includes 13 operating areas 330 vertically arranged on the left side of the input field. The different keys are again allocated, according to the circle of fifths, to the operating areas 330 in the previously described way. To illustrate this, the operating areas 330 in FIG. 9*b* again illustrate the numbers from −6 to +6.

Of course, also mixed forms of the operating areas 330 illustrated in FIGS. 9*a* and 9*b* are possible. Thus, for example, the change of key operating means 320 may be decomposed into two parts as in FIG. 9*a* which are, however, arranged on the left and right of the input field 380.

It remains to be noted that the number of chords appearing on the surface, for example the input field 380, may possibly be sensibly limited in order to prevent wrong conditions. Simultaneously, the above-explained implementation of the change of key operating means provides the possibility of limiting the musical freedom as little as possible.

As was already illustrated in FIG. 4*a*, in the case of a Cartesian or affine coordinate system the key-specific symmetry circle model may be applied on the tone quality axis such that the tonal center or the tonic is allocated to the center of the x axis or the y axis depending on the used plotting and mapping. By this, at the one side the dominant and at the other side the sub-dominant may be selected. Further hardly used accidental chords may be played by corresponding change of key or tone space adaptation operations.

Apart from that it is desirable in some application scenarios to alienate major and minor chords easily, i.e. for example change a major or minor chord into an augmented chord or a diminished chord. Also more unconventional chord alienations may be accessible to the user of the device 100.

In order to enable this, a function may be implemented to raise or lower individual tone qualities of the tone space by one or several semitone steps. By this, the predetermined major-minor tone space may quickly be reconfigured into any other tone space. Depending on the concrete implementation, it may happen in the case of a device without this function that the user is restricted to one tone quality raster. The player would, in this case, possibly be limited to the chords predefined by the respective tone space.

Via suitable input means the player may be given the possibility of adapting the predetermined tone quality division. Such an alienation of chords and the playing of the chords may also here possibly be carried out with the same hand and at the same time. In addition to that, it may be desirable to realize a clear relation of the respective alienation operating element with respect to the tone quality alienating the operating element.

To achieve this, the corresponding operating element for alienating the chords may be arranged in the proximity of the actual operating unit for playing the chords. It may also be advisable to arrange the same on the surface such that the same are positioned in an easily detectable geometrical connection with respect to the tone quality which alienates the operating element and with respect to the position on the input field.

Figure 10A:
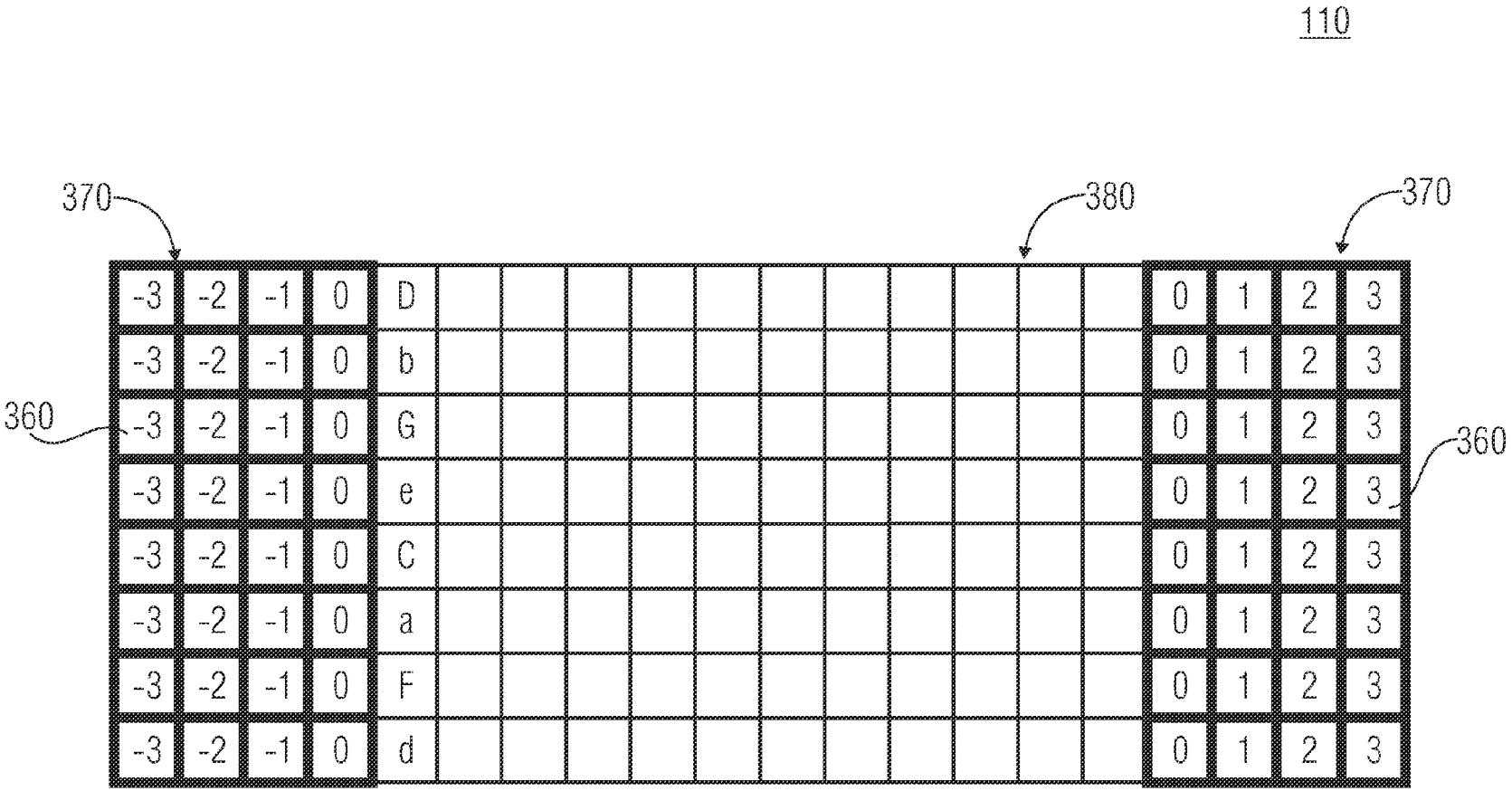
FIGS. 10*a* and 10*b* illustrate operating elements for raising or lowering tone qualities.

FIG. 10*a* shows an embodiment of an operating means 110 with a central input field 380, wherein the tone quality axis runs vertically and the tone qualities of the C major scale are arranged according to the symmetry circle model. The symmetry tone or the symmetry tone quality d or D here limit the input field 380 to the top and to the bottom.

Operating areas 360 are arranged on the left and the right of the input field 380 for each of the tone qualities represented in the input field 380, and for the sake of simplicity only two of them are provided with a reference numeral in FIG. 10. This is the operating area of the tone quality G having the value −3 and the operating area of the tone quality C having the value +3.

Here, four operating areas 360 each for each of the total of eight tone qualities represented on the input field 380 are arranged both on the left and the right adjacent to and neighboring to the corresponding positions of the tone qualities on the input field 380. The total of 64 operating areas 360 thus form two rasters the size of 32 operating areas, together forming a tone quality changing operating means 370.

On the left of the input field 380, here the operating areas are labeled starting from the left and ending on the right with the numbers −3 to 0. Accordingly, on the right side of the input field 380 the operating areas 360 are labeled with the numbers 0 to 3.

FIG. 10*a* thus shows an arrangement of operating elements 360 for raising or lowering the respective tone quality in the geometric proximity or in optical association to the respective tone quality. These operating areas 360 may be implemented as raising or lowering keys. Each of the lowering keys 360, or flat keys, arranged on the left next to the tone quality line stands for a fixed lowering value indicated on the respective operating area 360.

Accordingly, each of the sharp keys 360 arranged on the right of the input field 380 represents a corresponding sharp or raising value. These sharp keys 360 are each positioned on the right next to the associated tone quality line. The given sharp or flat values here relate to semitones, i.e. small seconds.

Figure 10B:
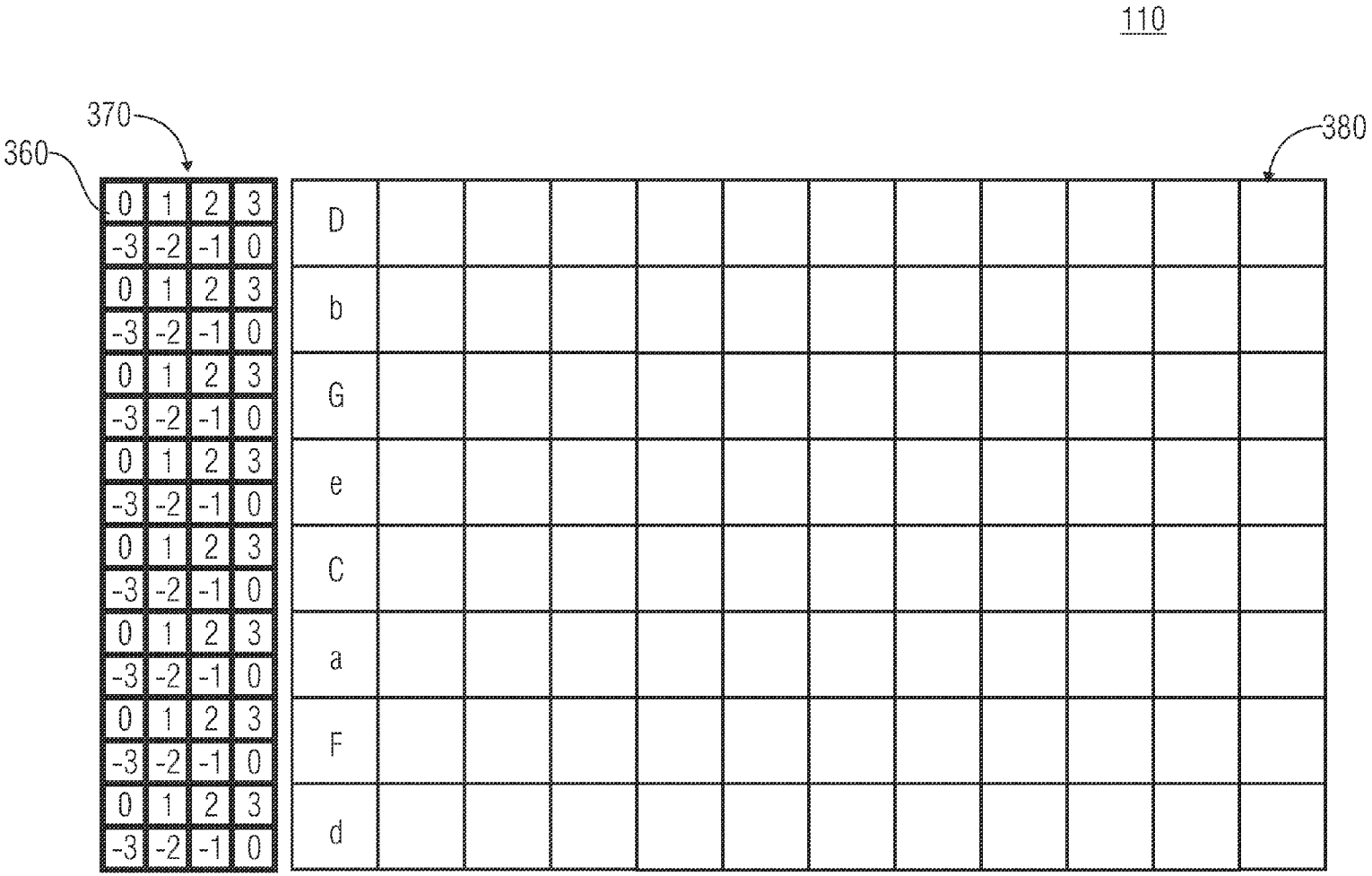

FIG. 10*b* shows a further embodiment of an operating means 110 with an input field 380 and a tone quality changing operating means 370 with a corresponding arrangement of 64 operating areas 360. In contrast to the operating means 110 illustrated in FIG. 10*a*, here both the sharp and also the flat keys are positioned on the same side of the input field 380. Accordingly, in FIG. 10*b* a double row of four operating areas 360 each is arranged on the left side of each tone quality line, wherein the top partial row of the double row includes the sharp keys and the bottom row the flat keys.

Of course, also here again deviations may be implemented, for example by arranging the double row implementation of FIG. 10*b* on the right of the input field 380. Further, a one-sided and one-row orientation of the operating areas 360 may be realized.

In the case of a touch-sensitive area (touch pad), there is additionally the possibility of arranging an operating element next to the corresponding tone quality lines enabling the operation for the change of tone quality. This might be a small joystick for example, which may be moved to the top or the bottom to shift the line by one semitone to the top or the bottom. Such an operating means 110 may further be implemented such that, when moving the joystick to the left or to the right, the line is changed by a whole-tone or semitone step. Another possibility is to offer a key field for each tone quality, wherein each key enables a fixed raising/sharp or lowering/flat value of the tone quality. Such a key field might again be arranged in corresponding spatial directions, as are described in connection with the joystick.

The embodiments illustrated in FIGS. 10*a* and 10*b* are thus different insofar that, in the case of the implementation illustrated in FIG. 10*a*, the sharp or raising and also the flat or lowering operating elements 360 are arranged on both sides of the respective tone quality line of the input field 380. In the case of the input field 380 with the tone quality changing operating means 370 illustrated in FIG. 10*b*, the sharp and also the flat operating elements 360 are positioned on the same side next to the respective tone quality line.

By this, for example the possibility of realizing a raising or lowering of the tone quality by a semitone or a whole tone during playing results. Thus, forming a variant, i.e., for example, a change from e minor to E major is possible for playing harmonic scales. Further, playing augmented chords is possible, wherein, for example, a C major chord is first played and the tone G contained in the chord is raised to G#. In other words, the tone quality G contained in the chord is raised to G#. Further, a seventh chord may be played in which, for example, based on the previously mentioned C major chord, the tone G is raised by three semitones.

Figure 11A:
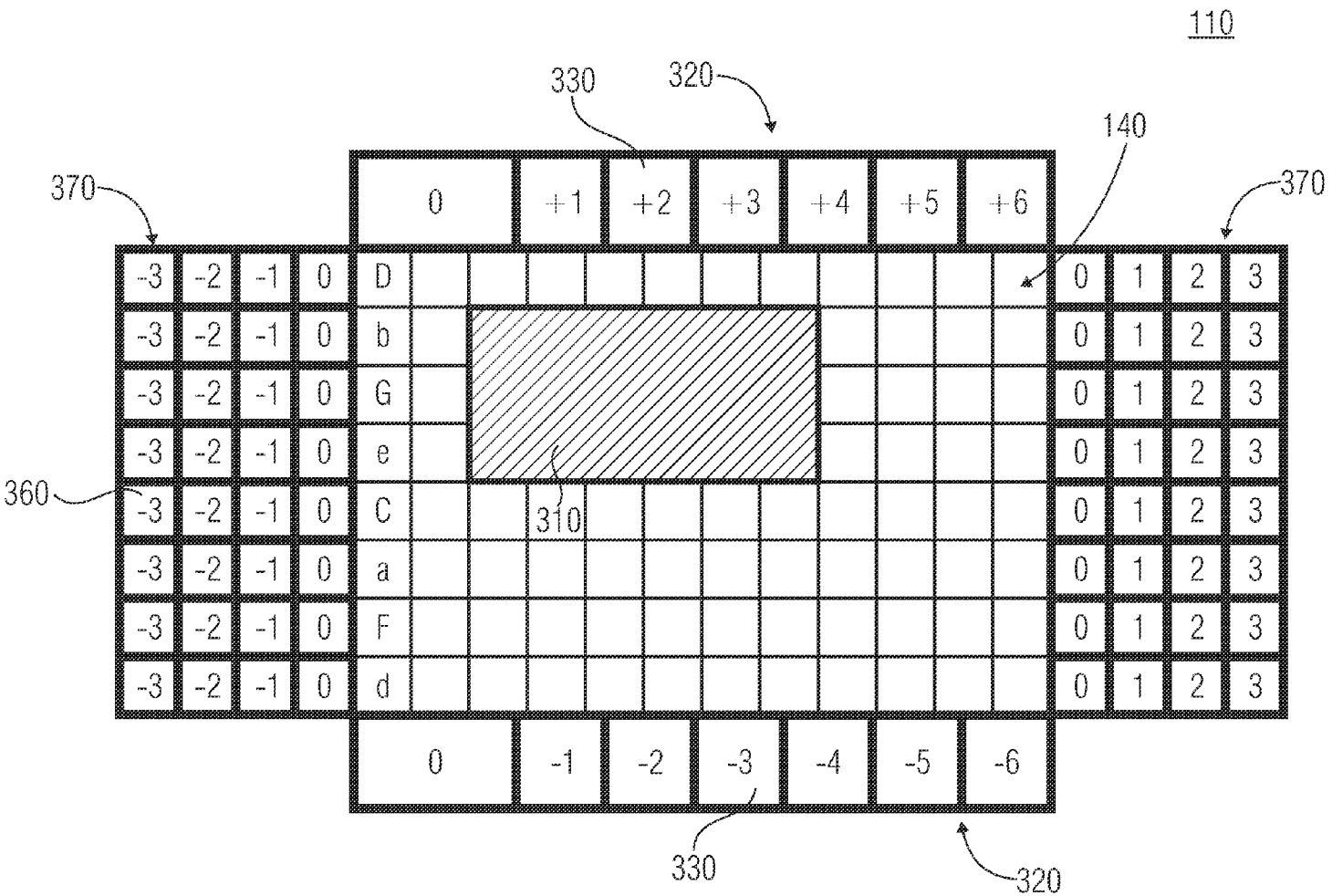
FIGS. 11*a* to 11*d* illustrate the alienation of minor and major chords with the help of an embodiment of the present invention.

FIG. 11*a* shows the operating means 110 already described in FIG. 8*a*, wherein in the description of FIG. 8*a* the tone quality changing operating means 370 was only briefly outlined regarding its operating areas 360. This is a means such as the one already shown and described in FIG. 10*a*. In particular this embodiment of an operating means 110 illustrated in FIG. 11*a* thus illustrates that different components of the corresponding operating means, as they have been explained and illustrated in the present description, may be combined with each other very flexibly.

As was already explained in connection with FIG. 8*a*, also here the individual operating areas 330 of the key changing operating means 320 and the operating areas 360 of the tone quality changing operating means 370 are only designated by reference numerals in individual cases.

In addition to that, in FIG. 11*a* an area 310 is illustrated on the display means 140. Considering the tone qualities represented on the tone quality axis according to the symmetry circle model of the key C major, an e minor chord is currently played.

Figure 11B:
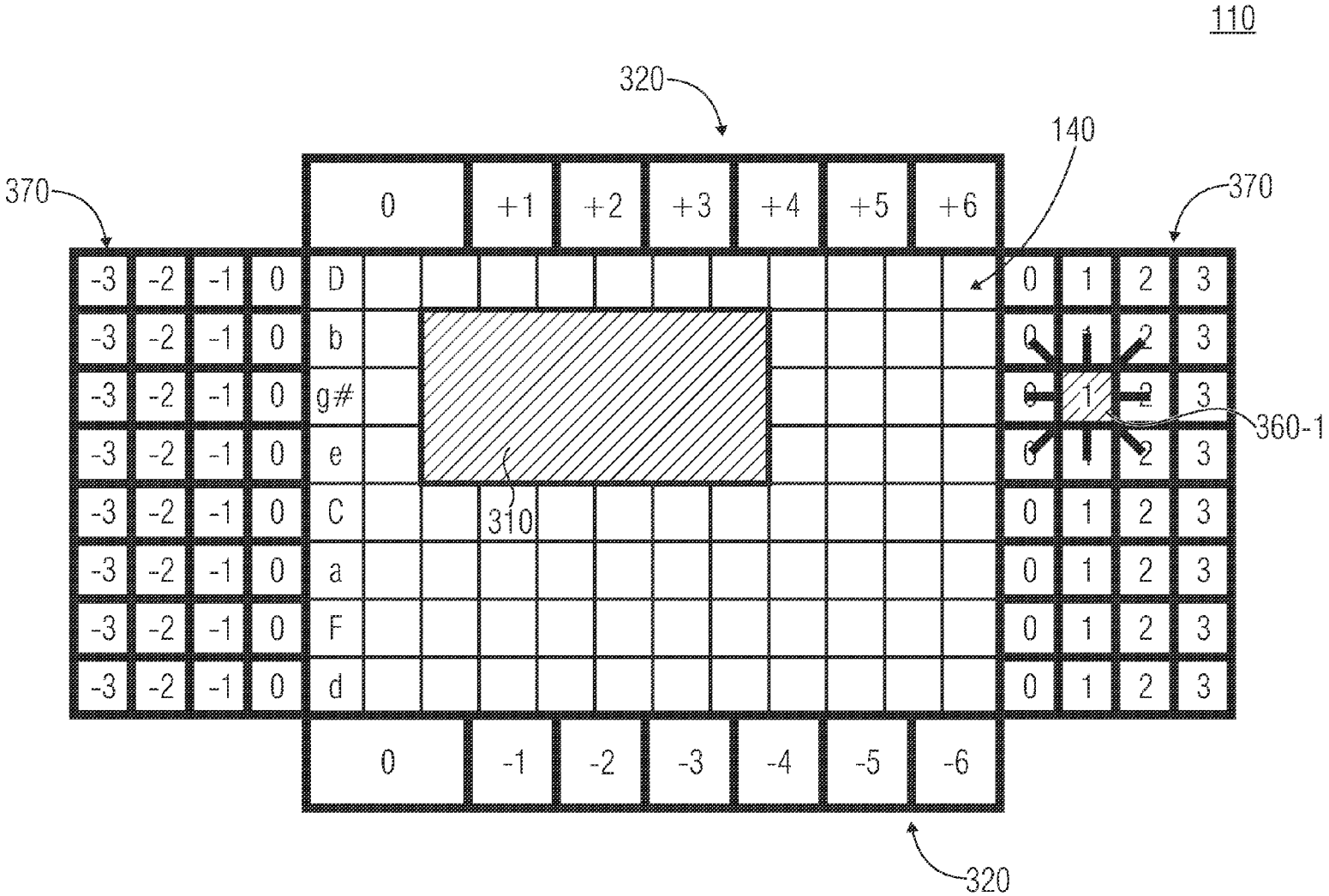

Based on the original unchanged tone space, by raising or lowering tones, one, several or all tones of the respective tone quality may now be raised or lowered. FIG. 11*b* shows the operating means 110 of FIG. 11*a*, wherein, however, the operating element or operating area 360-1 is operated for raising the tone G by one semitone. This is illustrated on the display means 140 also by the fact that the tone quality g# is now illustrated there. The tone quality g and thus all tones of the tone quality g are now raised by one semitone. The original chord e minor has thus changed into an E major chord.

FIGS. 11*a* and 11*b* thus currently illustrate the case that the control means 120, based on the allocation function, generates a modified allocation function with a definition quantity allocated to the same. The modified allocation function here currently comprises a first point to which, via the allocation function, the same tone is allocated as via the modified allocation function. The situation illustrated in FIGS. 11*a* and 11*b* is, for example, the tone e which is located within the area 310. The same is not changed in the transition into the modified allocation function in FIG. 11*b*, i.e. maintains its tone quality.

The definition quantity or amount of the modified allocation function in addition to that comprises a second point, however, to which, via the modified allocation function, a tone with a tone quality is allocated which is different from a tone quality of a tone allocated to a point having the same coordinate on the tone quality axis via the allocation function. In the present case, the points of the tone quality G in FIG. 11*a* and the tone quality g# in FIG. 11*b* comprise the same coordinate on the tone quality axis, i.e. here the Y axis. By the modification of the allocation function, thus a tone with another tone quality is allocated at least to one point having this coordinate, i.e. here to the point with the tone g#. Beforehand, the tone G was allocated to at least one associated base point having the same coordinate on the tone quality axis.

Again in other words, in embodiments of the present invention, the control means 120 may be implemented such that tones of a common tone quality are allocated to points with a common coordinate on the tone quality axis via the modified allocation function, these tones being, however, allocated to a tone quality deviating from the common coordinate on the tone quality axis via the (original) allocation function. Also here, the coordinate is again the one on the tone quality axis, i.e. that of the two tone qualities G and g#.

Figure 11C:
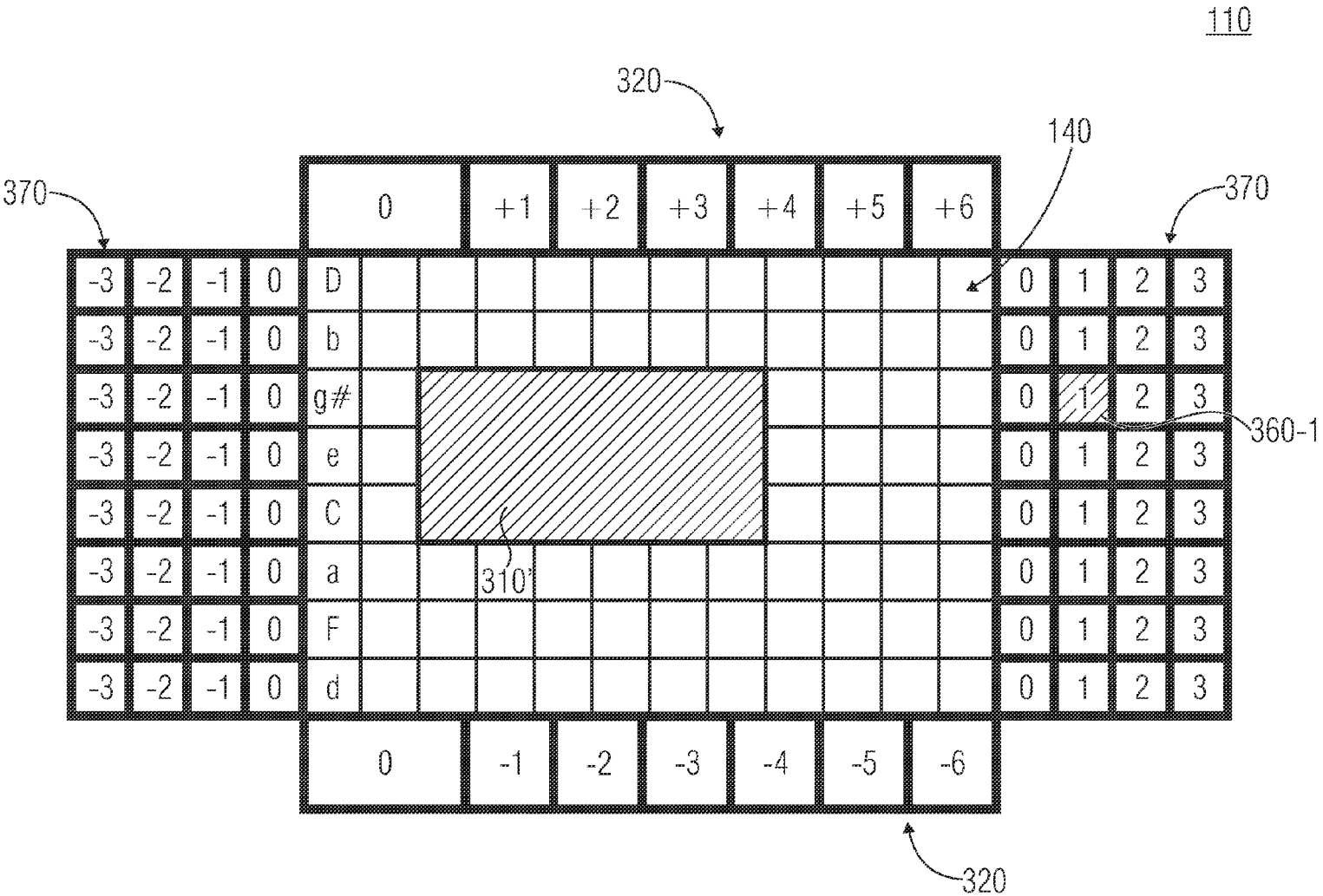

FIG. 11*c* again shows the operating means 110, wherein, however, the selection area 310 has been shifted "downwards" by one tone quality on the tone quality axis. Shifting the thus resulting selection area 310', considering the still pressed operating area 360-1, has the consequence that the area 310' is at the position in which originally the C major chord of the unchanged tone space was located. By raising the tone G to G#, however, the chord C sounds augmented.

Figure 11D:
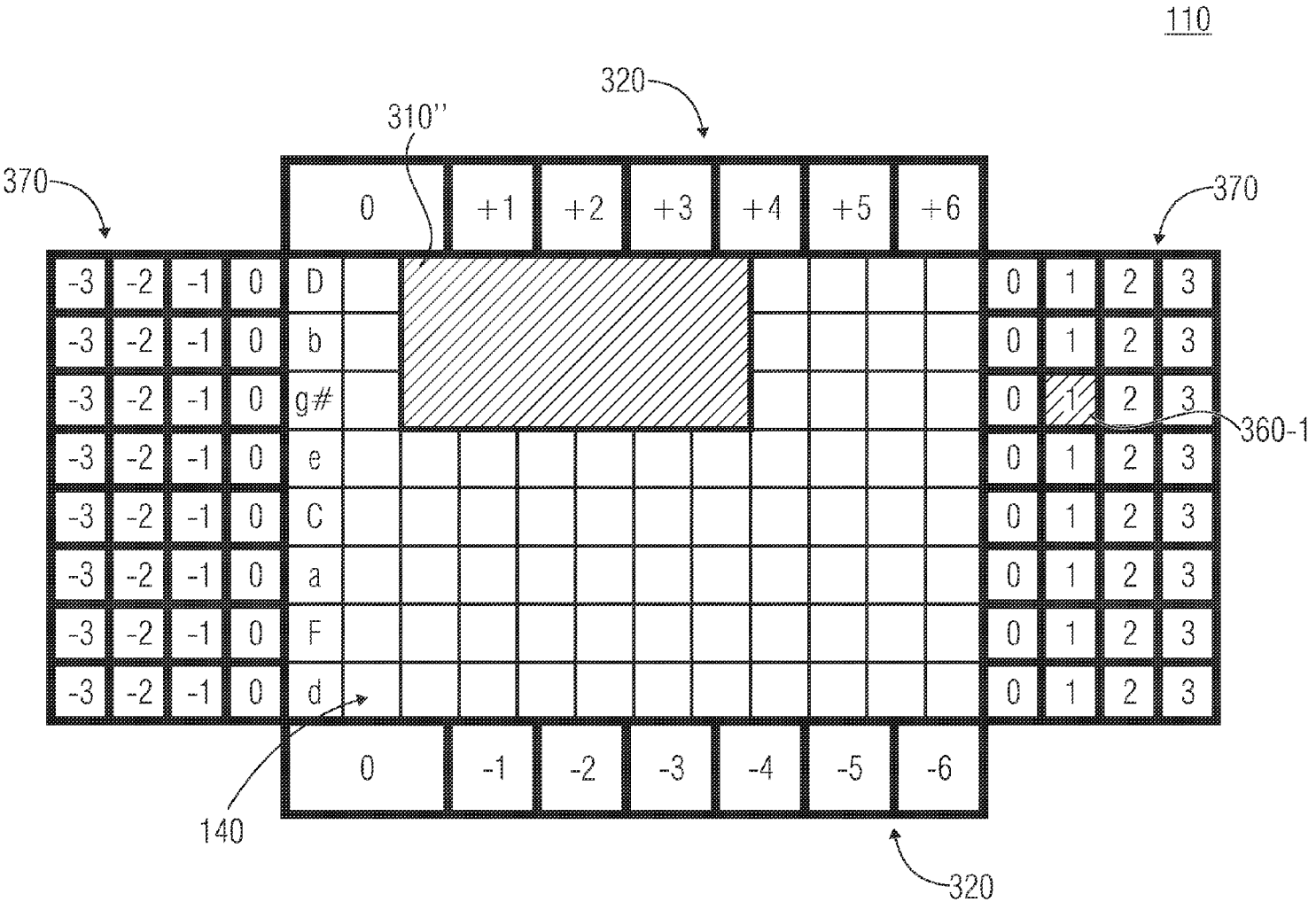

FIG. 11*d* shows the preceding situation in which, compared to FIG. 11*c*, the selection area 310' has been transformed by an opposite shifting into the new area 310". This has the consequence that the selection area 310" comes to lie in the position where originally, i.e. with regard to the unchanged tone space, the chord G major is located. By raising the tone quality G to G#, however, not the chord G major, but rather the chord G# is played diminished. In the case of such an implementation, for example all tone raster changes may be taken over immediately. By this, a selected chord immediately audibly changes across the associated area 310 when the tone space section relating to the chord is changed.

In the above-described implementation, thus all tones belonging to the respective tone quality are raised or lowered by a tone raising or tone lowering operating element 360. In particular with regard to this implementation detail, a corresponding raising or lowering may, however, be limited to a lower number, possibly even to only one single tone. Thus, it is possible, for example, by a corresponding octave selection, to raise or lower only part of the tones of a tone quality solely in embodiments of the present invention.

When alienating chords, i.e. with a specific raising or lowering of tones, it may sometimes happen that tones fall out of the respective selection area 310 and thus possible incomplete chords are played. It is, however, desirable, when individual tones are raised or lowered, to continue to achieve the same full sound and make it audible.

Figure 12A:
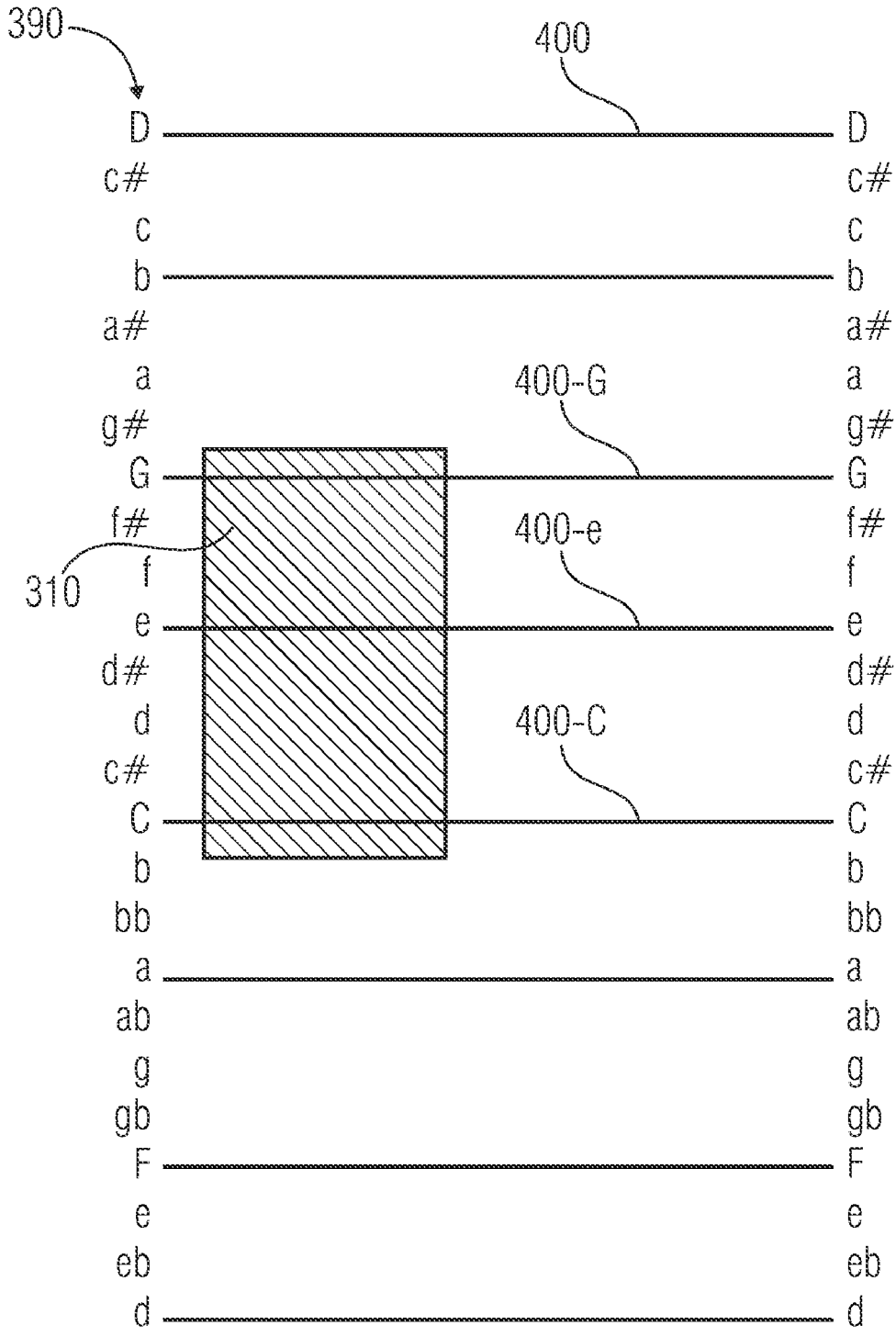
FIGS. 12*a* to 12*c* illustrate a distortion of the tone space defined by the allocation function according to embodiments of the present invention.

In order to illustrate this in more detail, in FIG. 12*a* a simplified illustration of an allocation function and a selection area 310 is illustrated. In particular, FIG. 12*a* shows a chromatic scale 390, wherein the tone qualities contained in the allocation function are illustrated by horizontal lines 400. Further, FIG. 12*a* shows the already mentioned selection area 310 which is set such that the chord C major is played. The selection area 310 thus covers the tone qualities C, e and G. This is also illustrated in FIG. 12*a* by the fact that the horizontal lines 400-G, 400-*e* and 400-C intersect the area 310.

Figure 12B:
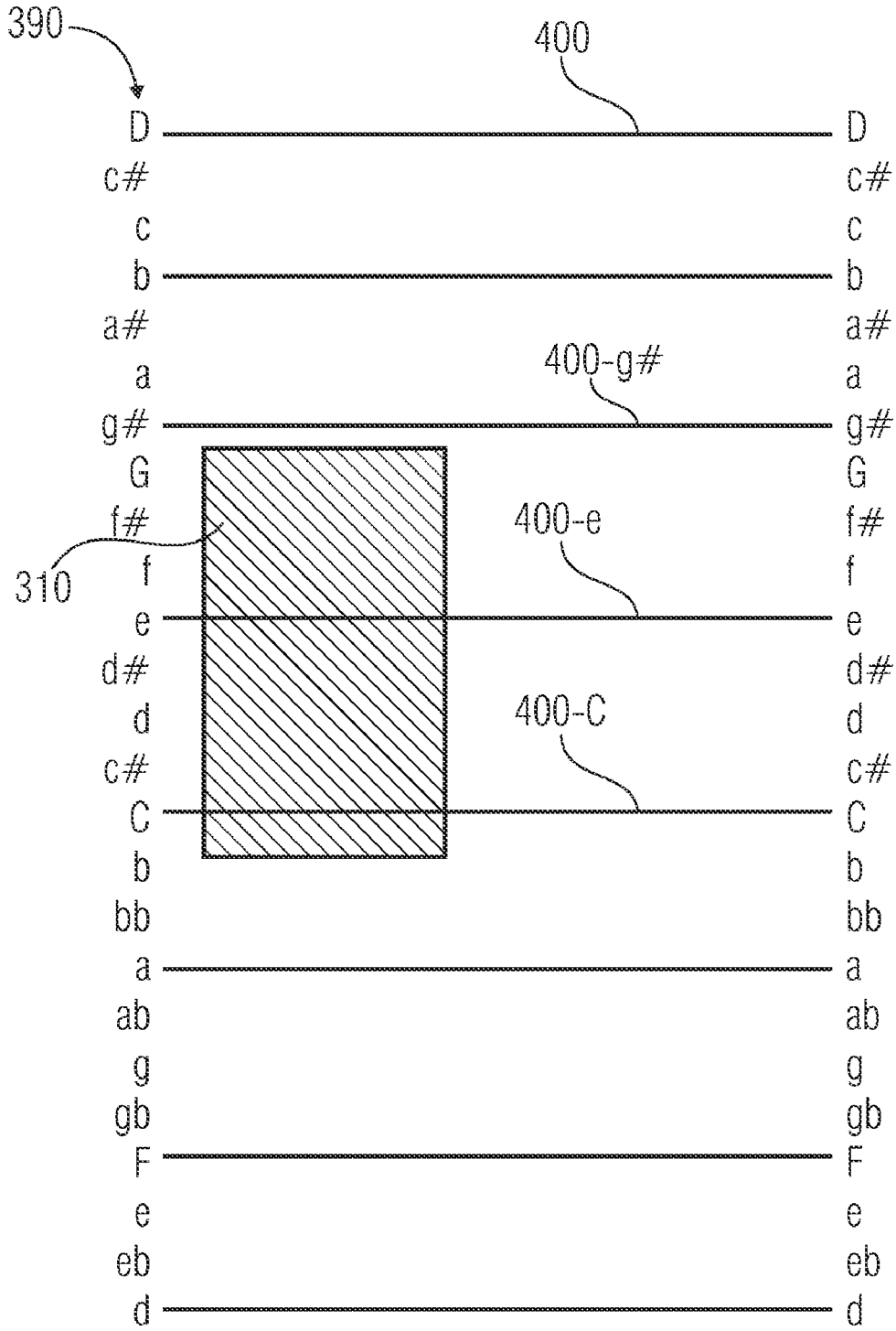

If now, as is illustrated in FIG. 12*b*, by operating the corresponding tone raising key, the tone G is raised to G#, the tone quality G will generally not belong to the modified allocation function any more, but the tone quality G#. In FIG. 12*b* this is illustrated by the fact that now the horizontal line 400-G is no longer represented but the line 400-*g#*.

The problem is now that the tone G# is no longer positioned in the area of the selection area 310. Thus, only the tones C and e will sound, so that the corresponding chord sounds thin an incomplete. The result in the form of a G augmented chord is not played.

A solution to this problem is a "bending" of the chromatic scale 390 to obtain the modified chromatic scale 390'. The same is different from the chromatic scale 390 illustrated in FIGS. 12*a* and 12*b* by the fact that in an area 410 the distance between the horizontal lines 400-*b* and 400-*g#* has been extended such that the raised tone (g#) is geometrically represented at the position of the original tone G. This approach, which may possibly also result in a shrinkage of the distance between the tone lines 400-G# and 400-*e*, has turned out to be advantageous when playing.

One possible realization here is based on distorting the tone space such that the raised, lowered or generally changed tone remains at the position of the original tone. By adjusting the geometrical representation of different intervals, thus this problem may be solved. An analogy in this respect may be found in the claviature, where in the key C major the whole-tone steps c-d, d-e, f-g, g-a, a-b and the semitone steps b-c and e-f are represented by the same key width.

Figure 12C:
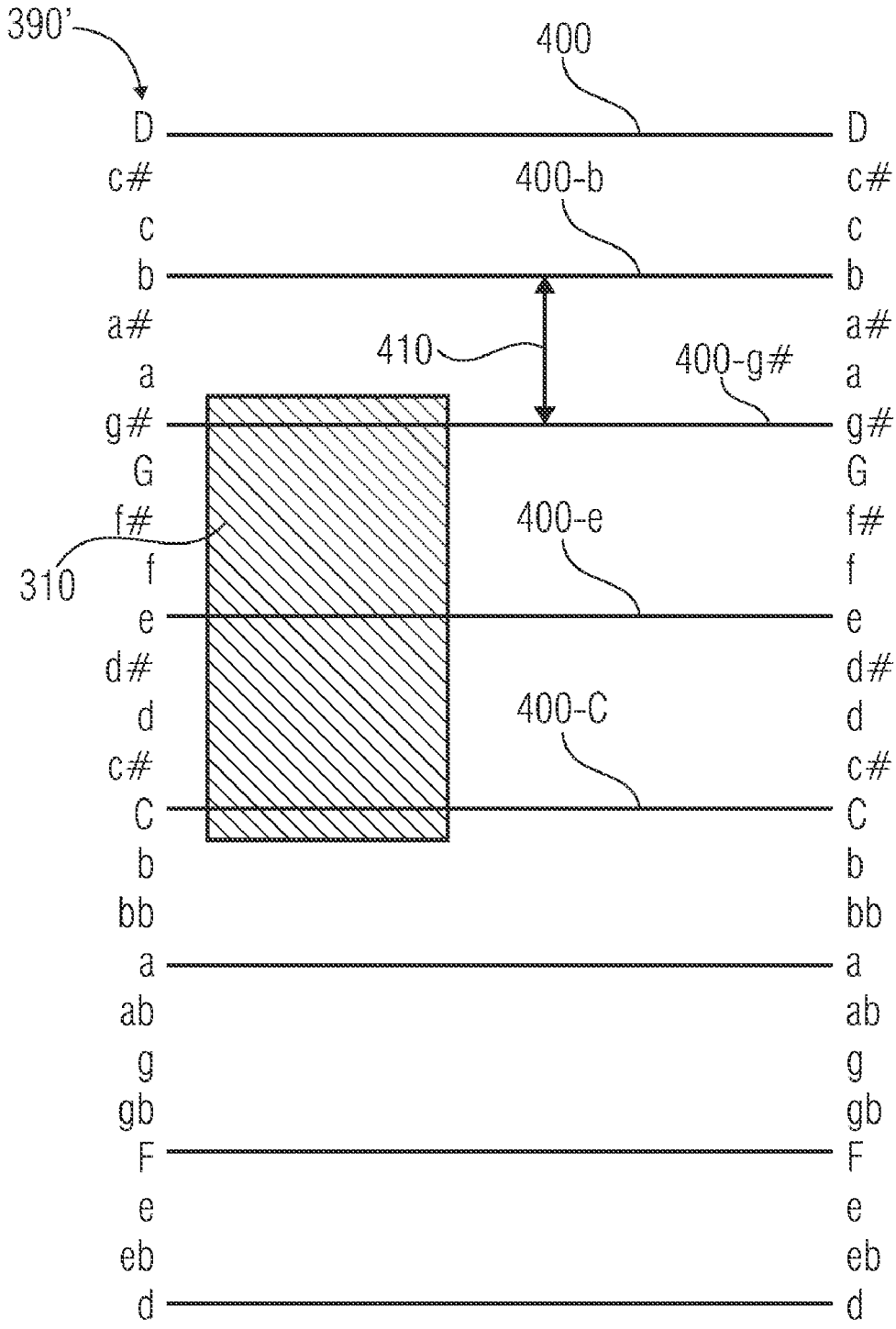

Exactly this is illustrated in FIG. 12*c*, wherein the tone space is distorted such that neighboring tone qualities have the same distance. The tone g# is thus at the position where the tone G was arranged beforehand. By this tone space including a distortion, again the complete chord may be played without adapting the area 310. As was already illustrated in FIGS. 11*a* to 11*d*, the auxiliary tone lines are automatically adapted. Three auxiliary tone lines are located between the tone e and the tone g#, whereby the real tone pitch or distance is still signalized.

One advantage of the distortion solution is that the tones are thus more easily accessible. Originally, the distances of the tones on the surface of the musical instrument correspond to 100 real interval distances. However, it turned out to be practical that two neighboring tones are represented at the same distance on the operating means 110 of the instrument. Thus, the tones are more easily accessible. There is thus the possibility of implementing a function which quantizes the different interval distances onto an equidistant raster.

Thus, in embodiments of the present invention, a function may be implemented to raise or lower individual tones of the tone space by one or several semitone steps. By this, the predetermined major-minor tone space may quickly be reconfigured into any other tone space. In contrast to a tone quality raster which is fixed, the player is now not limited only to the chords predefined by the tone space. He is rather given the possibility, by a suitable input means, of adapting the given tone quality classification.

Thus, for example a raising or lowering of a tone quality via a semitone or a whole tone is possible for forming variants, augmented chords, seventh chords and other alienations, as has already been indicated above.

Such a manual change of the given tone space may, for example, be implemented temporarily or permanently. In the case of a temporary change, the device 100 may be implemented such that after releasing the corresponding operating element the tone space is configured back into its original state. This enables a brief playing of a chord or tone which is alien to the scale. In the case of a permanent change of the tone space, the same remains in its state even after the corresponding operating element was released.

Additionally, there is the possibility of providing additional operating elements, for example macro keys, which are freely programmable by the user, preprogrammed or changeable with respect to their programming. By this, shifts and other modifications of the allocation function or the area 310 occurring when playing may be stored in advance. When shifting the tone space, there are certain configurations needed very frequently by the player. These include shifting the key by +/−3 fifths to find the corresponding variants for given major or minor chords. With the help of the above-mentioned macro keys, corresponding relative shifting operations may be pre-stored and retrieved via the same as corresponding operating elements.

Further, context-dependent macro keys may be implemented which lead to certain tone combinations. Thus, e.g., the extension of a major or minor triad into a dominant seventh chord is possible. This function may be achieved, for example, by a change of key and an extension of the tone quality interval.

With low frequencies, caused by the sensory dissonance and the frequency group width within the ear, strong dissonances may result when not only single tones but also intervals are played. To avoid this, a function may, for example, be implemented which automatically reduces a selected tone quality interval when a starting frequency, which may also be referred to as a relative reference position on the selection area, and thus the octave position of the chords to be played fall below a certain threshold value (cutoff frequency).

This function has turned out to be very useful in practice, as it offers the possibility of playing single bass tones and chord accompaniment patterns with one hand. Embodiments of the present invention are in this respect not at all limited to Cartesian or affine coordinate systems. Thus, polar coordinate systems in which, for example, the tone quality axis corresponds to an azimuthal direction, i.e. angles, may well be used. In such a case, the frequency or other tone pitch information, for example octaving, may be implemented as a radial axis. Thus, apart from the tone quality axis also a tone pitch information axis results, on which next to a frequency or an arrangement of tones derived from the same possibly also octave information, i.e. the octaving, may be comprised. In such a case, the reduction of the tone quality interval corresponds to a reduction of an opening angle.

Figure 13A:
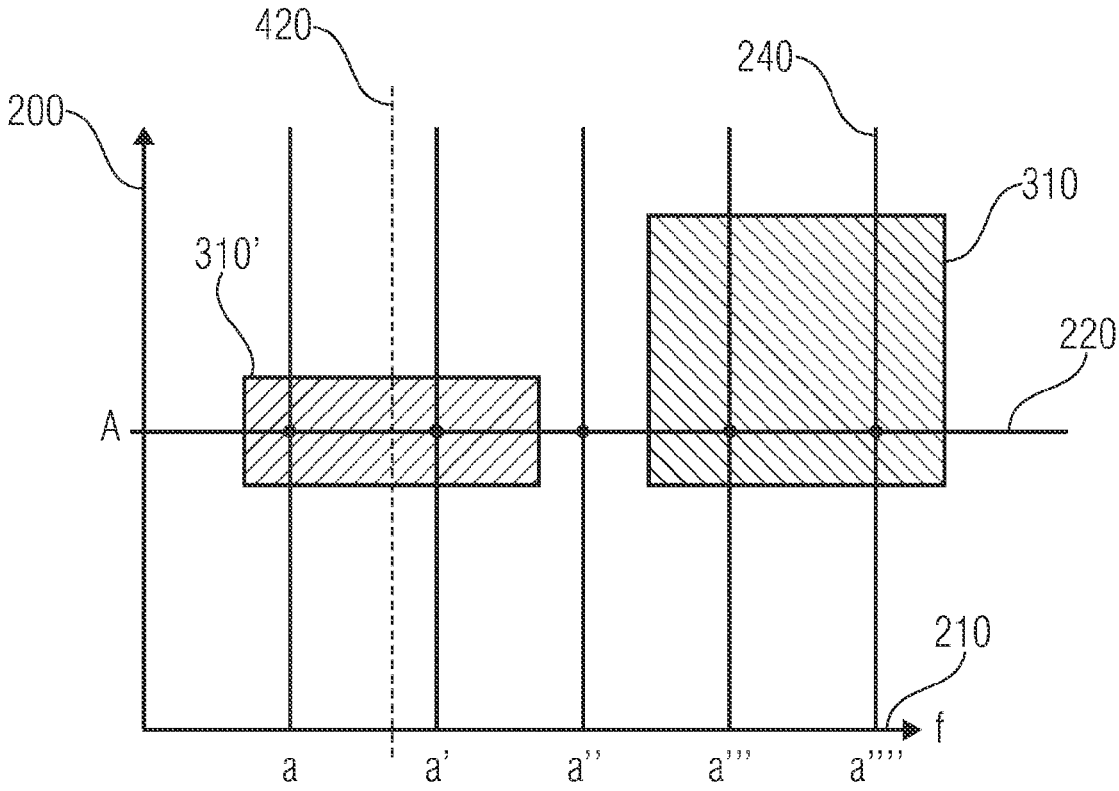
FIGS. 13*a* and 13*b* illustrate a reduction of a tone quality interval of a selected area depending on a lowest frequency according to embodiments of the present invention.

To explain this in more detail, FIG. 13*a* schematically shows an allocation function with a tone quality axis 200 and a frequency axis 210. For simplifying the illustration, in FIG. 13*a* only the tone quality A with its corresponding tone quality line 220 is illustrated. In addition to that, in FIG. 13 a corresponding tone lines 240 are plotted for different frequencies or tones of the tone quality A. These are the tones a, a', a", a'" and a". The frequency axis 210 is plotted logarithmically here.

In addition to that, FIG. 13*a* shows an area 310 including the two tones a'" and a". If the area 310 is now shifted along the frequency axis 210 towards smaller frequencies, an area 310' results as soon as a smallest or lowest frequency of the respective shifted area 310 falls below a cutoff frequency 420. Reducing the tone quality interval is here implemented such that only one single tone quality, in this case the tone quality A, is played.

In other words, the operating means 110 is implemented to enable a user of the same to define the area 310 with a tone quality interval as an input signal, wherein the tone quality interval depends on a lowest frequency of all points of the area 310. The tone quality interval is here reduced from a first value above the cutoff frequency 420 to a second value below the cutoff frequency 420, wherein the second value is smaller than the first value.

Figure 13B:
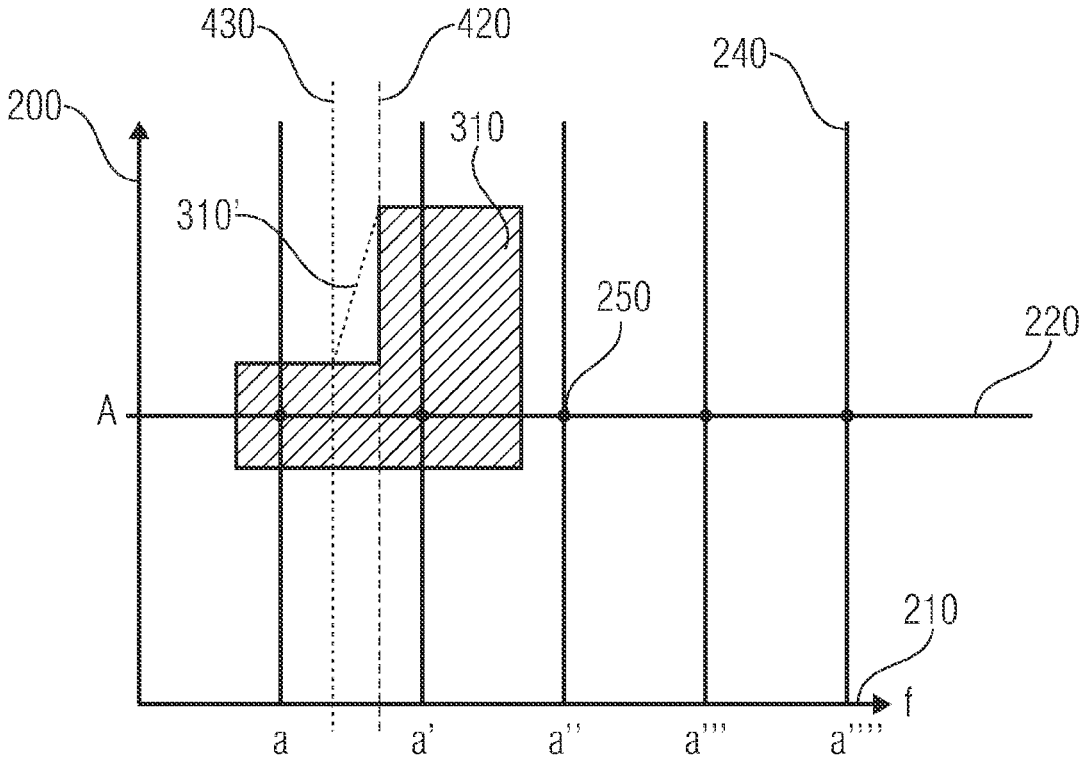

FIG. 13*b* illustrates an alternative implementation of such an automatic reduction of the tone quality interval in the bass range, which may possibly also be implemented in addition to the variant illustrated in FIG. 13*a*. FIG. 13*b* again shows the allocation function of the tone quality A, the tone quality line 220 and the above-described tones a to a" and the associated tone lines 240 already described above. In addition to that, FIG. 13*b* again shows an area 310 including the base points of the tones a and a'. In contrast to the case illustrated in FIG. 13*a*, however, the tone quality interval is not reduced for the complete area 310 when falling below the cutoff frequency 420. In this case, rather, only the tone quality interval is reduced for the portion of the area 310 which lies below the cutoff frequency 420. Thus, a mirrored L-shaped area 310 results.

In a further embodiment also schematically plotted in FIG. 13*b*, this transfer is not executed erratically, i.e. from the second value above the cutoff frequency to the first value below the cutoff frequency exactly when reaching the cutoff frequency 420, but a gentle reduction of the area 310 is executed as it is plotted in FIG. 13*b* as the area 310'. Here, the area is reduced linearly to the second value, starting at the cutoff frequency 420 up to a further cutoff frequency 430. Of course, in other embodiments of the present invention, also other functional connections for reducing the tone quality interval may be implemented. Examples thus include polygonal functional connections, exponential connections, logarithmic connections and any combinations of these and other mathematical functions.

Figure 14A:
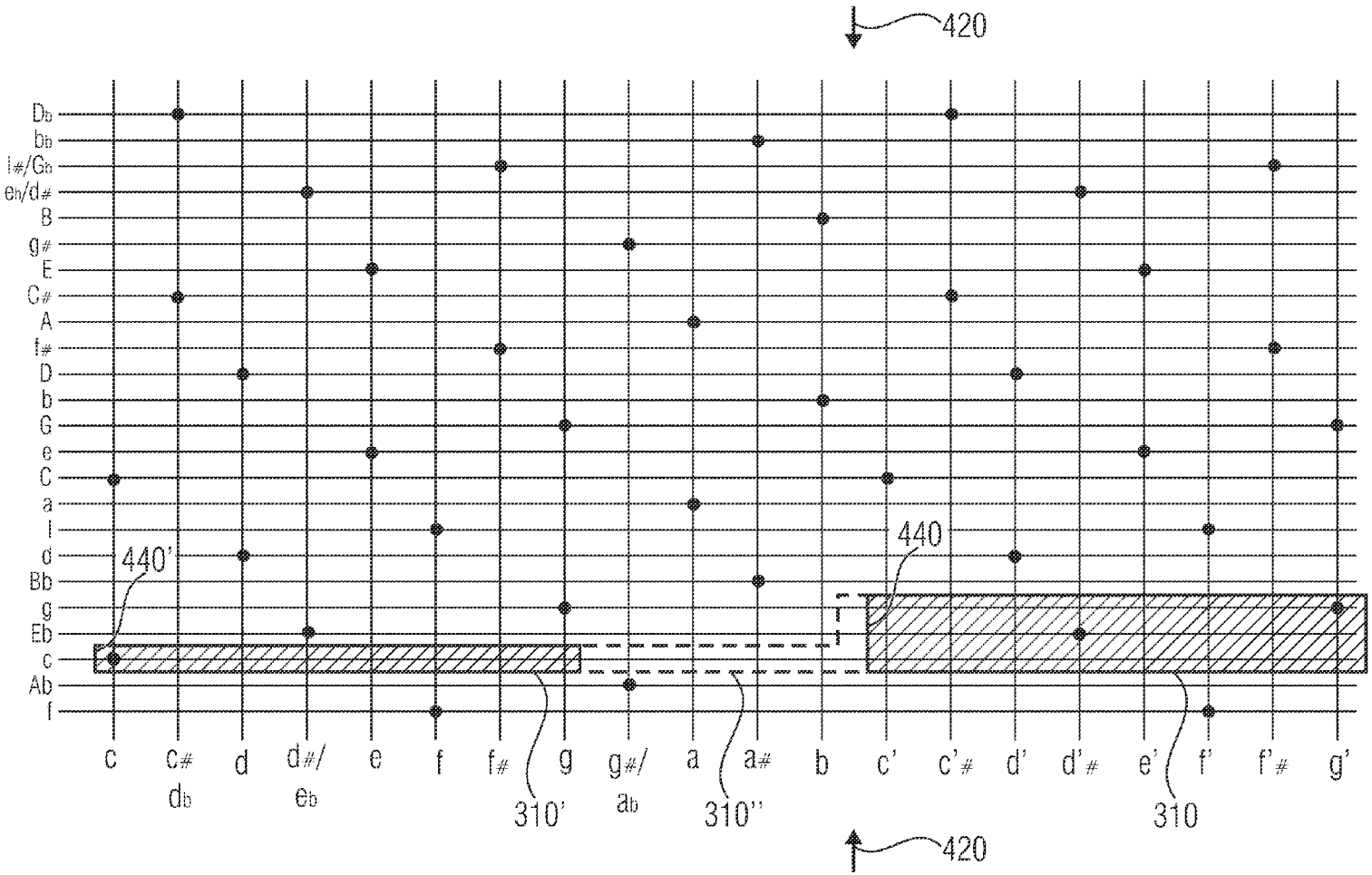
FIG. 14*a* illustrates reducing the tone quality interval according to a further embodiment of the present invention.

FIG. 14*a* illustrates this in the case of a more complex or more complete plotted allocation function. FIG. 14*a* shows the tone space already illustrated in FIG. 6, the description of which is referred to here. Here, first of all the first alternative is described, wherein the tone quality interval of the complete area 310 is reduced. In this example, the tone space is configured such that with a rising coordinate on the frequency axis also the tone pitch of the selected tone qualities increases.

Based on the area 310 illustrated in FIG. 14*a* a normal playing situation is represented, wherein a lowest frequency 440 of the area 310 is so high that tones are played in a normal frequency range so that a listener, also in the case when several tones are sounding, perceives these as a harmonic chord, i.e. not as dissonant. In other words, the lowest frequency 440 of the area 310 is above the cutoff frequency 420. In the present example, as a tone quality interval a preset tone quality interval is used which here comprises a width of more than three neighboring tone qualities. If the lowest frequency 440 of the area 310 is now reduced so that the same comes to lie at the lowest frequency 440' of the area 310', a preset or programmable threshold value, i.e. the cutoff frequency 420, is fallen short of The tone quality interval was here automatically reduced such that only one tone is played. Annoying dissonances may thus be avoided.

The second alternative illustrated and explained in connection with FIG. 13*b* is now to possibly divide the selection area 310", also illustrated in FIG. 14*a*, into two partial selection areas, wherein the one part covers tones of higher frequencies above the cutoff frequency 420 and another part covers tones of lower frequencies below the cutoff frequency 420. The first part of the area 310" here maintains its original tone quality interval, while the second part receives a reduced value as a tone quality interval. One advantage of this variant is that with only one single selection area 310" which covers or scans a large frequency range typically including a bass area, pleasant-sounding chords may be defined. The frequency range frequently starts at very low tones and may in such a case be defined up to very high tones. FIG. 14*a* thus in the form of the area 310" shows such an area which was automatically trimmed so that the tone quality interval in the lower frequency ranges is smaller and thus no annoying dissonances result.

Embodiments of the present invention in which a reduction of the tone quality interval is implemented with low frequencies are not limited to affine and Cartesian coordinate systems. Rather, also polar coordinate systems may be used.

In addition to that, an automatic reduction of the tone quality interval may, of course, also be realized by two neighboring input fields 380. It is thus possible to allocate a small tone quality interval to one input field 380 and a larger tone quality interval to the other input field. In addition to that, there is optionally also the possibility to configure the frequency axis of the two input fields such that the first one of the two mentioned input fields is used for lower octave ranges and the other input field for higher octave ranges.

In other words, the device may further comprise another operating means which is implemented to enable a user of the same as an input to define one or several points as a further input signal. The operating means and the further operating means may in this case be implemented to enable a user to select one area each having one tone quality interval and one frequency interval each. The tone quality interval of the area which may be selected via the operating means is larger than the tone quality interval of the area which may be selected via the further operating means. A lowest frequency for the area which may be selected by the operating means is higher than a smallest frequency of the area which may be selected on the further operating means.

Of course, embodiments of the present invention are not limited to the tone quality interval being reduced. If the cutoff frequency 420 is exceeded when shifting a corresponding area 310, the respective tone quality interval may automatically be increased.

Alternatively, there is the possibility of adapting not (only) the form of the area but the weighting function allocating a weight or volume to each point of the selection area, so that dissonant or unwanted tones are changed depending on the frequency or the tone quality. Thus, the third might be provided with less weight, for example in middle frequency ranges.

Figure 14B:
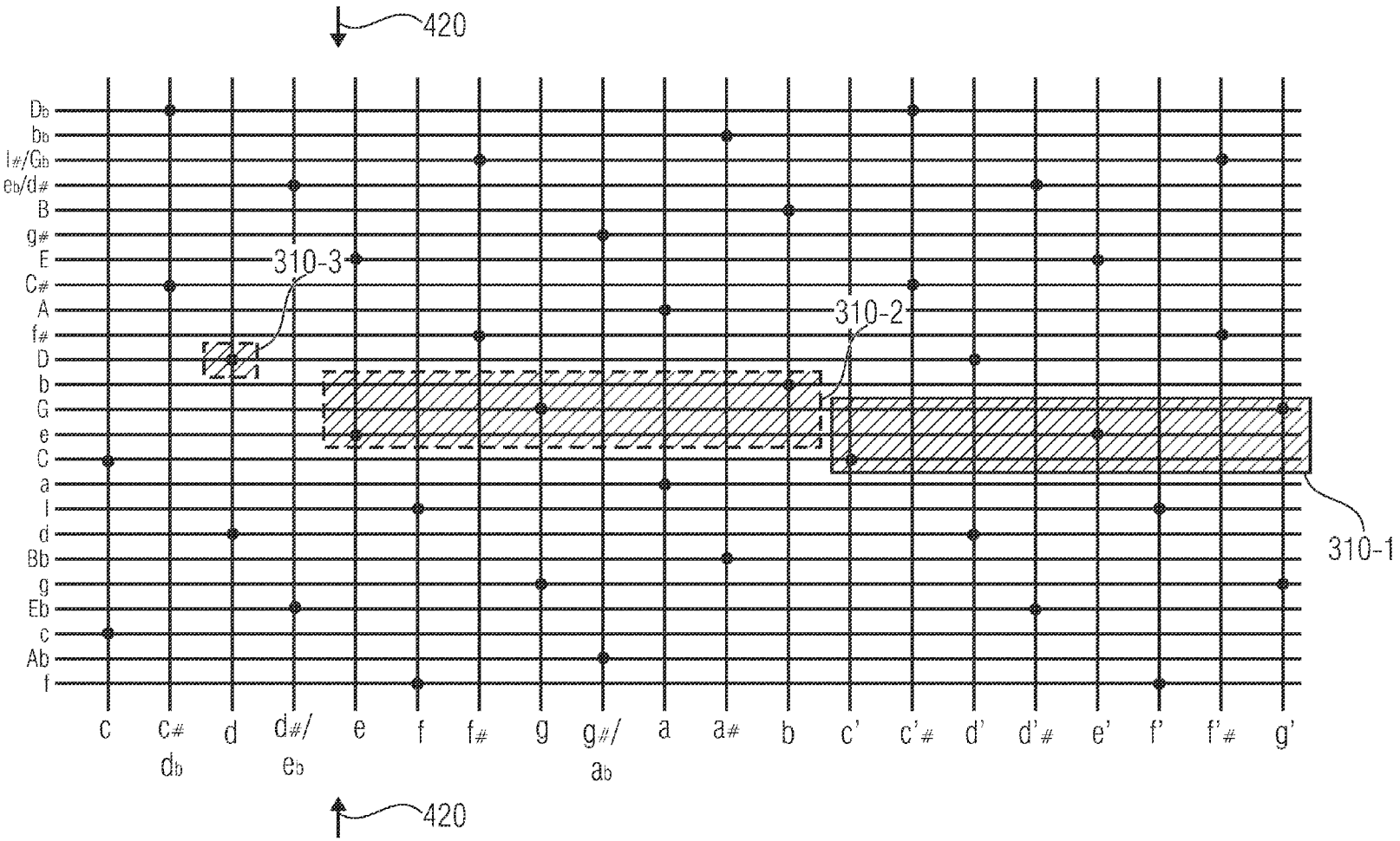
FIG. 14*b* illustrates a selection of several areas with the help of a device according to an embodiment of the present invention.

On the basis of the same allocation function, FIG. 14*b* illustrates a further optional implementation of all hitherto described and further described operating means 110 according to the embodiments of the present invention. To be more precise, this concerns the possibility of defining several selection areas 310-1, 310-2, . . . . In other words, in embodiments of the present invention optionally an area 310 may include several partial areas together not forming a connected or simply connected area.

Thus, by definition and independent control of several selection areas 310, also any mixed sounds may be generated. The parameters of the individual selection areas 310 may here be determined and fixed independently or together. Although hitherto only the selection of one single selection area 310 has been described, in many cases in other embodiments of the present invention also a selection of several areas 310 is possible. Technically, this may, for example, be also realized such that in the case of a touch-sensitive surface the individual, touched points are allocated to different selection areas 310. The position of the individual points is thus allocated to a characteristic position of the respective area 310, i.e. for example a vertex or corner point in the case of a rectangular area.

Thus, FIG. 14*b* initially shows an area 310-1 which leads to a C major chord sounding. If a second selection area 310-2 is now selected corresponding to an e minor chord, thus an overall sound impression of an e major chord results.

If, instead of the area 310-2, rather an area 310-3 is activated starting below the cutoff frequency 420, in the present case additionally a tone D will be played in bass possibly sounding together with the C major chord of the area 310-1.

Embodiments of the present invention also enable training a musician to think in terms of musical theory while simultaneously practicing the practical operation of the instrument. In this respect, a device according to an embodiment of the present invention, i.e. for example an electronic instrument with an affine or Cartesian orientation of the operating means may be combined with a circular display unit for using the periodicity in particular occurring with tone qualities which is mirrored in the closed circle for better understanding.

In addition to that it is possible, within the scope of embodiments of the present invention, to employ acceleration sensors such as are nowadays included in gaming consoles, media players and other small devices. Such new devices, such as the Wiimote or also the iPod Touch contain such acceleration sensors. Of course, these may also be implemented in other devices according to embodiments of the present invention in the operating means 110. The same may be integrated sensibly and supplementarily into the existing concept. Thus, for example, a device inclination angle of a parameter may be used for the definition of the selection area 310, for example to thus determine a relative reference position on the selection area, i.e. for example a starting tone quality, a starting frequency, a tone quality interval or a frequency interval, by the inclination of the device.

Commonly available touch-sensitive areas or touch surfaces today still have no possibility of detecting and measuring the pressure intensity or speed of a touch. The acceleration originating from the acceleration sensors may thus, for example, be used to determine the touch strength which in turn may influence the note signal regarding a volume information.

Thus, for example, in the iPod Touch three acceleration sensors are contained enabling the determination of the inclination of the device. Further, this device enables querying two touch points, so that, for example, the first point of contact or touch may be used for the definition of a first relative reference position on the selection area, i.e., for example, the starting tone quality and the starting frequency, and the second point of contact or touch may be used for the definition of a second relative reference position on the selection area, i.e., for example, a corresponding finishing tone quality and a corresponding finishing frequency for the definition of an area 310. Apart from that, also movements of the device for influencing the generated note signal may be used in another way. Thus, for example by shaking the instrument, chords may be arpeggiated.

There is the further possibility of using the acceleration sensors to pop up a context menu or indicate different auxiliary keys by tilting into a certain direction. Thus there is the possibility, for example, of showing/slotting in keys for changing the key or for raising or lowering tone qualities when a certain inclination angle is exceeded.

Figure 15A:
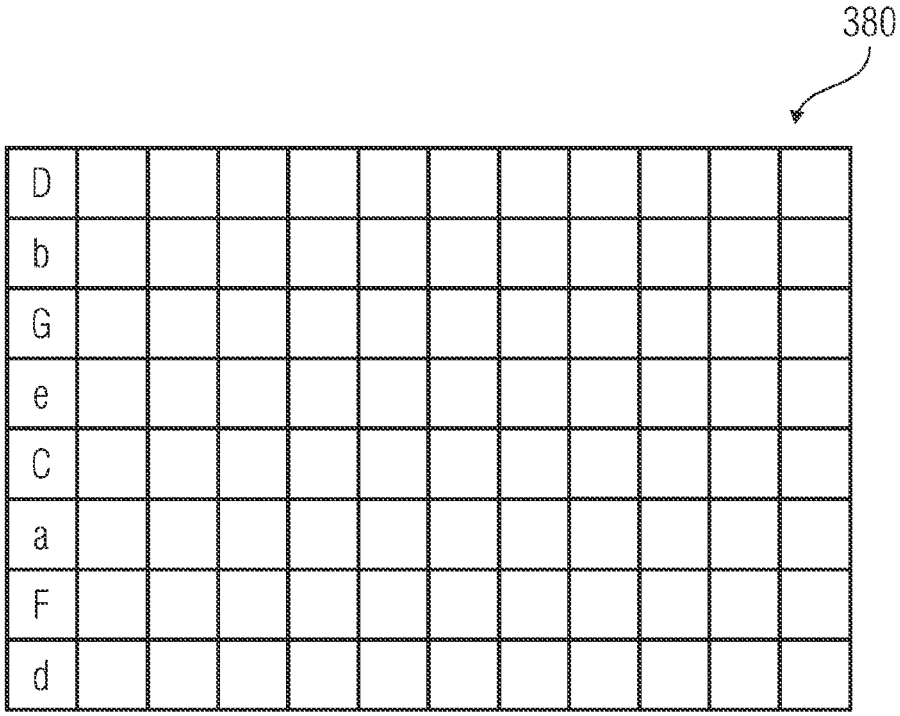
FIGS. 15*a* to 15*c* show a possible implementation of an embodiment according to the present invention in the case of a small device.

FIG. 15*a* shows a tone space which may, for example, be represented on a touch-sensitive surface of a very small device, i.e. for example a PDA (personal data assistant) or the above-mentioned iPod Touch. With these devices there is frequently no space for arranging additional keys for changing the key, as is, for example, illustrated in FIG. 11. On the respective screen of the display means 140 there is, in this case, frequently only space for representing the input field illustrated in FIG. 15*a*.

Figure 15B:
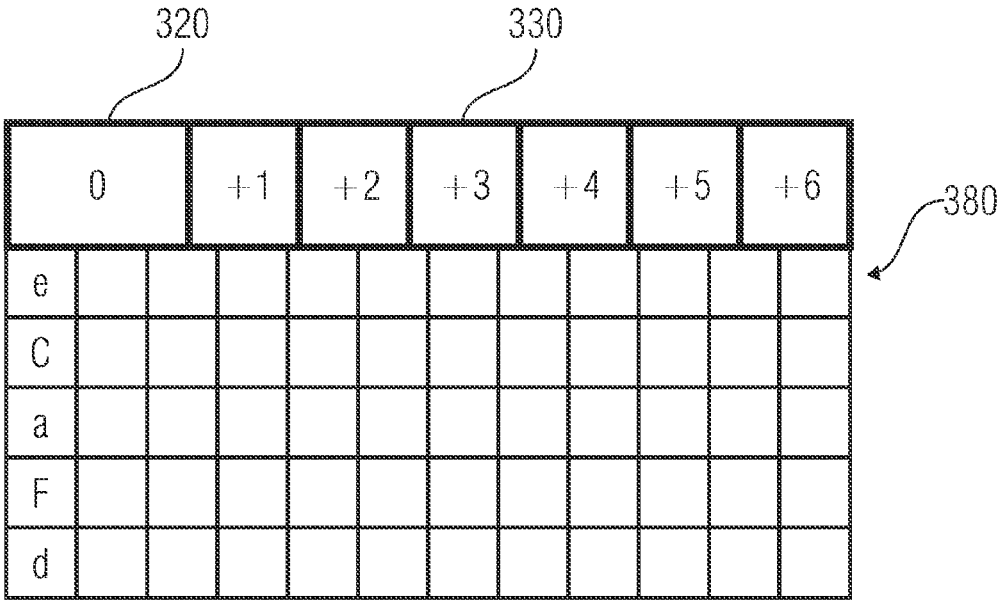
Figure 15C:
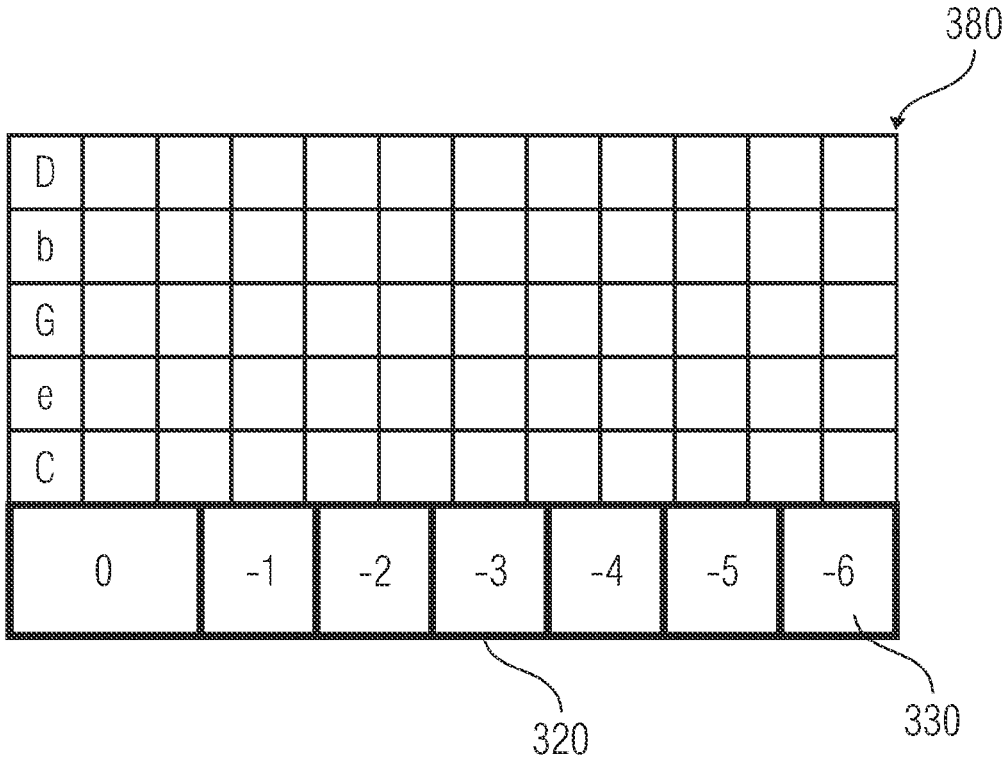

If such a device is now tilted forwards, the change of key keys 330 of the change of key operating means 320 may be slotted in above the input field 380. This is illustrated in FIG. 15*b*, wherein after tilting the device forwards the keys 330 for changing the key are indicated in an ascending direction according to the circle of fifths in a clockwise direction. Analog to that, change of key keys may also be slotted in below the selection area or the input field 380, as is illustrated in FIG. 15*c*. By tilting the device backwards, as illustrated in FIG. 15*c*, keys 330 for changing the key may be slotted in in a descending direction according to the circle of fifths in a counterclockwise direction. Also these keys 330 are part of a change of key operating means 320.

Accordingly, by an inclination to the right, tone quality raising keys may be slotted in, as well as tone quality lowering keys, which is not illustrated in the figures, when the corresponding device is inclined to the left. Optionally, also the further operating elements arranged outside the actual input field 380, illustrated for example in FIG. 11, may be slotted in above the input field 380.

Likewise, by an inclination, for example, a kind of "shift key functionality" may be activated, when, for example, different functions are allocated to different operating areas or buttons. More specific examples of this are described in connection with FIG. 17.

By touching a point on the touch-sensitive surface, in addition to that, depending on the tone quality interval, a whole chord may be played. If the user now touches a point A and then a closely neighboring point B, the following may happen. First of all the chord belonging to A is played. When touching the point B, those tones are played that are contained in the chord B but not contained in the chord A. When releasing the corresponding points, the same situation results for the deactivation of the tones.

It is now possible in embodiments according to the present invention to implement a functionality so that the chord A is held while chord B is struck again and again. Corresponding tones of the chord B are to be re-struck even if they belong to chord A. If, for example, an a minor chord is held, a C major chord is struck again and again. With regard to repetition frequency, volume and other parameters, such a function may, of course, be preprogrammed, influencable or completely freely programmable. Also rhythmic patterns may be considered when striking a key.

Technically, this may also be realized by allocating a different MIDI channel to the chord A as compared to the chord B. Accordingly, also the associated NoteOff commands are allocated to corresponding MIDI channels, so that the sound generator on the other hand knows and may detect which note has to be deactivated with a certain NoteOff command.

In embodiments of the present invention, of course a recording means may also be included which enables recording and editing chord sequences on the basis of the inputs of the user. Thus, for example a tool for the animation of two-dimensional paths (2D path animation tool) may be used. Paths are formed by the tone space and used with acceleration and speed information.

In addition to that it may also be advisable to implement a function for mirroring all axes. If, in the case of a Cartesian coordinate system, the representation, i.e. the arrangement of the axes may be rotated by 90° in a counterclockwise direction, then the tone qualities in the case of C major are d-b-G-e-C-a-F-d from left to right. It may, however, be the case that in such a case an arrangement is implemented according to the arrangement on a piano, i.e. in the direction of an ascending frequency. This is the reverse arrangement to the aforementioned arrangement, i.e. d-F-a-C-e-G-b-d. In other words, it may be advisable in the case of a rotatable allocation function or a corresponding display means, when rotating the same by 90° to also exchange the y axis. Of course, this may also be implemented in the case of non-rectangular coordinate systems, i.e. in the case of affine coordinate systems.

In the following, musical instruments are described as further embodiments of the present invention in connection with FIGS. 16 and 17, which may, for example, be employed commercially on the creative music market, on the market for musical education, in music schools, for music therapy and in the toy and music software industries, to mention only a few of the possible fields of use.

Figure 16:
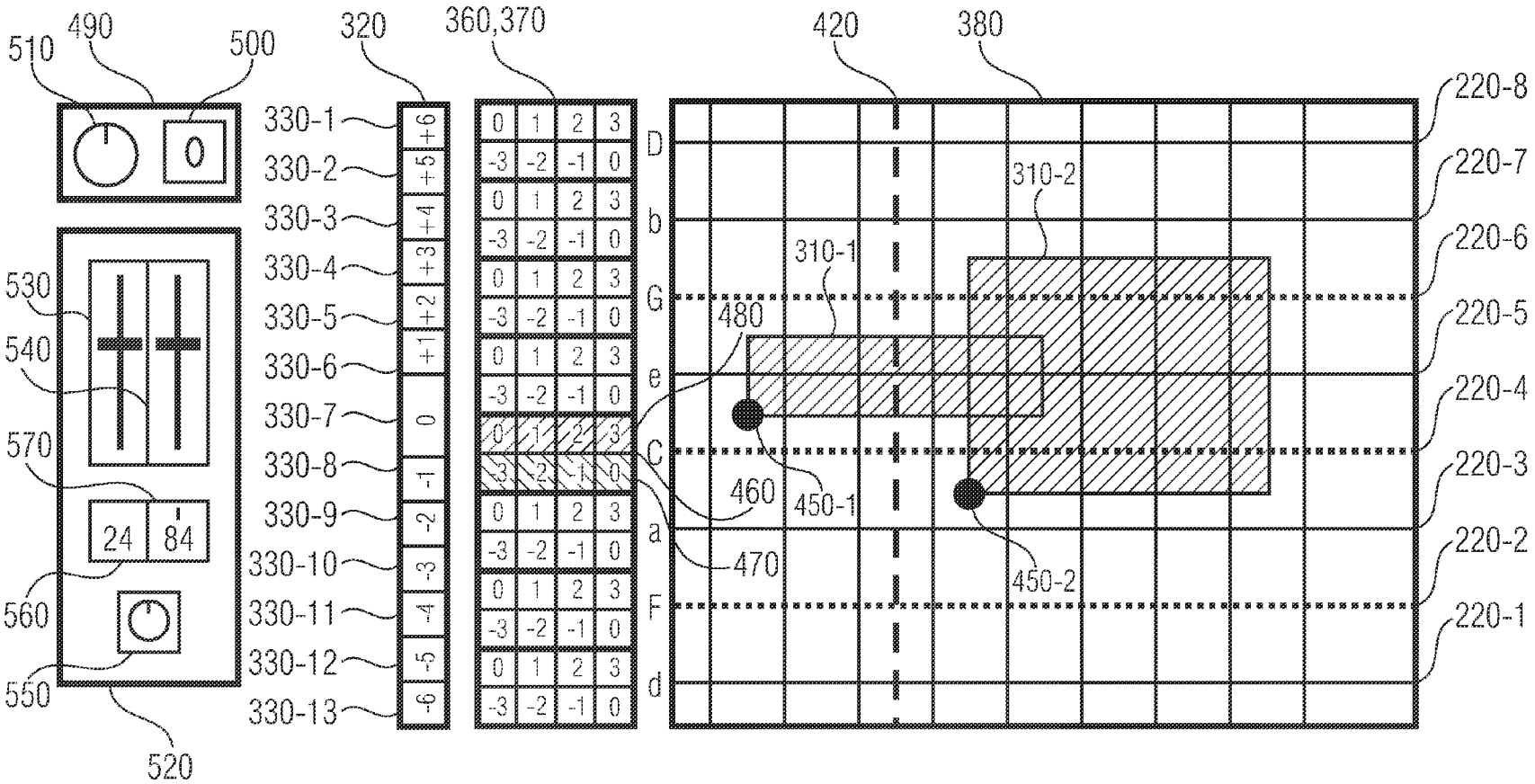
FIG. 16 illustrates a further embodiment of the present invention.

As a further embodiment according to the present invention, FIG. 16 shows a device with an operating means 110, also referred to as "big touch screen". The operating means 110 includes such an input area or input field 380 and a display unit for a relative reference position on the selection area, i.e., for example, a starting tone quality value and a starting frequency value. On the input field 380, also representing a display means, further tone information may be reproduced. In the present case, the input field 380 is capable of multi-touch, so that several areas 310-1 and/or several points may be selected simultaneously. In the illustration illustrated in FIG. 16, in the bass a tone e (area 310-1) and a C major chord in the top frequency range (area 310-2) are selected. The definition of the relative reference position on the selection area, i.e., for example, the starting tone quality and the starting frequency of the two selection areas 310-1, 310-2, is executed by touching the input field 380 at the reference points 450-1, 450-2 connected to the respective selection areas 310.

On the input field 380, further eight tone quality lines 220-1 to 220-8 are represented according to the symmetry circle model. For example, the tone quality line 220-1 is the tone quality d. Accordingly: 220-2=F, 220-3=a, 220-4=C, 220-5=e, 220-6=G, 220-7=b, 220-8=d.

Optionally, in addition to that, also marks of the major fundamental tones and intervals of fifths may be represented for better orientation. Thus, the tone quality lines 220-6, 220-4 and 220-2 marking the corresponding fundamental tones or tone qualities are correspondingly more strongly implemented or represented. Further, on the input field 380 the cutoff frequency or the threshold value is also plotted for reducing the tone quality interval 420. The operating means 110 further comprises tone raising keys or operating areas 360 of a tone quality changing operating means 370. The same is arranged on the left of the input field 380.

Here, the tone raising keys or sharp keys 360 are each divided into blocks 460, wherein each block is associated with a tone quality line 220. The block 460 which is marked in FIG. 16 is associated with the tone quality line 220-4 (C).

Each of the blocks 460 is here divided into a top block 470 and a bottom block 480 which are arranged on top of each other. The top block 470 raises the tone qualities by one, two or three semitones, depending on which of the corresponding operating areas 360 are pressed. The bottom block 480 correspondingly lowers the tone qualities by one, two or three semitones.

The keys of the blocks 470, 470 designated by "0", reset the raising or lowering of the tone qualities again.

By the arrangement of the tone raising keys 360 on the left of the operating area 380 (touchpad 380), an operation may be executed with the thumb of the right hand, while the other fingers of the same hand play the corresponding chord. For left-handers, of course, a mirrored arrangement or an arrangement changed with respect to its order may be implemented.

The operating means 110 further includes an input and display element 490 for setting and displaying the absolute key. The same itself includes a display 500 displaying the number of the sign (−6, . . . , +6) or beyond that or the key designation (F# major, . . . , Gb major). In addition to that, it further includes a rotary knob or rotary regulator 510, via which the allocation of the keys may be executed according to the circle of fifths. If the regulator position is turned to the top, the C major or a minor key (0) will be selected. If, however, the regulator position is turned to the left up to the stop position, the current key will be Gb major or eb minor (−6). Accordingly, when rotating the regulator 510 to the stop position in the opposite direction, the F# major or d# minor key will be selected (+6). In the situation illustrated in FIG. 16, the C major key (0) is currently selected.

The operating means 110 further includes key changing keys 330 of a key changing operating means 320 for a relative change of key. A key 330-8 leads to a change of key which is in a counterclockwise direction to the current key in the circle of fifths 1. This may be set using the operating means 490. If, for example, currently the A major key (+3) was set, a corresponding change of key would lead to the D major or b minor key (+3+(−1)=+2). A change of key is thus possible without a change at the input or display element 490. By pressing the key 330-7 (key 0) this relative change of key is reversed again and the key displayed by the input and display element 490 is activated again.

Accordingly, upon the operation of the key 330-6 (key +1), the key in the circle of fifths is changed by 1 in a clockwise direction with respect to the current key. In the example mentioned above, thus the key would change to +3+(+1)=+4, i.e. E major or c# minor. The same holds true also for the other keys 330-1 to 330-5 (keys +6 to +2) and the keys 330-9 to 330-13 (keys −2 to −6).

The operating means 110 further includes further configuration elements 520, more precisely a regulator 530 for the tone quality interval, a regulator 540 for the frequency interval, and a regulator 550 for the cutoff frequency 420 for reducing the tone quality interval. In the present example, a value of 0.3 is set, wherein the value range enables the values between 0 and 1. If a starting frequency is input in the input field 380, which is smaller than 0.3 of a selected frequency band, the tone quality interval is automatically reduced so that only one tone is selected.

In addition to that, the further configuration elements 520 include an input field 560 for the definition of the lowest tone of the selection. In the example of FIG. 16, the tone pitch indication is implemented in the form of MIDI note numbers. In the example, i.e. as the lowest tone, the tone 24 is set, which is associated with the starting frequency 0.0. Accordingly, the operating means 110 in the further configuration elements 520 includes a further input field 570 for inputting the highest tone of the selection. In the example, again as the highest tone, the tone 84 is set, which is associated with the above-referenced value 1.0. The selected frequency band thus includes the tones of the MIDI notes 24 to 84.

For illustrating the operation, in the following an operation example is described. First of all, the defaults are made. I.e., first the C major key is executed in the operating element 490. Subsequently, a tone quality interval is set with the help of the regulator 530 such that three tones are selected. In addition to that, a corresponding appropriate configuration of the settings 540 to 570 is executed.

If, subsequently, as a starting example (example 0), a cadence C major, F major, G major, C major is played, first of all the input field 380 on the tone quality line for the tone C 220-4 is touched. The C major chord is played. Subsequently, the input field 380 at the tone quality line 220-2 for the tone F is touched. The F major chord is played.

Subsequently, on the input field 380 the tone quality line 220-6 for the tone G is touched, so that the G major chord is played. Subsequently, the tone quality line 220-4 of the input field 380 is touched again so that the C major chord is played.

In a further example (example 1) a C major chord is played with a third in bass. For this purpose, first of all on the touchpad or the input field 380 on the tone quality line 220-5 for the tone e the same is touched on the left of the mark of the threshold frequency (threshold mark) 420. In this case, only the tone e is played. Subsequently, the touchpad 380 on the tone quality line for the tone C 220-4, that is right of the mark of the cutoff frequency 420, is touched, so that the whole chord is played according to the tone quality interval set by the regulator 530. If the touch-sensitive surface 380 is released, the sound stops again.

In a further example (example 2) a sequence C major, E major, a minor is played. First of all, again the touchpad 380 on the tone quality line 220-4 for the tone C is touched. The area 380 is, however, not released. The C major chord sounds. While the touchpad or touch area 380 is still being touched and the C major chord is still sounding, the relative key changing key 330-3 is pressed. The fixedly set C major key in the input and display element 490 is transposed by +4 keys, i.e. brought to E major. At the point where the C major chord was previously located in the touchpad 380, now the E major chord is positioned. Immediately, the E major chord sounds. Subsequently, by simultaneously pressing the relative key changing key 330-7 "+/−0" or "0", the key may again be set back to the default value, i.e. the default key C major and a minor. Further, the touchpad 380 is touched at the tone quality line 220-3 *(a)*.

In the next example (example 3) a sequence C major, e minor with b in the bass, C7 with Bb in the bass and a7 (seventh chord on the basis of a minor) is played. First of all, the touchpad 380 is touched in two positions on the tone quality line 220-4 (C). This takes place once on the left of the cutoff frequency mark 420 for playing the fundamental tone and on the right of the cutoff frequency line 420 for playing the chord.

Subsequently, the tone quality C is lowered by half a tone by touching the flat key "−1" associated with the tone quality C in the block 480. The tone C is lowered by half a tone to B. The e minor chord with B in the bass sounds.

Subsequently, the tone quality C is lowered by 2 semitones by touching the flat key "−2" associated with the tone quality C of the same block 480. The tone C is lowered to the tone Bb or B. A chord Bb-e-g sounds which may be interpreted as C7 with B in the bass. Subsequently, the tone quality C is lowered by 3 semitones by touching the flat key "−3" associated with the tone quality C of the same block 480. The tone C is lowered to the tone a. A chord a-e-g sounds which may be interpreted as a7.

A further embodiment which is similar to the embodiment described above in connection with FIG. 16 may be realized by the touch surface 380 being replaced by a key matrix of n×m keys, wherein n and m are natural numbers, for example powers of 2 or also other natural numbers. Here, n and m may both be identical and also different. In the case of an operating surface, as is, for example, implemented in the Yamaha Tenori-On, this is here a key matrix including 16×16 keys. The respective x and y coordinates or positions of the keys are associated with corresponding points and thus starting tone qualities and starting frequencies. In other words, the corresponding x/y key index is mapped to the parameters of the selection area.

Depending on the specific implementation, here the corresponding note signal may be calculated contemporarily on the basis of the allocation function and the input signal or be obtained in a pre-stored way. As explained above, thus, for example, the corresponding note signal may be stored in a table.

Figure 17:
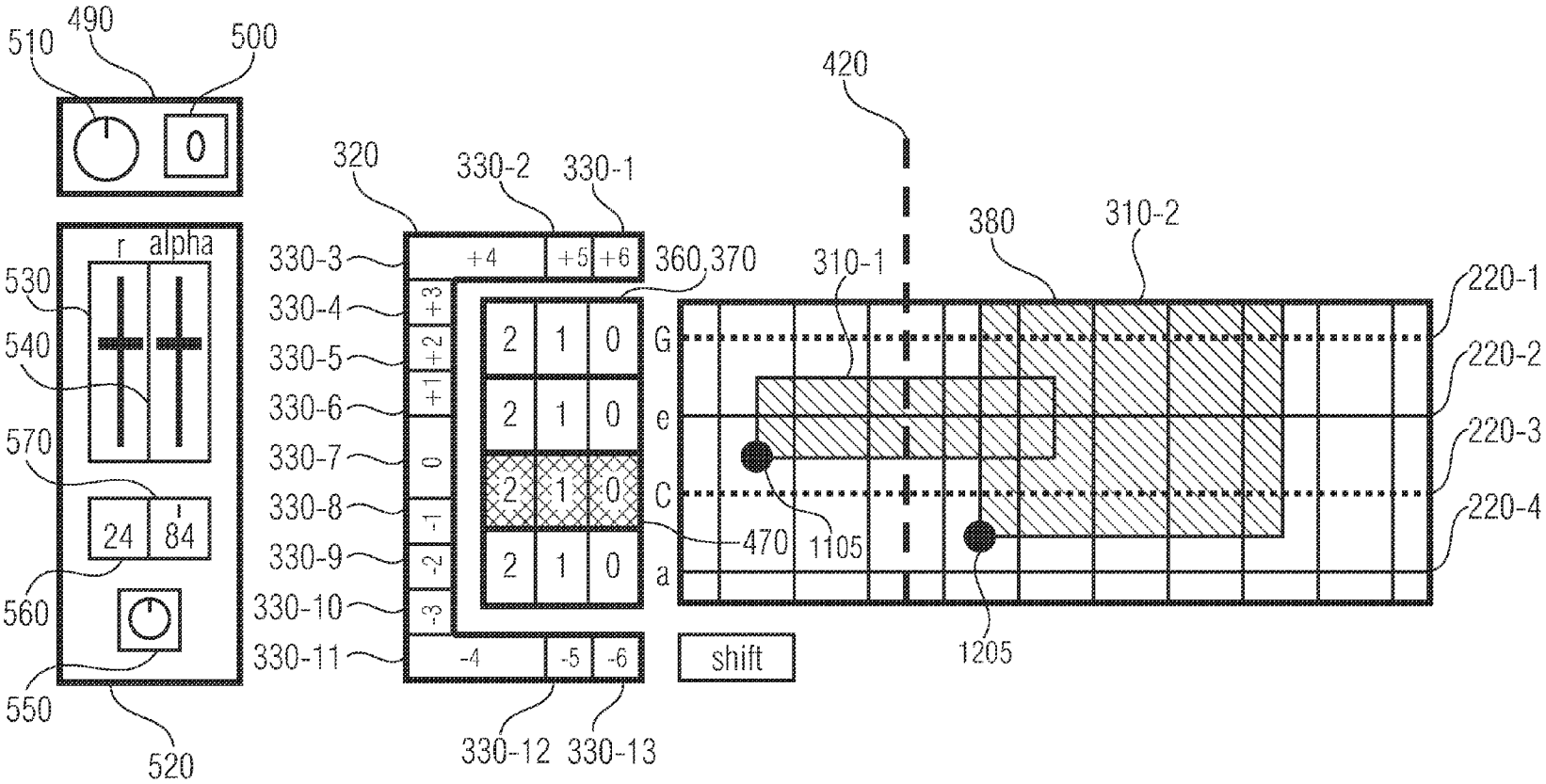
FIG. 17 shows a further embodiment according to the present invention.

FIG. 17 shows a further embodiment according to the present invention with an operating means 110. This embodiment is a device which is also referred to as a "small device".

The operating means 110 thus includes an input field 380 for inputting and for the definition of the selection area or selection function. This may, for example, be done by inputting the starting tone qualities and starting frequencies. This is also capable of multi-touch, so that several areas 310-1 or 310-2 or corresponding points may be selected simultaneously. In FIG. 17 two areas are selected which correspond to a C in the bass area and an e minor chord above it.

In the embodiment illustrated in FIG. 17, only four tone quality lines 220-1 to 220-4 according to the symmetry model are illustrated. In the present case, i.e. for the C major or a minor key, thus the tone quality line 220-1 corresponds to the tone quality G, the tone quality line 220-2 to the tone quality e, the tone quality line 220-3 to the tone quality C and the tone quality line 220-4 to the tone quality a. As was already explained in connection with FIG. 16, also here the fundamental major tones are highlighted for better orientation. Accordingly, the tone quality lines G and C (220-1, 220-3) are optically highlighted. In addition to that, again in the input field 380 the cutoff frequency is designated as such via a mark 420 leading to a reduction of the tone quality interval.

As a new element, the operating means 110 of FIG. 17 includes a shift key 580 for shifting key functionalities. Thus, for example, with the help of the shift key 580, the key regulator 510 already described in connection with FIG. 16 may also be realized as follows. With the help of the shift key 580 and the keys for inputting the relevant key 320, by operating the shift key 580, the functionality of the key changing keys 320 may be changed such that the relative key is no longer associated with the same but rather an absolute key. A sensible allocation might here be realized, for example, by allocating the keys Gb major with 6 flat signs (b) via C major without signs up to F# major with 6 sharp signs (or #) to the keys 330-13 (−6) and 330-7 (0) up to 330-1 (+6). Of course, also other allocations may be entered.

The operating means 110 further accordingly includes tone quality raising keys or tone raising keys 360, together forming a tone quality changing operating means 370. The same is arranged on the left next to the input field 380. One block 470 is here only associated with one tone quality line. The block 470 is associated with the tone quality line 220-3 (C) in FIG. 17. Depending on the pressed key or depending on the pressed operating area, the same raises the tone quality line by one, two or three semitones. In the case of a simultaneous pressing together with the shift key 580, thus the corresponding tone quality may be lowered by the same keys by one, two or three tones.

In addition to that, the operating means 110 again includes an input and display element 490 for setting and displaying the absolute key, as was already described in connection with FIG. 16. Further, the operating means 110 also includes change of key keys 330, together forming a change of key operating means 320. The same serve for changing the relative key and basically correspond to the embodiment illustrated in FIG. 16 with respect to the functionality. However, in contrast to the above-described embodiments, the same are implemented in a bent way and comprise a different key size which corresponds to the frequency of use of the keys. Also the further configuration elements 520 correspond to those of the above-described embodiment, wherein, however, the illustration may optionally also be executed on a separate screen.

In the following, an operating example for the above-described embodiment is presented. First of all, as described above, the corresponding default settings are made. Subsequently, to play the above-mentioned example (example 0) of a cadence of a C major chord, an F major chord, a G major chord and a C major chord, the touchpad 380 on the tone quality line 220-3 of the tone quality C is touched. As a consequence, the C major chord is played. Subsequently, the relative change of key 330-8 (−1) is touched, whereupon the F major chord sounds. Subsequently, the relative change of key 330-6 (+1) is touched, whereupon the G major chord is played. Subsequently, the relative change of key 330-7 (+/−0 or 0) is touched, whereupon again the D major chord sounds.

The further mentioned examples (examples 1, 2, 3) are different with regard to the operation of the operating means 110 from the above-described inputs.

In a further embodiment not illustrated in any figure and also referred to as "rotated touchscreen", there is the possibility of exchanging the tone quality axis 200 and the frequency axis 210 with respect to their arrangement. This has the advantage that, in the case of playing a single tone, the tone qualities are placed onto the x axis, for example, which comes closest to the natural hand movement of a human being. If a chord is to be played in this situation and different tone qualities are thus to be selected, the same may be selected by a hand movement along the x axis which is easiest for a human being. Accordingly, tone raising or sharp keys may be arranged at the top and tone lowering or flat keys at the bottom. The tone quality axis increases towards the right. In the case of C major, thus a possible arrangement of the tone qualities is d-F-a-C-e-G-b-d.

In a further embodiment which may, for example, be implemented in an iPod Touch, a combination of acceleration sensors and a touchscreen may be used. Basically, such an embodiment may be realized on the basis of the embodiment illustrated in FIG. 17, considering some additional functionalities. Thus, when inclining the device forwards, which is determined via the acceleration sensors, the tone space may be shifted by a fifth in the clockwise direction. If, for example, the C major chord is currently selected, the same is transformed into an F major chord by an inclination of the device. If the a minor chord is currently selected, this chord is transformed into an e minor chord.

When the device is inclined backwards, the performance is basically the same as when the device is inclined forwards, with the difference that the tone space is shifted by a fifth in the counterclockwise direction. A C major chord is consequently turned into a G major chord, an a minor chord into a d minor chord. It is, of course, also possible to extend the mapping of the acceleration sensors to the tone space and selection parameters or to change the same.

Depending on the conditions, an embodiment of a method may be implemented in hardware or in software. The implementation may be on a digital storage medium, for example a floppy disc, a CD, a DVD or a memory card having electronically readable control signals which may cooperate with a programmable computer system so that an embodiment of the method is executed. In general, embodiments of the present invention thus also consist in a software program product or a computer program product or a program product having a program code stored on a machine-readable carrier for executing an embodiment of a method when the software program product is executed on a computer or a processor. In other words, embodiments of the present invention may thus be realized as a computer program or software program or program having a computer program code for executing an embodiment of a method, when the program is executed on a processor. The processor may here be formed by a computer, a computing device, a chip card (smartcard), an application-specific integrated circuit (ASIC), a system on chip (SOC), a mobile telephone, a PDA, a media player, a small computer or another integrated circuitry.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A device for generating a note signal upon a manual input, comprising:

an operator which is implemented to enable, as an input, a user of the same to define one or several points as an input signal; and a controller implemented to receive the input signal and to generate a note signal based on the input signal and an allocation function, wherein the allocation function allocates one single or no tone to each point of a two-dimensional definition amount determined via an affine coordinate system and comprising a tone quality axis and a frequency axis;

wherein the definition amount comprises a plurality of base points;

wherein to each of the base points exactly one tone is allocated, which may be uniquely determined by a tone quality and a frequency, wherein the tone quality indicates relational connections between tones;

wherein to base points comprising the same coordinate on the tone quality axis tones comprising the same tone quality are allocated;

wherein at least two of the base points comprising an identical coordinate on the tone quality axis exist which comprise different coordinates on the frequency axis; and wherein to each point of the definition amount which is not a base point either no tone or a tone associated to a base point is associated and, if there is a point which is not a base point and to which a tone is associated, this tone belongs to a simply connected area of the definition amount in which further a base point is located and in which the same tone is associated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area.

2. The device according to claim 1, wherein the controller is implemented so that the affine coordinate system is a Cartesian coordinate system.

3. The device according to claim 1, wherein a tone distance between a tone quality of a tone associated to a base point and a tone quality of a tone of a neighboring base point closest with respect to the tone quality axis is a prime, a small third, a major third, a fourth or a fifth.

4. The device according to claim 1, wherein the operator is implemented to enable a user to select the area by a designated point, a tone quality interval and a frequency interval or by the selection of two designated points which are characteristic for the area with regard to the underlying coordinate system.

5. The device according to claim 1, wherein the operator is further implemented to enable a user of the same to generate a changeover signal, and wherein the controller is implemented to receive the changeover signal and to modify the allocation function to acquire a modified allocation function.

6. The device according to claim 5, wherein the controller is implemented to acquire an allocation function shifted with respect to the tone quality axis, the frequency axis or the tone quality axis and the frequency axis as a modified allocation function.

7. The device according to claim 5, wherein the controller is implemented so that the definition amount of the modified allocation function comprises a first point to which the same tone is allocated via the allocation function as via the modified allocation function, and wherein the definition amount of the modified allocation function comprises a second point to which via the modified allocation function a tone with a tone quality is allocated which is different from a tone quality of a tone allocated to a point with the same coordinate on the tone quality axis via the allocation function.

8. The device according to claim 4, wherein the controller is implemented so that to points with a common coordinate on the tone quality axis via the modified allocation function tones are allocated which comprise a common tone quality deviating via the allocation function from a common coordinate.

9. The device according to claim 1, wherein the operator is implemented to enable a user of the same to generate an influencing signal, and wherein the controller is implemented to generate the note signal upon the influencing signal with tones which are transposed as a whole by a number of semitones with respect to tones based on the input signal and the allocation function, wherein the influencing signal comprises information with respect to the number of the semitones.

10. The device according to claim 1, wherein the controller is implemented to generate the note signal such that the note signal comprises volume information and wherein the controller is implemented so that the allocation function allocates volume information for the respective tone to each point to which a tone is allocated.

11. The device according to claim 10, wherein volume information for the points comprised in the area is allocated to one, a plurality, a multitude or all connected areas of the definition amount, wherein the information is based on the coordinates of the points with respect to the tone quality axis and the frequency axis and a single tone volume function.

12. The device according to claim 1, wherein the operator is implemented to enable a user of the same to define an area as an input signal, wherein the area comprises a tone quality interval and wherein the tone quality interval depends on a smallest frequency of all points of the area.

13. The device according to claim 12, wherein the operator is implemented to reduce the tone quality interval from a first value above a cutoff frequency to a second value below a cutoff frequency, wherein the second value is smaller than the first value.

14. The device according to claim 1, further comprising a further operator which is implemented to enable a user of the same as an input to define one or several points as a further input signal, wherein the operator and the further operator are implemented to enable a user to select one area each comprising one tone quality interval and one frequency interval each, wherein the tone quality interval of the area which may be selected via the operator is larger than the tone quality interval of the area which may be selected via the further operator, and wherein a smallest frequency for the area which may be selected on the operator is larger than a smallest frequency of the area which may be selected on the further operator.

15. The device according to claim 1, wherein the operator comprises a key, a touchscreen, a touch-sensitive area, a joystick, a mouse, a keypad or an acceleration sensor to enable the input to the user.

16. The device according to claim 1, wherein the operator comprises a keypad with a two-dimensional raster of keys, wherein a point is allocated to each key, so that either at least one tone or no tone is allocated to the keys via the allocation function of the controller and the two-dimensional raster of keys reproduces the allocation function.

17. The device according to claim 16, wherein either no tone, one tone, or a plurality of tones is allocated to each key of the keypad in a pre-stored way, so that such tones, which are allocated via the allocation function to a plurality of points via a connected area, are allocated at least to each key to which a plurality of tones is allocated, wherein the point allocated to the keys is part of the area.

18. A method for generating a note signal upon a manual input into an operator, including:

receiving an input signal defining one or several points; and generating a note signal on the basis of an allocation function and the input signal, wherein the allocation function allocates one single or no tone to each point of a two-dimensional definition amount determined via an affine coordinate system and comprising a tone quality axis and a frequency axis, wherein the tone quality indicates relational connections between tones;

wherein the definition amount comprises a plurality of base points;

wherein exactly one tone which may be uniquely determined by a tone quality and a frequency is allocated to each of the base points;

wherein to base points comprising the same coordinate on the tone quality axis tones with the same tone quality are allocated;

wherein at least two of the base points with an identical coordinate on the tone quality axis exist which comprise different coordinates on the frequency axis; and wherein either no tone or a tone allocated to a base point is allocated to each point of the definition amount which is not a base point and, if there is a point which is not a base point and to which a tone is allocated, this tone belongs to a simply connected area of the definition amount in which a base point is further located and in which the same tone is allocated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area.

19. A non-transitory storage medium having stored thereon a computer program comprising program code for executing a method for generating, when the computer program is executed on a processor, a note signal upon a manual input into an operator, the method including:

receiving an input signal defining one or several points; and generating a note signal on the basis of an allocation function and the input signal, wherein the allocation function allocates one single or no tone to each point of a two-dimensional definition amount determined via an affine coordinate system and comprising a tone quality axis and a frequency axis, wherein the tone quality indicates relational connections between tones;

wherein the definition amount comprises a plurality of base points;

wherein exactly one tone which may be uniquely determined by a tone quality and a frequency is allocated to each of the base points;

wherein to base points comprising the same coordinate on the tone quality axis tones with the same tone quality are allocated;

wherein at least two of the base points with an identical coordinate on the tone quality axis exist which comprise different coordinates on the frequency axis; and wherein either no tone or a tone allocated to a base point is allocated to each point of the definition amount which is not a base point and, if there is a point which is not a base point and to which atone is allocated, this tone belongs to a simply connected area of the definition amount in which a base point is further located and in which the same tone is allocated to all points, wherein the operator is implemented to enable a user of the same to select an area so that the point or the several points of the input signal are given by the area, wherein tones on the frequency axis are arranged in an order corresponding to the tone pitch, wherein an area of any form may be selected, wherein by shifting this area along the frequency axis, automatically an inversion of a chord may be formed defined by the area.

* * * * *